US009479886B2

(12) United States Patent
Xiang et al.

(10) Patent No.: US 9,479,886 B2
(45) Date of Patent: *Oct. 25, 2016

(54) SCALABLE DOWNMIX DESIGN WITH FEEDBACK FOR OBJECT-BASED SURROUND CODEC

(71) Applicant: QUALCOMM Incorporated, San Diego, CA (US)

(72) Inventors: Pei Xiang, San Diego, CA (US); Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 322 days.

This patent is subject to a terminal disclaimer.

(21) Appl. No.: 13/945,806

(22) Filed: Jul. 18, 2013

(65) Prior Publication Data

US 2014/0023196 A1 Jan. 23, 2014

Related U.S. Application Data

(60) Provisional application No. 61/673,869, filed on Jul. 20, 2012, provisional application No. 61/745,129, filed on Dec. 21, 2012, provisional application No. 61/745,505, filed on Dec. 21, 2012.

(51) Int. Cl.
*H04S 1/00* (2006.01)
*G10L 19/008* (2013.01)
(Continued)

(52) U.S. Cl.
CPC ..... *H04S 1/007* (2013.01); *G10L 19/008* (2013.01); *H04S 7/30* (2013.01); *G10L 19/22* (2013.01);
(Continued)

(58) Field of Classification Search
CPC ..... G10L 19/008; G10L 19/00; G10L 19/24; G10L 19/22; H04S 1/007; H04S 7/30; H04S 2400/03; H04S 2400/11; H04S 2400/15; H04S 2420/03; H04S 2420/11
USPC ..... 381/1, 17, 22, 23; 704/500–504; 700/94
See application file for complete search history.

(56) References Cited

U.S. PATENT DOCUMENTS 7,006,636 B2 2/2006 Baumgarte et al.
7,356,465 B2 4/2008 Tsingos et al.
(Continued)

FOREIGN PATENT DOCUMENTS

WO 2011160850 A1 12/2011
WO 2012098425 A1 7/2012
WO 2015059081 A1 4/2015

OTHER PUBLICATIONS

Advanced Television Systems Committee (ATSC): "ATSC Standard: Digital Audio Compression (AC-3, E-AC-3)," Doc. A/52:2012, Digital Audio Compression Standard, Mar. 23, 2012, 269 pp., Accessed online Jul. 15, 2012 < URL: www.atsc.org/cms/standards >.
(Continued)

*Primary Examiner* — David Ton
(74) *Attorney, Agent, or Firm* — Shumaker & Sieffert, P.A.

(57) ABSTRACT

In general, techniques are described for grouping audio objects into clusters. In some examples, a device for audio signal processing comprises a cluster analysis module configured to group, based on spatial information for each of N audio objects, a plurality of audio objects that includes the N audio objects into L clusters, where L is less than N, wherein the cluster analysis module is configured to receive information from at least one of a transmission channel, a decoder, and a renderer, and wherein a maximum value for L is based on the information received. The device also comprises a downmix module configured to mix the plurality of audio objects into L audio streams, and a metadata downmix module configured to produce, based on the spatial information and the grouping, metadata that indicates spatial information for each of the L audio streams.

43 Claims, 39 Drawing Sheets

(51) Int. Cl.

| | |
|---|---|
| ***H04S 3/00*** | (2006.01) |
| ***G10L 19/22*** | (2013.01) |
| ***G10L 19/24*** | (2013.01) |
| ***H04S 7/00*** | (2006.01) |

(52) U.S. Cl.
CPC ..... *G10L 19/24* (2013.01); *H04S 3/008* (2013.01); *H04S 2400/03* (2013.01); *H04S 2400/11* (2013.01); *H04S 2400/15* (2013.01); *H04S 2420/03* (2013.01); *H04S 2420/11* (2013.01)

(56) References Cited

U.S. PATENT DOCUMENTS

| | | | | |
|---|---|---|---|---|
| 7,447,317 | B2 | 11/2008 | Herre et al. | |
| 7,756,713 | B2 | 7/2010 | Chong et al. | |
| 7,979,282 | B2 | 7/2011 | Kim et al. | |
| 8,180,061 | B2 | 5/2012 | Hilpert et al. | |
| 8,234,122 | B2 | 7/2012 | Kim et al. | |
| 8,315,396 | B2 | 11/2012 | Schreiner et al. | |
| 8,379,023 | B2 | 2/2013 | Aristarkhov | |
| 8,385,662 | B1 | 2/2013 | Yoon et al. | |
| 9,100,768 | B2 | 8/2015 | Batke et al. | |
| 2003/0147539 | A1 | 8/2003 | Elko et al. | |
| 2003/0182001 | A1 | 9/2003 | Radenkovic et al. | |
| 2006/0045275 | A1 | 3/2006 | Daniel | |
| 2008/0140426 | A1* | 6/2008 | Kim | G10L 19/008 704/500 |
| 2009/0125313 | A1 | 5/2009 | Hellmuth et al. | |
| 2009/0125314 | A1 | 5/2009 | Hellmuth et al. | |
| 2009/0210238 | A1* | 8/2009 | Kim | G10L 19/008 704/500 |
| 2009/0210239 | A1* | 8/2009 | Yoon | G10L 19/008 704/500 |
| 2009/0265164 | A1 | 10/2009 | Yoon et al. | |
| 2009/0287495 | A1 | 11/2009 | Breebaart et al. | |
| 2010/0094631 | A1 | 4/2010 | Engdegard et al. | |
| 2010/0121647 | A1 | 5/2010 | Beack et al. | |
| 2010/0191354 | A1* | 7/2010 | Oh | G10L 19/008 700/94 |
| 2010/0228554 | A1 | 9/2010 | Beack et al. | |
| 2010/0324915 | A1 | 12/2010 | Seo et al. | |
| 2011/0022402 | A1 | 1/2011 | Engdegard et al. | |
| 2011/0040395 | A1 | 2/2011 | Kraemer et al. | |
| 2011/0182432 | A1 | 7/2011 | Ishikawa et al. | |
| 2011/0249821 | A1 | 10/2011 | Jaillet et al. | |
| 2011/0249822 | A1 | 10/2011 | Jaillet et al. | |
| 2011/0264456 | A1 | 10/2011 | Koppens et al. | |
| 2011/0268281 | A1 | 11/2011 | Florencio et al. | |
| 2012/0155653 | A1 | 6/2012 | Jax et al. | |
| 2012/0232910 | A1* | 9/2012 | Dressler | G10L 19/008 704/500 |
| 2012/0314878 | A1 | 12/2012 | Daniel et al. | |
| 2013/0022206 | A1 | 1/2013 | Thiergart et al. | |
| 2013/0132099 | A1 | 5/2013 | Oshikiri et al. | |
| 2013/0202129 | A1* | 8/2013 | Kraemer | G10L 19/00 381/77 |
| 2014/0023197 | A1* | 1/2014 | Xiang | H04S 1/007 381/17 |
| 2014/0025386 | A1 | 1/2014 | Xiang et al. | |
| 2015/0163615 | A1 | 6/2015 | Boehm et al. | |
| 2016/0104492 | A1* | 4/2016 | Dressler | H04S 3/02 381/23 |

OTHER PUBLICATIONS

Bates, "The Composition and Performance of Spatial Music", Ph.D. thesis, Univ. of Dublin, Aug. 2009, pp. 257, Accessed online Jul. 22, 2013 at http://endabates.net/Enda%20Bates%20-%20The%20Composition%20and%20Performance%20of%-20Spatial%20Music.pdf.

Braasch, et al., "A Loudspeaker-Based Projection Technique for Spatial Music Applications Using Virtual Microphone Control", Computer Music Journal, 32:3, pp. 55-71, Fall 2008, Accessed online Jul. 6, 2012; available online Jul. 22, 2013 at http://www.rpi.edu/giving/print/Disney%20present/BraaschValentePeters2008CMJ_ViMiC.pdf.

Breebaart, et al., "Background, Concept, and Architecture for the Recent MPEG Surround Standard on Multichannel Audio Compression", pp. 21, J. Audio Eng. Soc., vol. 55, No. 5, May 2007, Accessed online Jul. 9, 2012; available online Jul. 22, 2013 at www.jeroenbreebaart.com/papers/jaes/jaes2007.pdf.

Breebaart, et al., "Binaural Rendering in MPEG Surround", EURASIP Journal on Advances in Signal Processing, vol. 2008, Article ID 732895, Revised Nov. 12, 2007, 14 pp.

Breebaart, et al., "MPEG Spatial Audion coding/MPEG surround: Overview and Current Status," Audio Engineering Society Convention Paper, Presented at the 119th Convention, Oct. 7-10, 2005, USA, 17 pp.

Breebaart, et al., "Parametric Coding of Stereo Audio", EURASIP Journal on Applied Signal Processing 2005: Revised Jul. 22, 2004, pp. 1305-1322.

European Broadcasting Union (EBU): "Specification of the Broadcast Wave Format (BWF): A format for audio data files in broadcasting, Supplement 1—MPEG audio", EBU-TECH 3285-E Supplement 1, Jul. 1997, Geneva, CH. pp. 14, Available online Jul. 22, 2013 at https://tech.ebu.ch/docs/tech/tech3285s1.pdf.

European Broadcasting Union (EBU): "Specification of the Broadcast Wave Format (BWF): A format for audio data files in broadcasting, Supplement 2—Capturing Report", EBU-TECH 3285 Supplement 2, Jul. 2001, Geneva, CH. pp. 14, Available online Jul. 22, 2013 at https://tech.ebu.ch/docs/tech/tech3285s2.pdf.

European Broadcasting Union (EBU): "Specification of the Broadcast Wave Format (BWF): A format for audio data files in broadcasting, Supplement 3—Peak Envelope Chunk", EBU-TECH 3285 Supplement 3, Jul. 2001, Geneva, CH. pp. 8, Available online Jul. 22, 2013 at https://tech.ebu.ch/docs/tech/tech3285s3.pdf.

European Broadcasting Union (EBU): "Specification of the Broadcast Wave Format (BWF): A format for audio data files in broadcasting, Supplement 4: <link> Chunk", EBU-TECH 3285 Supplement 4, Apr. 2003, Geneva, CH. pp. 4, Available online Jul. 22, 2013 at https://tech.ebu.ch/docs/tech/tech3285s4.pdf.

European Broadcasting Union (EBU): "Specification of the Broadcast Wave Format (BWF): A format for audio data files in broadcasting, Supplement 5: <axml> Chunk", EBU-TECH 3285 Supplement 5, Jul. 2003, Geneva, CH. pp. 3, Available online Jul. 22, 2013 at https://tech.ebu.ch/docs/tech/tech3285s5.pdf.

European Broadcasting Union (EBU): "Specification of the Broadcast Wave Format (BWF): A format for audio data files in broadcasting Version 2.0.", EBU-TECH 3285, May 2011, Geneva, CH. pp. 20, Available online Jul. 22, 2013 at https://tech.ebu.ch/docs/tech/tech3285.pdf.

European Broadcasting Union (EBU): "Specification of the Broadcast Wave Format (BWF): A format for audio data files, Supplement 6: Dolby Metadata, <dbmd> chunk", EBU-TECH 3285 suppl.6, Oct. 2009, Geneva, CH. pp. 46, Available online Jul. 22, 2013 at https://tech.ebu.ch/docs/tech/tech3285s6.pdf.

Fraunhofer Institute for Integrated Circuits: "White Paper: An Introduction to MP3 Surround", Mar. 2012, pp. 17, Accessed online Jul. 10, 2012; available online Jul. 22, 2013 at http://www.iis.fraunhofer.de/content/dam/iis/de/dokumente/amm/wp/introduction_mp3surround_03-2012.pdf.

Fraunhofer Institute for Integrated Circuits: "White Paper: The MPEG Standard on Parametric Object Based Audio Coding", Mar. 2012, pp. 4, Accessed online Jul. 5, 2012; available online Jul. 22, 2013 at http://www.iis.fraunhofer.de/content/dam/iis/en/dokumente/AMM/SAOC-wp_2012.pdf.

Herder, "Optimization of Sound Spatialization Resource Management through Clustering," Jan. 2000, 7 pp.

Herre, "Efficient Representation of Sound Images: Recent Developments in Parametric Coding of Spatial Audio," 40pp., Accessed online Jul. 9, 2012; accessed online Jul. 22, 2012 at www.img.lx.it.pt/pcs2007/presentations/JurgenHere_Sound_Images.pdf.

Herre, et al., "An Introduction to MP3 Surround", 9 pp., Accessed online Jul. 10, 2012; available online Jul. 22, 2013 at http://www.iis.fraunhofer.de/content/dam/iis/en/dokumente/AMM/introduction_to_mp3surround.pdf.

(56) References Cited

OTHER PUBLICATIONS

Herre, et al., "MPEG Surround—The ISO/MPEG Standard for Efficient and Compatible Multichannel Audio Coding", J. Audio Eng. Soc., vol. 56, No. 11, Nov. 2008, pp. 24, Accessed online Jul. 9, 2012; available online Jul. 22, 2013 at www.jeroenbreebaart.com/papers/jaes/jaes2008.pdf.

Herre J., et al., "The Reference Model Architecture for MPEG Spatial Audio Coding", 2005, pp. 13, Accessed online Jul. 11, 2012; available online Jul. 22, 2013 at http://www.iis.fraunhofer.de/content/dam/iis/de/dokumente/amm/conference/AES6447_MPEG_Spatial_Audio_Reference_Model_Architecture.pdf.

Herre J., "Personal Audio: From Simple Sound Reproduction to Personalized Interactive Rendering", pp. 22, Accessed online Jul. 9, 2012; available online Jul. 22, 2013 at http://www.audiomostly.com/amc2007/programme/presentations/AudioMostlyHerre.pdf.

West J., "Chapter 2: Spatial Hearing", pp. 10, Accessed online Jul. 25, 2012; accessed online Jul. 22, 2013 at http://www.music.miami.edu/programs/mue/Research/jwest/Chap_2/Chap_2_Spatial_Hearing.html.

International Telecommunication Union (ITU): "Recommendation ITU-R BS.775-1: Multichannel Stereophonic Sound System With and Without Accompanying Picture", pp. 10, Jul. 1994.

Malham D., "Spherical Harmonic Coding of Sound Objects—the Ambisonic 'O' Format," pp. 4, Accessed online Jul. 13, 2012; available online Jul. 22, 2013 at <URL: pcfarina.eng.unipr.it/Public/O-format/AES19-Malham.pdf>.

"Metadata Standards and Guidelines Relevant to Digital Audio", Prepared by the Preservation and Reformatting Section (PARS) Task Force on Audio Preservation Metadata in cooperation with the Music Library Association (MLA) Bibliographic Control Committee (BCC) Metadata Subcommittee, Feb. 17, 2010, 5 pp., Accessed online Jul. 22, 2013 at www.ala.org/alcts/files/resources/preserv/audio_metadata.pdf.

Moeck T., et al., "Progressive Perceptual Audio Rendering of Complex Scenes," I3D '07 Proceedings of the 2007 symposium on Interactive 3D graphics and games, Apr. 30-May 2, 2007, pp. 189-196.

Muscade Consortium: "D1.1.2: Reference architecture and representation format—Phase I", Ref. MUS.RP.00002.THO, Jun. 30, 2010, pp. 39, Accessed online Jul. 22, 2013 at www.muscade.eu/deliverables/D1.1.2.PDF.

Tsingos N., "Perceptually-Based Auralization," 19th International Congress on Acoustics Madrid, Sep. 2-7, 2007, 6 pp.

Peters N., et al., "Spatial sound rendering in MAX/MSP with VIMIC", 4 pp., Accessed online Jul. 6, 2012; available online Jul. 22, 2013 at nilspeters.info/papers/ICMC08-VIMIC_final.pdf.

Pro-MPEG Forum: "Pro-MPEG Code of Practice #2, May 2000: Operating Points for MPEG-2 Transport Streams on Wide Area Networks", pp. 10, Accessed online Dec. 5, 2012; available online Jul. 22, 2013 at www.pro-mpeg.org/documents/wancop2.pdf.

Silzle A., "How to Find Future Auduo Formats?", 2009, 15 pp., Accessed online Oct. 1, 2012; available online Jul. 22, 2013 at http://www.tonmeister.de/symposium/2009/np_pdf/A08.pdf.

Tsingos, et al., "Perceptual Audio Rendering of Complex Virtual Environments," ACM, 2004, pp. 249-258.

"Wave PCM soundfile format", pp. 4, Jan. 2003, at https://ccrma.stanford.edu/courses/422/projects/WaveFormat/.

Daniel, et al., "Spatial Auditory Blurring and Applications to Multichannel Audio Coding," Universit_e Pierre et Marie Curie—Paris, Sep. 14, 2011, 173 pp.

International Preliminary Report on Patentability from International Application No. PCT/US2013/051371, dated Jan. 29, 2015, 8 pp.

* cited by examiner

SCALABLE DOWNMIX DESIGN WITH FEEDBACK FOR OBJECT-BASED SURROUND CODEC

This application claims priority to U.S. Provisional Application No. 61/673,869, filed Jul. 20, 2012; U.S. Provisional Application No. 61/745,505, filed Dec. 21, 2012; and U.S. Provisional Application No. 61/745,129, filed Dec. 21, 2012.

This application is related to U.S. patent application Ser. No. 13/844,283, filed Mar. 15, 2013.

TECHNICAL FIELD

This disclosure relates to audio coding and, more specifically, to spatial audio coding.

BACKGROUND

The evolution of surround sound has made available many output formats for entertainment nowadays. The range of surround-sound formats in the market includes the popular 5.1 home theatre system format, which has been the most successful in terms of making inroads into living rooms beyond stereo. This format includes the following six channels: front left (L), front right (R), center or front center (C), back left or surround left (Ls), back right or surround right (Rs), and low frequency effects (LFE)). Other examples of surround-sound formats include the growing 7.1 format and the futuristic 22.2 format developed by NHK (Nippon Hoso Kyokai or Japan Broadcasting Corporation) for use, for example, with the Ultra High Definition Television standard. It may be desirable for a surround sound format to encode audio in two dimensions (2D) and/or in three dimensions (3D). However, these 2D and/or 3D surround sound formats require high-bit rates to properly encode the audio in 2D and/or 3D.

SUMMARY

In general, techniques are described for grouping audio objects into clusters to potentially reduce bit rate requirements when encoding audio in 2D and/or 3D.

As one example, a method of audio signal processing includes, based on spatial information for each of N audio objects, grouping a plurality of audio objects that includes the N audio objects into L clusters, where L is less than N. The method also includes mixing the plurality of audio objects into L audio streams. The method also includes, based on the spatial information and the grouping, producing metadata that indicates spatial information for each of the L audio streams, wherein a maximum value for L is based on information received from at least one of a transmission channel, a decoder, and a renderer.

As another example, an apparatus for audio signal processing comprises means for receiving information from at least one of a transmission channel, a decoder, and a renderer. The apparatus also comprises means for grouping, based on spatial information for each of N audio objects, a plurality of audio objects that includes the N audio objects into L clusters, where L is less than N and wherein a maximum value for L is based on the information received. The apparatus also comprises means for mixing the plurality of audio objects into L audio streams, and means for producing, based on the spatial information and the grouping, metadata that indicates spatial information for each of the L audio streams.

As another examples, a device for audio signal processing comprises a cluster analysis module configured to group, based on spatial information for each of N audio objects, a plurality of audio objects that includes the N audio objects into L clusters, where L is less than N, wherein the cluster analysis module is configured to receive information from at least one of a transmission channel, a decoder, and a renderer, and wherein a maximum value for L is based on the information received. The device also comprises a downmix module configured to mix the plurality of audio objects into L audio streams, and a metadata downmix module configured to produce, based on the spatial information and the grouping, metadata that indicates spatial information for each of the L audio streams.

As another example, a non-transitory computer-readable storage medium having stored thereon instructions that, when executed, cause one or more processors to, based on spatial information for each of N audio objects, group a plurality of audio objects that includes the N audio objects into L clusters, where L is less than N. The instructions also cause the processors to mix the plurality of audio objects into L audio streams and, based on the spatial information and the grouping, produce metadata that indicates spatial information for each of the L audio streams, wherein a maximum value for L is based on information received from at least one of a transmission channel, a decoder, and a renderer.

The details of one or more aspects of the techniques are set forth in the accompanying drawings and the description below. Other features, objects, and advantages of these techniques will be apparent from the description and drawings, and from the claims.

BRIEF DESCRIPTION OF THE DRAWINGS

FIG. 9 shows a 5.1 transcoding matrix included in metadata during encoding, and FIG. 10 shows a transcoding matrix calculated at the decoder.

Like reference characters denote like elements throughout the figures and text.

DETAILED DESCRIPTION

Figure 1:
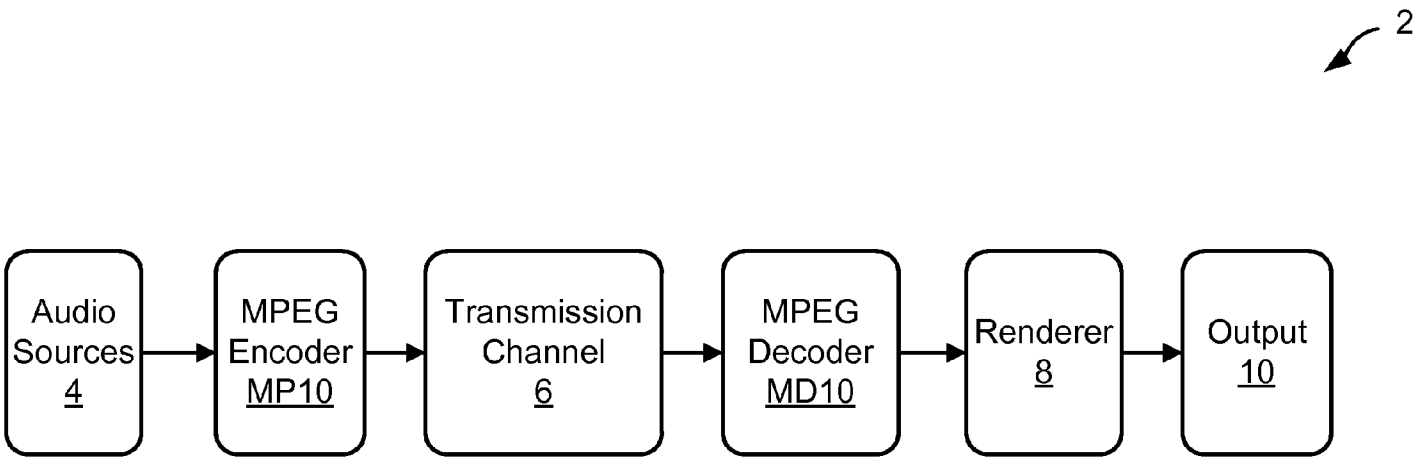
FIG. 1 shows a general structure for audio coding standardization, using an MPEG codec (coder/decoder).

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, estimating, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

The evolution of surround sound has made available many output formats for entertainment nowadays. The range of surround-sound formats in the market includes the popular 5.1 home theatre system format, which has been the most successful in terms of making inroads into living rooms beyond stereo. This format includes the following six channels: front left (FL), front right (FR), center or front center, back left or surround left, back right or surround right, and low frequency effects (LFE). Other examples of surround-sound formats include the 7.1 format and the 22.2 format developed by NHK (Nippon Hoso Kyokai or Japan Broadcasting Corporation) for use, for example, with the Ultra High Definition Television standard. The surround-sound format may encode audio in two dimensions and/or in three dimensions. For example, some surround sound formats may use a format involving a spherical harmonic array.

The types of surround setup through which a soundtrack is ultimately played may vary widely, depending on factors that may include budget, preference, venue limitation, etc. Even some of the standardized formats (5.1, 7.1, 10.2, 11.1, 22.2, etc.) allow setup variations in the standards. At the audio creator's side, a studio will typically produce the soundtrack for a movie only once, and it is unlikely that efforts will be made to remix the soundtrack for each speaker setup. Accordingly, many audio creators may prefer to encode the audio into bit streams and decode these streams according to the particular output conditions. In some examples, audio data may be encoded into a standardized bit stream and a subsequently decoded in a manner that is adaptable and agnostic to the speaker geometry and acoustic conditions at the location of the renderer.

FIG. 1 illustrates a general structure for such standardization, using a Moving Picture Experts Group (MPEG) codec, to potentially provide the goal of a uniform listening experience regardless of the particular setup that is ultimately used for reproduction. As shown in FIG. 1, MPEG encoder MP10 encodes audio sources 4 to generate an encoded version of the audio sources 4, where the encoded version of the audio sources 4 are sent via transmission channel 6 to MPEG decoder MD10. The MPEG decoder MD10 decodes the encoded version of audio sources 4 to recover, at least partially, the audio sources 4, which may be rendered and output as output 10 in the example of FIG. 1.

In some examples, a 'create-once, use-many' philosophy may be followed in which audio material is created once (e.g., by a content creator) and encoded into formats which can be subsequently decoded and rendered to different outputs and speaker setups. A content creator, such as a Hollywood studio, for example, would like to produce the soundtrack for a movie once and not spend the efforts to remix it for each speaker configuration.

One approach that may be used with such a philosophy is object-based audio. An audio object encapsulates individual pulse-code-modulation (PCM) audio streams, along with their three-dimensional (3D) positional coordinates and other spatial information (e.g., object coherence) encoded as metadata. The PCM streams are typically encoded using, e.g., a transform-based scheme (for example, MPEG Layer-3 (MP3), AAC, MDCT-based coding). The metadata may also be encoded for transmission. At the decoding and rendering end, the metadata is combined with the PCM data to recreate the 3D sound field. Another approach is channel-based audio, which involves the loudspeaker feeds for each of the loudspeakers, which are meant to be positioned in a predetermined location (such as for 5.1 surround sound/home theatre and the 22.2 format).

In some instances, an object-based approach may result in excessive bit rate or bandwidth utilization when many such audio objects are used to describe the sound field. The techniques described in this disclosure may promote a smart and more adaptable downmix scheme for object-based 3D audio coding. Such a scheme may be used to make the codec scalable while still preserving audio object independence and render flexibility within the limits of, for example, bit rate, computational complexity, and/or copyright constraints.

One of the main approaches of spatial audio coding is object-based coding. In the content creation stage, individual spatial audio objects (e.g., PCM data) and their corresponding location information are encoded separately. Two examples that use the object-based philosophy are provided here for reference.

The first example is Spatial Audio Object Coding (SAOC), in which all objects are downmixed to a mono or stereo PCM stream for transmission. Such a scheme, which is based on binaural cue coding (BCC), also includes a metadata bitstream, which may include values of parameters, such as interaural level difference (ILD), interaural time difference (ITD), and inter-channel coherence (ICC), relating to the diffusivity or perceived size of the source and may be encoded into as little as one-tenth of an audio channel.

Figure 2A:
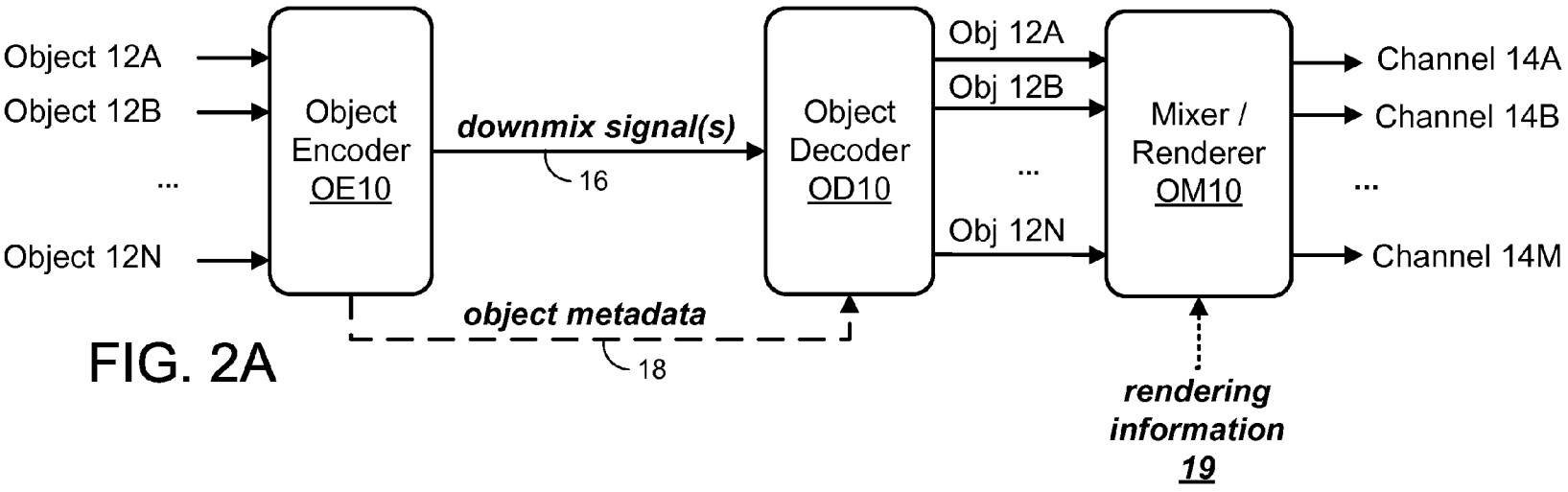
FIGS. 2A and 2B show conceptual overviews of Spatial Audio Object Coding (SAOC).
Figure 2B:
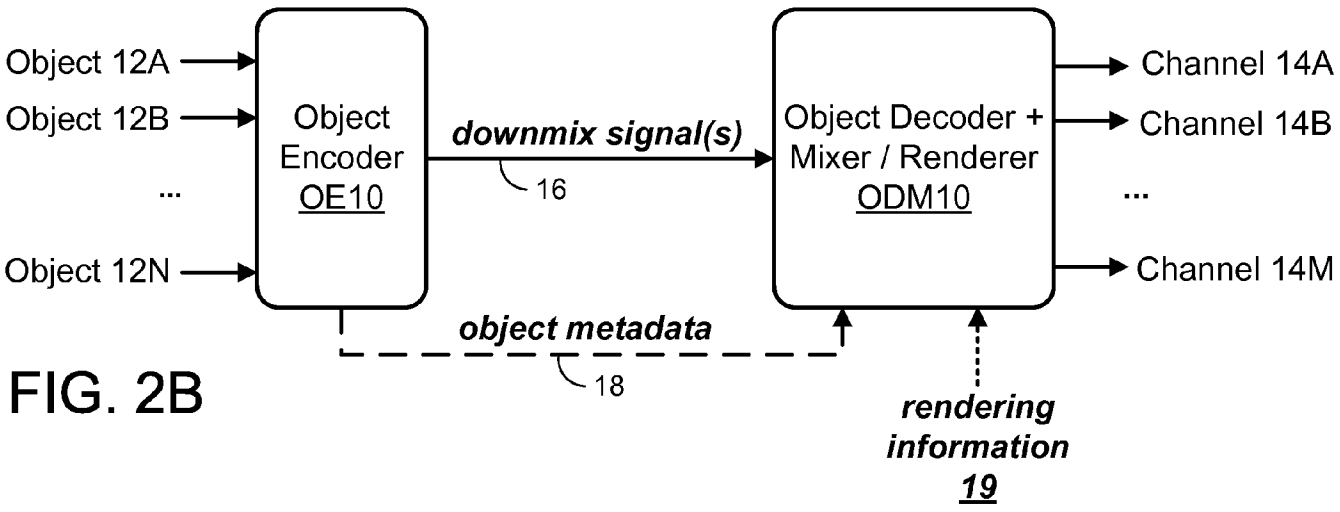

FIG. 2A shows a conceptual diagram of an SAOC implementation in which the object decoder OD10 and object mixer OM10 are separate modules. FIG. 2B shows a conceptual diagram of an SAOC implementation that includes an integrated object decoder and mixer ODM10. As shown in FIGS. 2A and 2B, the mixing and/or rendering operations to generate channels 14A-14M (collectively, "channels 14") may be performed based on rendering information 19 from the local environment, such as the number of loudspeakers, the positions and/or responses of the loudspeakers, the room response, etc. Channels 14 may alternatively be referred to as "speaker feeds 14" or "loudspeaker feeds 14." In the illustrated examples of FIGS. 2A and 2B, the object encoder OE10 downmixes all spatial audio objects 12A-12N (collectively, "objects 12") to the downmix signal(s) 16, which may include a mono or stereo PCM stream. In addition, the object encoder OE10 generates object metadata 18 for transmission as a metadata bitstream in the manner described above.

In operation, SAOC may be tightly coupled with MPEG Surround (MPS, ISO/IEC 14496-3, also called High-Efficiency Advanced Audio Coding or HeAAC), in which the six channels of a 5.1 format signal are downmixed into a mono or stereo PCM stream, with corresponding side-information (such as ILD, ITD, ICC) that allows the synthesis of the rest of the channels at the renderer. While such a scheme may have a quite low bit rate during transmission, the flexibility of spatial rendering is typically limited for SAOC. Unless the intended render locations of the audio objects are very close to the original locations, the audio quality may be compromised. Also, when the number of audio objects increases, doing individual processing on each of them with the help of metadata may become difficult.

Figure 3:
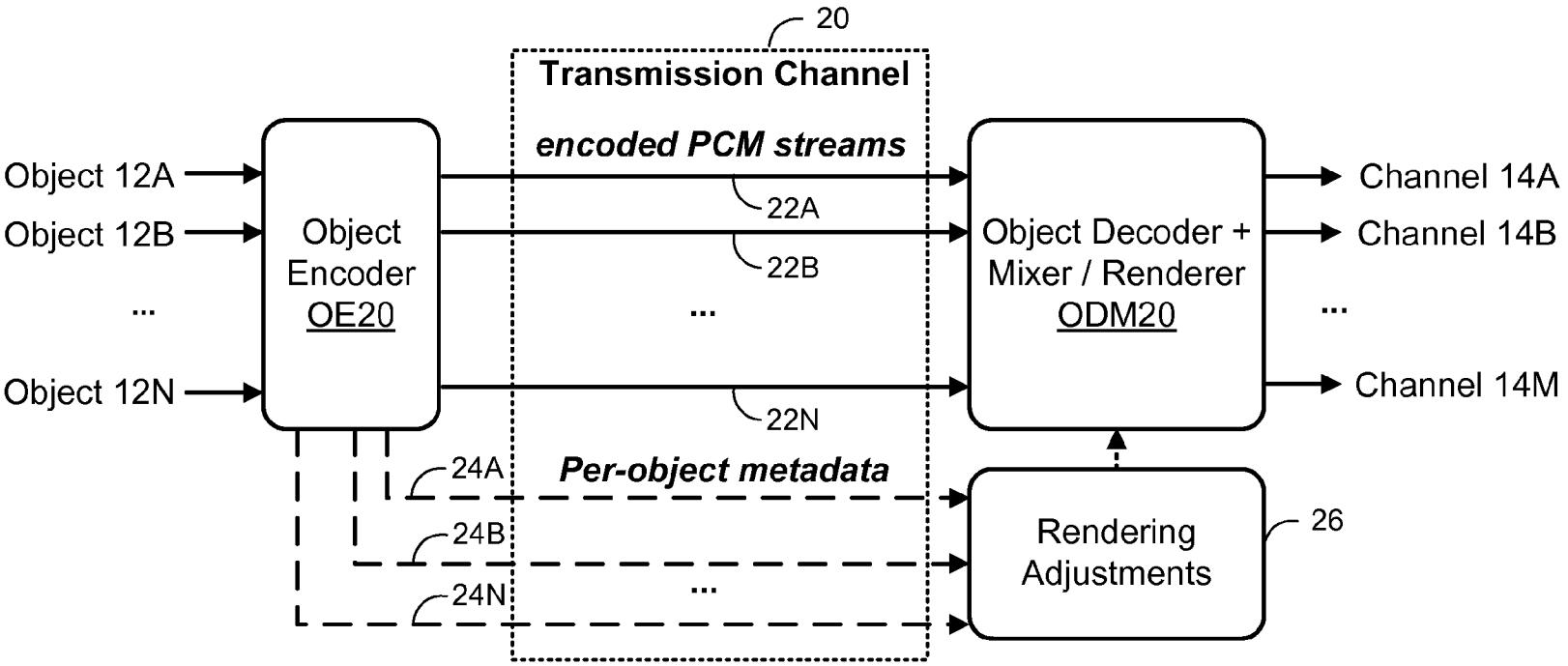
FIG. 3 shows a conceptual overview of one object-based coding approach.

FIG. 3 shows a conceptual overview of the second example, which refers to an object-based coding scheme in which each of one or more sound source encoded PCM stream(s) 22A-22N (collectively "PCM stream(s) 22") is individually encoded by object encode OE20 and transmitted, along with their respective per-object metadata 24A-24N (e.g., spatial data and collectively referred to herein as "per-object metadata 24"), via transmission channel 20. At the renderer end, a combined object decoder and mixer/renderer ODM20 uses the PCM objects 12 encoded in PCM stream(s) 22 and the associated metadata received via transmission channel 20 to calculate the channels 14 based on the positions of the speakers, with the per-object metadata 24 providing rendering adjustments 26 to the mixing and/or rendering operations. For example, the object decoder and mixer/renderer ODM20 may use a panning method (e.g., vector base amplitude panning (VBAP)) to individually spatialize the PCM streams back to a surround-sound mix. At the renderer end, the mixer usually has the appearance of a multi-track editor, with PCM tracks laying out and spatial metadata as editable control signals. It will be understood that the object decoder and mixer/renderer ODM20 shown in FIG. 3 (and elsewhere in this document) may be implemented as an integrated structure or as separate decoder and mixer/renderer structures, and that the mixer/renderer itself may be implemented as an integrated structure (e.g., performing an integrated mixing/rendering operation) or as a separate mixer and renderer performing independent respective operations.

Although an approach as shown in FIG. 3 allows significant flexibility, it also has potential drawbacks. Obtaining individual PCM audio objects 12 from the content creator may be difficult, and the scheme may provide an insufficient level of protection for copyrighted material, as the decoder end (represented in FIG. 3 by object decoder and mixer/renderer ODM20) can easily obtain the original audio objects (which may include, for example, gunshots and other sound effects). Also the soundtrack of a modern movie can easily involve hundreds of overlapping sound events, such that encoding each of PCM objects 12 individually may fail to fit all the data into limited-bandwidth transmission channels (e.g., transmission channel 20) even with a moderate number of audio objects. Such a scheme does not address this bandwidth challenge, and therefore this approach may be prohibitive in terms of bandwidth usage.

For object-based audio, the above may result in excessive bit-rate or bandwidth utilization when there are many audio objects to describe the sound field. Similarly, the coding of channel-based audio may also become an issue when there is a bandwidth constraint.

Scene-based audio is typically encoded using an Ambisonics format, such as B-Format. The channels of a B-Format signal correspond to spherical harmonic basis functions of the sound field, rather than to loudspeaker feeds. A first-order B-Format signal has up to four channels (an omnidirectional channel W and three directional channels X,Y,Z); a second-order B-Format signal has up to nine channels (the four first-order channels and five additional channels R,S,T,U,V); and a third-order B-Format signal has up to sixteen channels (the nine second-order channels and seven additional channels K,L,M,N,O,P,Q).

Figure 4A:
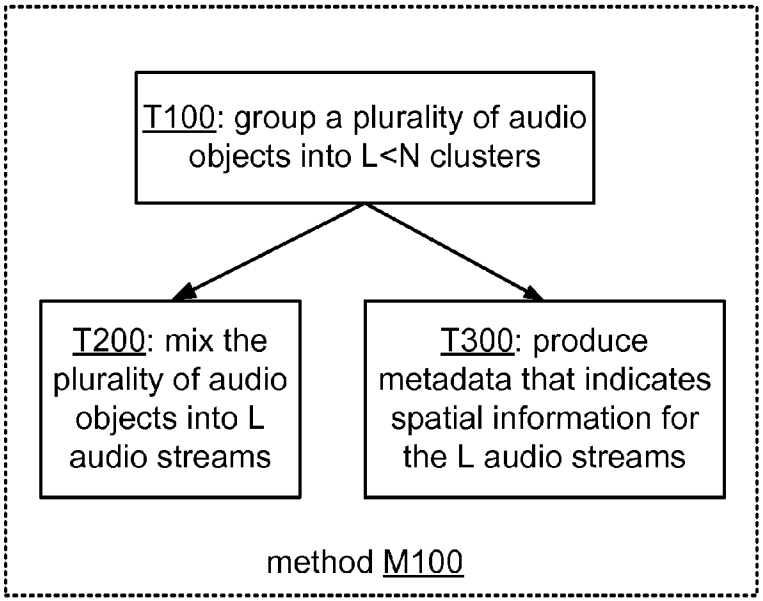
FIG. 4A shows a flowchart for a method M100 of audio signal processing according to a general configuration.

Accordingly, scalable channel reduction techniques are described in this disclosure that use a cluster-based downmix, which may result in lower bit-rate encoding of audio data and thereby reduce bandwidth utilization. FIG. 4A shows a flowchart for a method M100 of audio signal processing according to a general configuration that includes tasks T100, T200, and T300. Based on spatial information for each of N audio objects 12, task T100 groups a plurality of audio objects that includes the N audio objects 12 into L clusters 28, where L is less than N. Task T200 mixes the plurality of audio objects into L audio streams. Based on the spatial information, task T300 produces metadata that indicates spatial information for each of the L audio streams.

Each of the N audio objects 12 may be provided as a PCM stream. Spatial information for each of the N audio objects 12 is also provided. Such spatial information may include a location of each object in three-dimensional coordinates (cartesian or spherical polar (e.g., distance-azimuth-elevation)). Such information may also include an indication of the diffusivity of the object (e.g., how point-like or, alternatively, spread-out the source is perceived to be), such as a spatial coherence function. The spatial information may be obtained from a recorded scene using a multi-microphone method of source direction estimation and scene decomposition. In this case, such a method (e.g., as described herein with reference to FIG. 14 et seq.) may be performed within the same device (e.g., a smartphone, tablet computer, or other portable audio sensing device) that performs method M100.

In one example, the set of N audio objects 12 may include PCM streams recorded by microphones at arbitrary relative locations, together with information indicating the spatial position of each microphone. In another example, the set of N audio objects 12 may also include a set of channels corresponding to a known format (e.g., a 5.1, 7.1, or 22.2 surround-sound format), such that location information for each channel (e.g., the corresponding loudspeaker location) is implicit. In this context, channel-based signals (or loudspeaker feeds) are PCM feeds in which the locations of the objects are the pre-determined positions of the loudspeakers. Thus channel-based audio can be treated as just a subset of object-based audio in which the number of objects is fixed to the number of channels.

Task T100 may be implemented to group the audio objects 12 by performing a cluster analysis, at each time segment, on the audio objects 12 present during each time segment. It is possible that task T100 may be implemented to group more than the N audio objects 12 into the L clusters 28. For example, the plurality of audio objects 12 may include one or more objects 12 for which no metadata is available (e.g., a non-directional or completely diffuse sound) or for which the metadata is generated at or is otherwise provided to the decoder. Additionally or alternatively, the set of audio objects 12 to be encoded for transmission or storage may include, in addition to the plurality of audio objects 12, one or more objects 12 that are to remain separate from the clusters 28 in the output stream. In recording a sports event, for example, various aspects of the techniques described in this disclosure may, in some examples, be performed to transmit a commentator's dialogue separate from other sounds of the event, as an end user may wish to control the volume of the dialogue relative to the other sounds (e.g., to enhance, attenuate, or block such dialogue).

Methods of cluster analysis may be used in applications such as data mining. Algorithms for cluster analysis are not specific and can take different approaches and forms. A typical example of a clustering method is k-means clustering, which is a centroid-based clustering approach. Based on a specified number of clusters 28, k, individual objects will be assigned to the nearest centroid and grouped together.

Figure 4B:
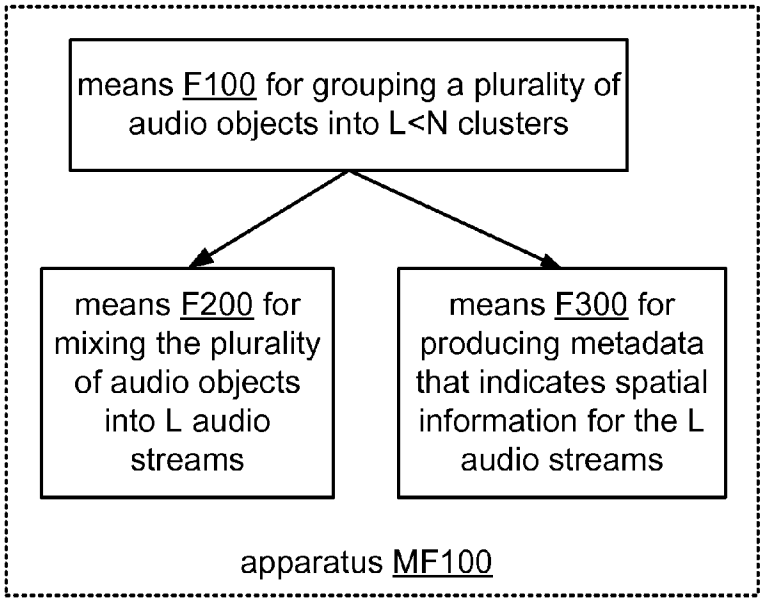
FIG. 4B shows a block diagram for an apparatus MF100 according to a general configuration.

FIG. 4B shows a block diagram for an apparatus MF100 according to a general configuration. Apparatus MF100 includes means F100 for grouping, based on spatial information for each of N audio objects 12, a plurality of audio objects 12 that includes the N audio objects 12 into L clusters, where L is less than N (e.g., as described herein with reference to task T100). Apparatus MF100 also includes means F200 for mixing the plurality of audio objects 12 into L audio streams 22 (e.g., as described herein with reference to task T200). Apparatus MF100 also includes means F300 for producing metadata, based on the spatial information and the grouping indicated by means F100, that indicates spatial information for each of the L audio streams 22 (e.g., as described herein with reference to task T300).

Figure 4C:
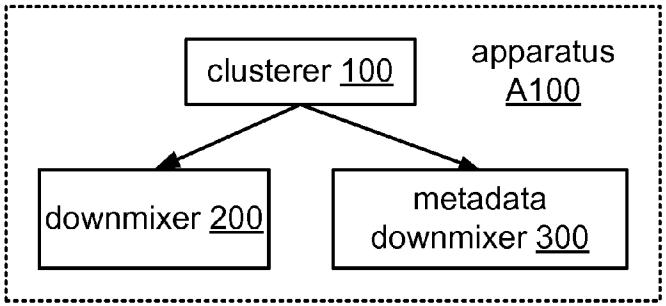
FIG. 4C shows a block diagram for an apparatus A100 according to a general configuration.

FIG. 4C shows a block diagram for an apparatus A100 according to a general configuration. Apparatus A100 includes a clusterer 100 configured to group, based on spatial information for each of N audio objects 12, a plurality of audio objects that includes the N audio objects 12 into L clusters 28, where L is less than N (e.g., as described herein with reference to task T100). Apparatus A100 also includes a downmixer 200 configured to mix the plurality of audio objects into L audio streams 22 (e.g., as described herein with reference to task T200). Apparatus A100 also includes a metadata downmixer 300 configured to produce metadata, based on the spatial information and the grouping indicated by clusterer 100, that indicates spatial information for each of the L audio streams 22 (e.g., as described herein with reference to task T300).

Figure 5:
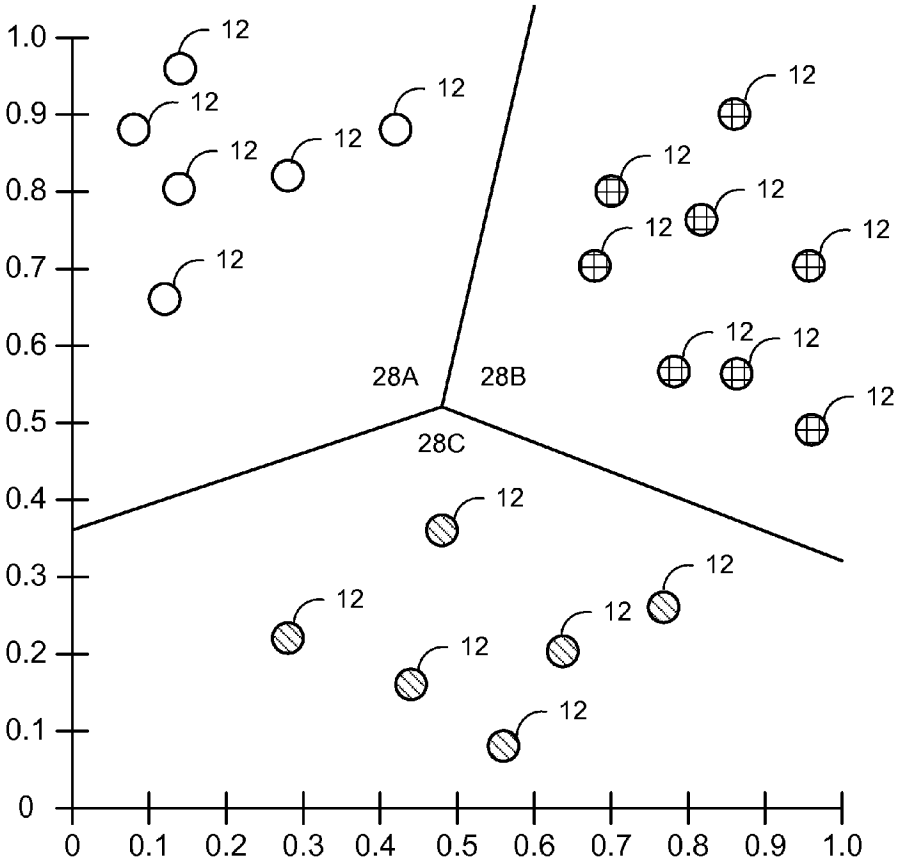
FIG. 5 shows an example of k-means clustering with three cluster centers.

FIG. 5 shows an example visualization of a two-dimensional k-means clustering, although it will be understood that clustering in three dimensions is also contemplated and hereby disclosed. In the particular example of FIG. 5, the value of k is three such that objects 12 are grouped into clusters 28A-28C, although any other positive integer value (e.g., larger than three) may also be used. Spatial audio objects 12 may be classified according to their spatial location (e.g., as indicated by metadata) and clusters 28 are identified, then each centroid corresponds to a downmixed PCM stream and a new vector indicating its spatial location.

In addition or in the alternative to a centroid-based clustering approach (e.g., k-means), task T100 may use one or more other clustering approaches to cluster a large number of audio sources. Examples of such other clustering approaches include distribution-based clustering (e.g., Gaussian), density-based clustering (e.g., density-based spatial clustering of applications with noise (DBSCAN), EnDBSCAN, Density-Link-Clustering, or OPTICS), and connectivity based or hierarchical clustering (e.g., unweighted pair group method with arithmetic mean, also known as UPGMA or average linkage clustering).

Additional rules may be imposed on the cluster size according to the object locations and/or the cluster centroid locations. For example, the techniques may take advantage of the directional dependence of the human auditory system's ability to localize sound sources. The capability of the human auditory system to localize sound sources is typically much better for arcs on the horizontal plane than for arcs that are elevated from this plane. The spatial hearing resolution of a listener is also typically finer in the frontal area as compared to the rear side. In the horizontal plane that includes the interaural axis, this resolution (also called "localization blur") is typically between 0.9 and four degrees (e.g., +/−three degrees) in the front, +/−ten degrees at the sides, and +/−six degrees in the rear, such that it may be desirable to assign pairs of objects within these ranges to the same cluster. Localization blur may be expected to increase with elevation above or below this plane. For spatial locations in which the localization blur is large, more audio objects may be grouped into a cluster to produce a smaller total number of clusters, since the listener's auditory system will typically be unable to differentiate these objects well in any case.

Figure 6:
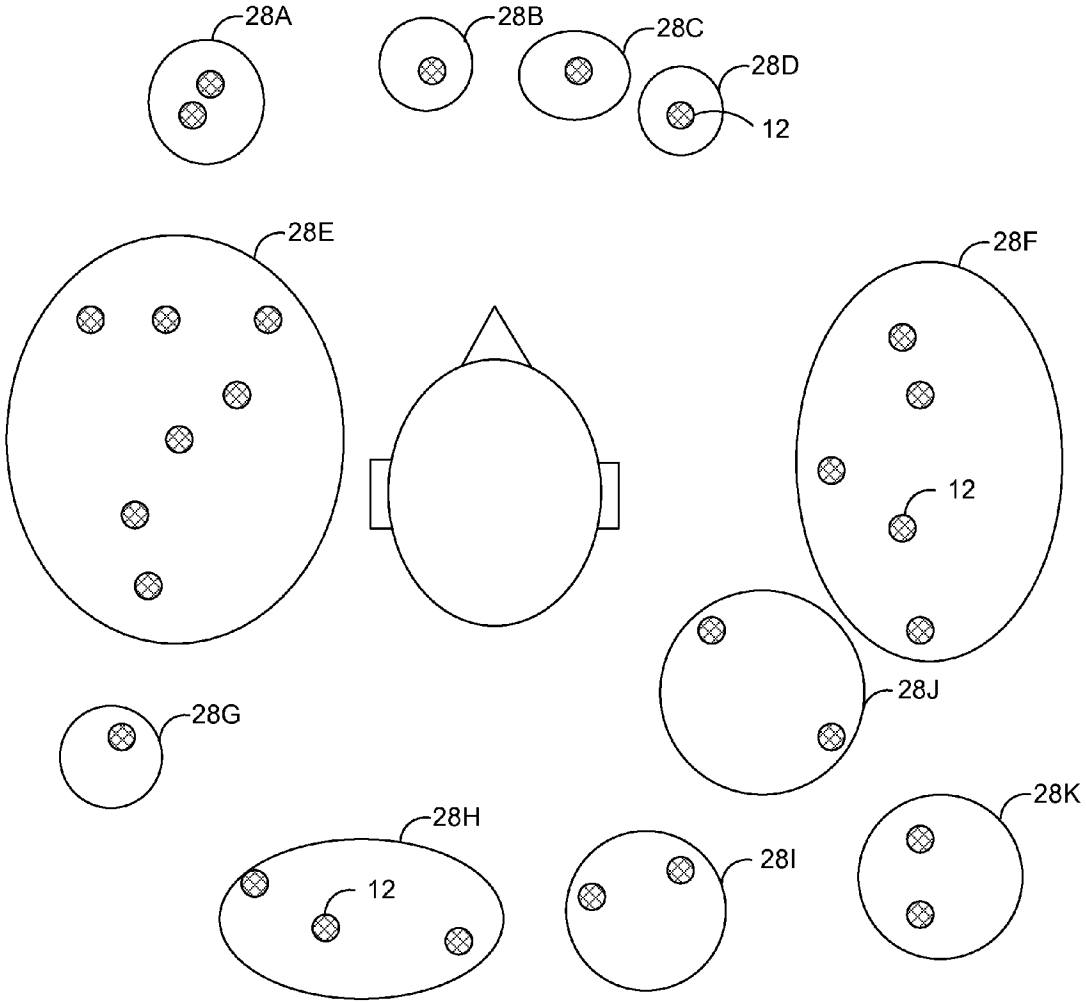
FIG. 6 shows an example of different cluster sizes with cluster centroid location.

FIG. 6 shows one example of direction-dependent clustering. In the example, a large cluster number is presented. The frontal objects are finely separated with clusters 28A-28D, while near the "cone of confusion" at either side of the listener's head, lots of objects are grouped together and rendered as left cluster 28E and right cluster 28F. In this example, the sizes of the clusters 28G-28K behind the listener's head are also larger than those in front of the listener. As illustrated, not all objects 12 are individually labeled for clarity and ease of illustration purposes. However, each of objects 12 may represent a different individual spatial audio object for spatial audio coding.

In some examples, the techniques described in this disclosure may specify values for one or more control parameters of the cluster analysis (e.g., number of clusters). For example, a maximum number of clusters 28 may be specified according to the transmission channel 20 capacity and/or intended bit rate. Additionally or alternatively, a maximum number of clusters 28 may be based on the number of objects 12 and/or perceptual aspects. Additionally or alternatively, a minimum number of clusters 28 (or, e.g., a minimum value of the ratio N/L) may be specified to ensure at least a minimum degree of mixing (e.g., for protection of proprietary audio objects). Optionally a specified cluster centroid information can also be specified.

The techniques described in this disclosure may, in some examples, include updating the cluster analysis over time, and the samples passed from one analysis to the next. The interval between such analyses may be called a downmix frame. Various aspects of the techniques described in this disclosure may, in some examples, be performed to overlap such analysis frames (e.g., according to analysis or processing requirements). From one analysis to the next, the number and/or composition of the clusters may change, and objects 12 may come and go between each cluster 28. When an encoding requirement changes (e.g., a bit-rate change in a variable-bit-rate coding scheme, a changing number of source objects, etc.), the total number of clusters 28, the way in which objects 28 are grouped into the clusters 12, and/or the locations of each of one or more clusters 28 may also change over time.

In some examples, the techniques described in this disclosure may include performing the cluster analysis to prioritize objects 12 according to diffusivity (e.g., apparent spatial width). For example, the sound field produced by a concentrated point source, such as a bumblebee, typically requires more bits to model sufficiently than a spatially wide source, such as a waterfall, that typically does not require precise positioning. In one such example, task T100 clusters only objects 12 having a high measure of spatial concentration (or a low measure of diffusivity), which may be determined by applying a threshold value. In this example, the remaining diffuse sources may be encoded together or individually at a lower bit rate than the clusters 28. For example, a small reservoir of bits may be reserved in the allotted bitstream to carry the encoded diffuse sources.

For each audio object 12, the downmix gain contribution to its neighboring cluster centroid is also likely to change over time. For example, in FIG. 6, the objects 12 in each of the two lateral clusters 28E and 28F can also contribute to the frontal clusters 28A-28D, although with very low gains. Over time, the techniques described in this disclosure may include checking neighboring frames for changes in each object's location and cluster distribution. Within one frame during the downmix of PCM streams, smooth gain changes for each audio object 12 may be applied, to avoid audio artifacts that may be caused by a sudden gain change from one frame to the next. Any one or more of various known gain smoothing methods may be applied, such as a linear gain change (e.g., linear gain interpolation between frames) and/or a smooth gain change according to the spatial movement of an object from one frame to the next.

Returning to FIG. 4A, the task T200 downmixes the original N audio objects 12 to L clusters 28. For example, the task T200 may be implemented to perform a downmix, according to the cluster analysis results, to reduce the PCM streams from the plurality of audio objects down to L mixed PCM streams (e.g., one mixed PCM stream per cluster). This PCM downmix may be conveniently performed by a downmix matrix. The matrix coefficients and dimensions are determined by, e.g., the analysis in task T100, and additional arrangements of method M100 may be implemented using the same matrix with different coefficients. The content creator can also specify a minimal downmix level (e.g., a minimum required level of mixing), so that the original sound sources can be obscured to provide protection from renderer-side infringement or other abuse of use. Without loss of generality, the downmix operation can be expressed as $$C_{(L\times 1)}=A_{(L\times N)}S_{(N\times 1)},$$

where S is the original audio vector, C is the resulting cluster audio vector, and A is the downmix matrix.

Task T300 downmixes metadata for the N audio objects 12 into metadata for the L audio clusters 28 according to the grouping indicated by task T100. Such metadata may include, for each cluster, an indication of the angle and distance of the cluster centroid in three-dimensional coordinates (e.g., cartesian or spherical polar (e.g., distance-azimuth-elevation)). The location of a cluster centroid may be calculated as an average of the locations of the corresponding objects (e.g., a weighted average, such that the location of each object is weighted by its gain relative to the other objects in the cluster). Such metadata may also include, for each of one or more (possibly all) of the clusters 28, an indication of the diffusivity of the cluster.

An instance of method M100 may be performed for each time frame. With proper spatial and temporal smoothing (e.g., amplitude fade-ins and fade-outs), the changes in different clustering distribution and numbers from one frame to another can be inaudible.

The L PCM streams may be outputted in a file format. In one example, each stream is produced as a WAV file compatible with the WAVE file format. The techniques described in this disclosure may, in some examples, use a codec to encode the L PCM streams before transmission over a transmission channel (or before storage to a storage medium, such as a magnetic or optical disk) and to decode the L PCM streams upon reception (or retrieval from storage). Examples of audio codecs, one or more of which may be used in such an implementation, include MPEG Layer-3 (MP3), Advanced Audio Codec (AAC), codecs based on a transform (e.g., a modified discrete cosine transform or MDCT), waveform codecs (e.g., sinusoidal codecs), and parametric codecs (e.g., code-excited linear prediction or CELP). The term "encode" may be used herein to refer to method M100 or to a transmission-side of such a codec; the particular intended meaning will be understood from the context. For a case in which the number of streams L may vary over time, and depending on the structure of the particular codec, it may be more efficient for a codec to provide a fixed number $L_{max}$ of streams, where $L_{max}$ is a maximum limit of L, and to maintain any temporarily unused streams as idle, than to establish and delete streams as the value of L changes over time.

Typically the metadata produced by task T300 will also be encoded (e.g., compressed) for transmission or storage (using, e.g., any suitable entropy coding or quantization technique). As compared to a complex algorithm such as SAOC, which includes frequency analysis and feature extraction procedures, a downmix implementation of method M100 may be expected to be less computationally intensive.

Figure 7A:
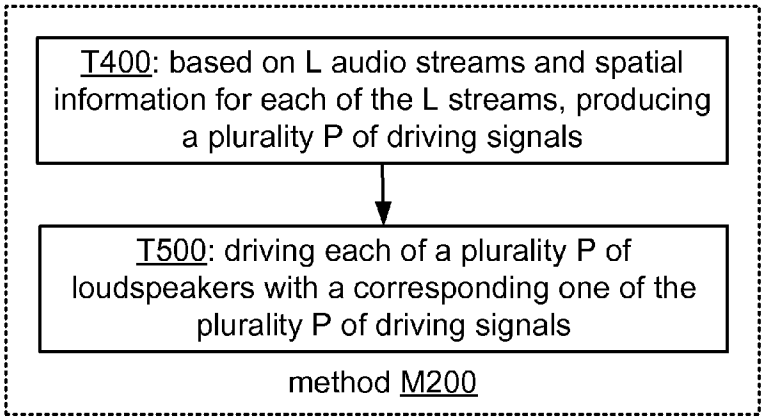
FIG. 7A shows a flowchart for a method M200 of audio signal processing according to a general configuration.

FIG. 7A shows a flowchart of a method M200 of audio signal processing according to a general configuration that includes tasks T400 and T500. Based on L audio streams and spatial information for each of the L streams, task T400 produces a plurality P of driving signals. Task T500 drives each of a plurality P of loudspeakers with a corresponding one of the plurality P of driving signals.

At the decoder side, spatial rendering is performed per cluster instead of per object. A wide range of designs are available for the rendering. For example, flexible spatialization techniques (e.g., VBAP or panning) and speaker setup formats can be used. Task T400 may be implemented to perform a panning or other sound field rendering technique (e.g., VBAP). The resulting spatial sensation may resemble the original at high cluster counts; with low cluster counts, data is reduced, but a certain flexibility on object location rendering may still be available. Since the clusters still preserve the original location of audio objects, the spatial sensation may be very close to the original sound field as soon as enough cluster numbers are allowed.

Figure 7C:
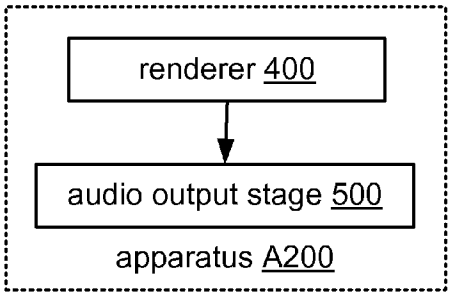
FIG. 7C shows a block diagram of an apparatus A200 for audio signal processing according to a general configuration.
Figure 7B:
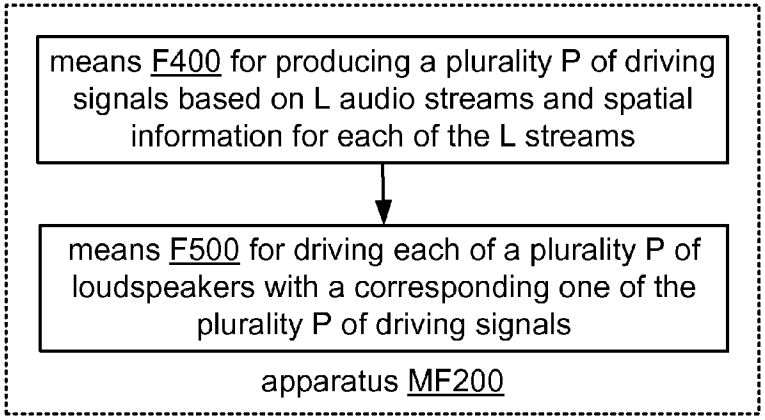
FIG. 7B shows a block diagram of an apparatus MF200 for audio signal processing according to a general configuration.

FIG. 7B shows a block diagram of an apparatus MF200 for audio signal processing according to a general configuration. Apparatus MF200 includes means F400 for producing a plurality P of driving signals based on L audio streams and spatial information for each of the L streams (e.g., as described herein with reference to task T400). Apparatus MF200 also includes means F500 for driving each of a plurality P of loudspeakers with a corresponding one of the plurality P of driving signals (e.g., as described herein with reference to task T500).

FIG. 7C shows a block diagram of an apparatus A200 for audio signal processing according to a general configuration. Apparatus A200 includes a renderer 400 configured to produce a plurality P of driving signals based on L audio streams and spatial information for each of the L streams (e.g., as described herein with reference to task T400). Apparatus A200 also includes an audio output stage 500 configured to drive each of a plurality P of loudspeakers with a corresponding one of the plurality P of driving signals (e.g., as described herein with reference to task T500).

Figure 8:
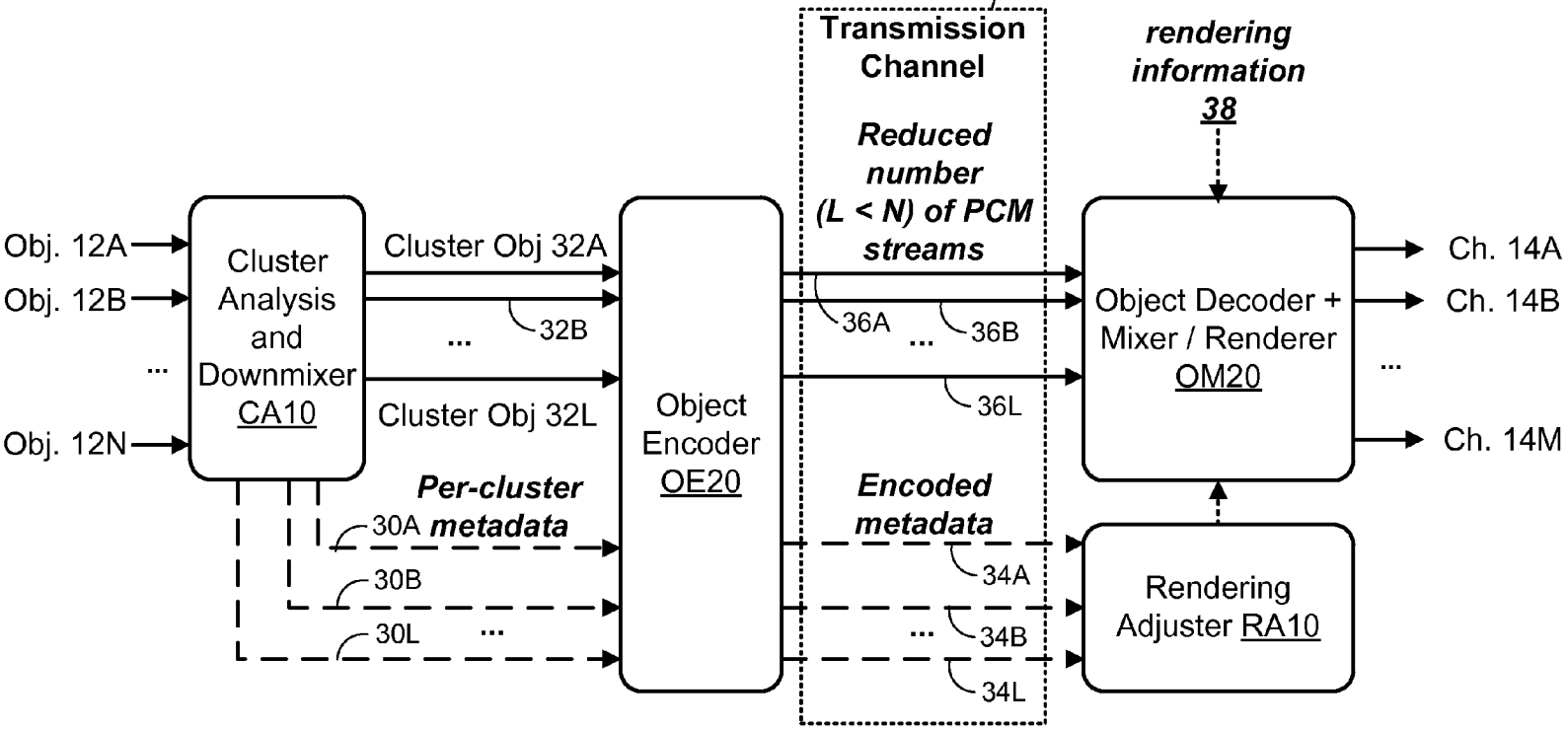
FIG. 8 shows a conceptual overview of a coding scheme as described herein with cluster analysis and downmix design.

FIG. 8 shows a conceptual diagram of a system that includes a cluster analysis and downmix module CA10 that may be implemented to perform method M100, an object decoder and mixer/renderer module OM20, and a rendering adjustments module RA10 that may be implemented to perform method M200. The mixing and/or rendering operations to generate channels 14A-14M (collectively, "channels 14") may be performed based on rendering information 38 from the local environment, such as the number of loudspeakers, the positions and/or responses of the loudspeakers, the room response, etc. This example also includes a codec as described herein that comprises an object encoder OE20 configured to encode the L mixed streams, illustrated as PCM streams 36A-36L (collectively "streams 36"), and an object decoder of object decoder and mixer/renderer module OM20 configured to decode the L mixed streams 36.

Such an approach may be implemented to provide a very flexible system to code spatial audio. At low bit rates, a small number L of cluster objects 32 (illustrated as "Cluster Obj 32A-32L") may compromise audio quality, but the result is usually better than a straight downmix to only mono or stereo. At higher bit rates, as the number of cluster objects 32 increases, spatial audio quality and render flexibility may be expected to increase. Such an approach may also be implemented to be scalable to constraints during operation, such as bit rate constraints. Such an approach may also be implemented to be scalable to constraints at implementation, such as encoder/decoder/CPU complexity constraints. Such an approach may also be implemented to be scalable to copyright protection constraints. For example, a content creator may require a certain minimum downmix level to prevent availability of the original source materials.

It is also contemplated that methods M100 and M200 may be implemented to process the N audio objects 12 on a frequency subband basis. Examples of scales that may be used to define the various subbands include, without limitation, a critical band scale and an Equivalent Rectangular Bandwidth (ERB) scale. In one example, a hybrid Quadrature Mirror Filter (QMF) scheme is used.

Figure 9:
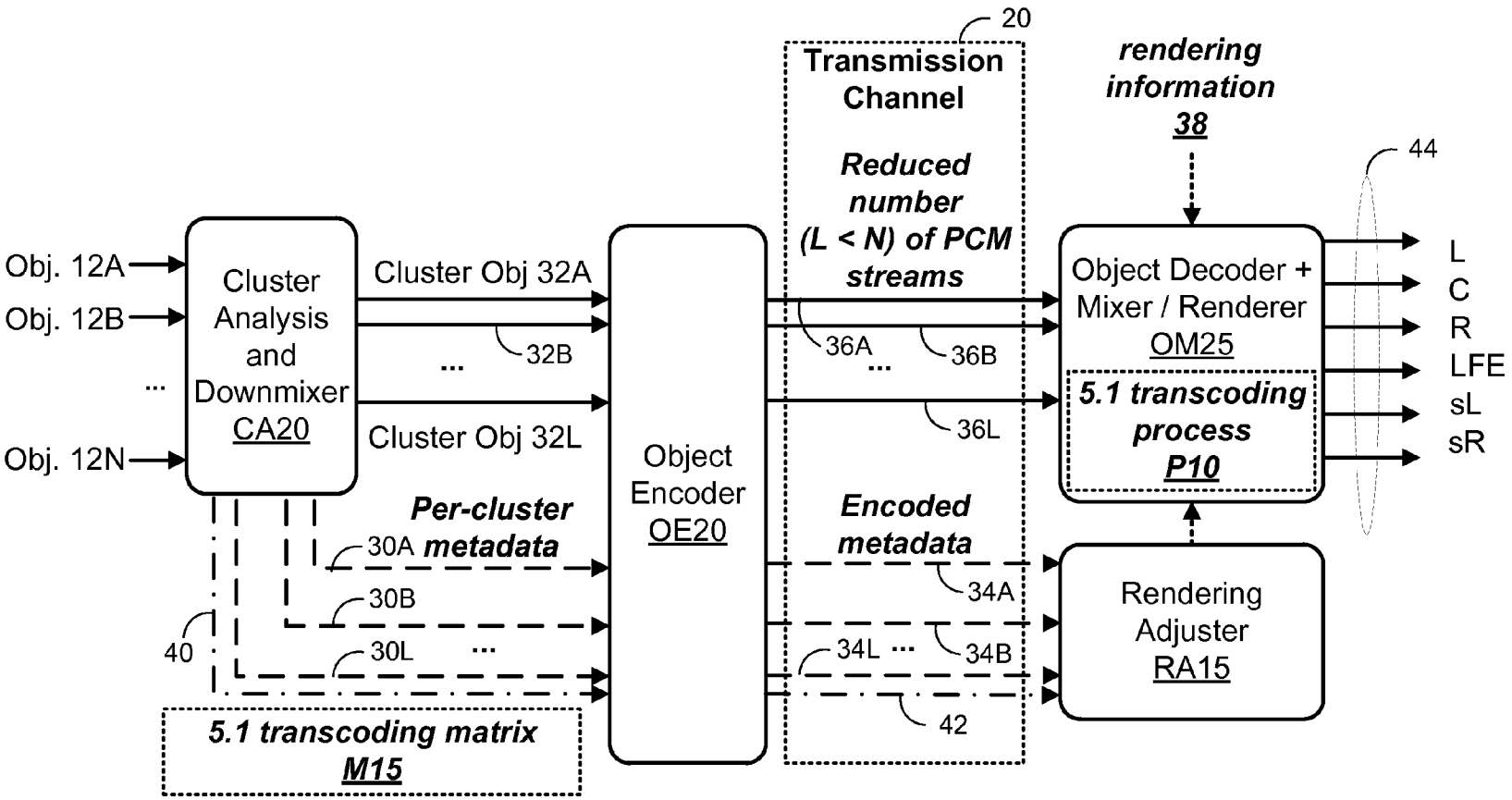
FIGS. 9 and 10 show transcoding for backward compatibility.
Figure 10:
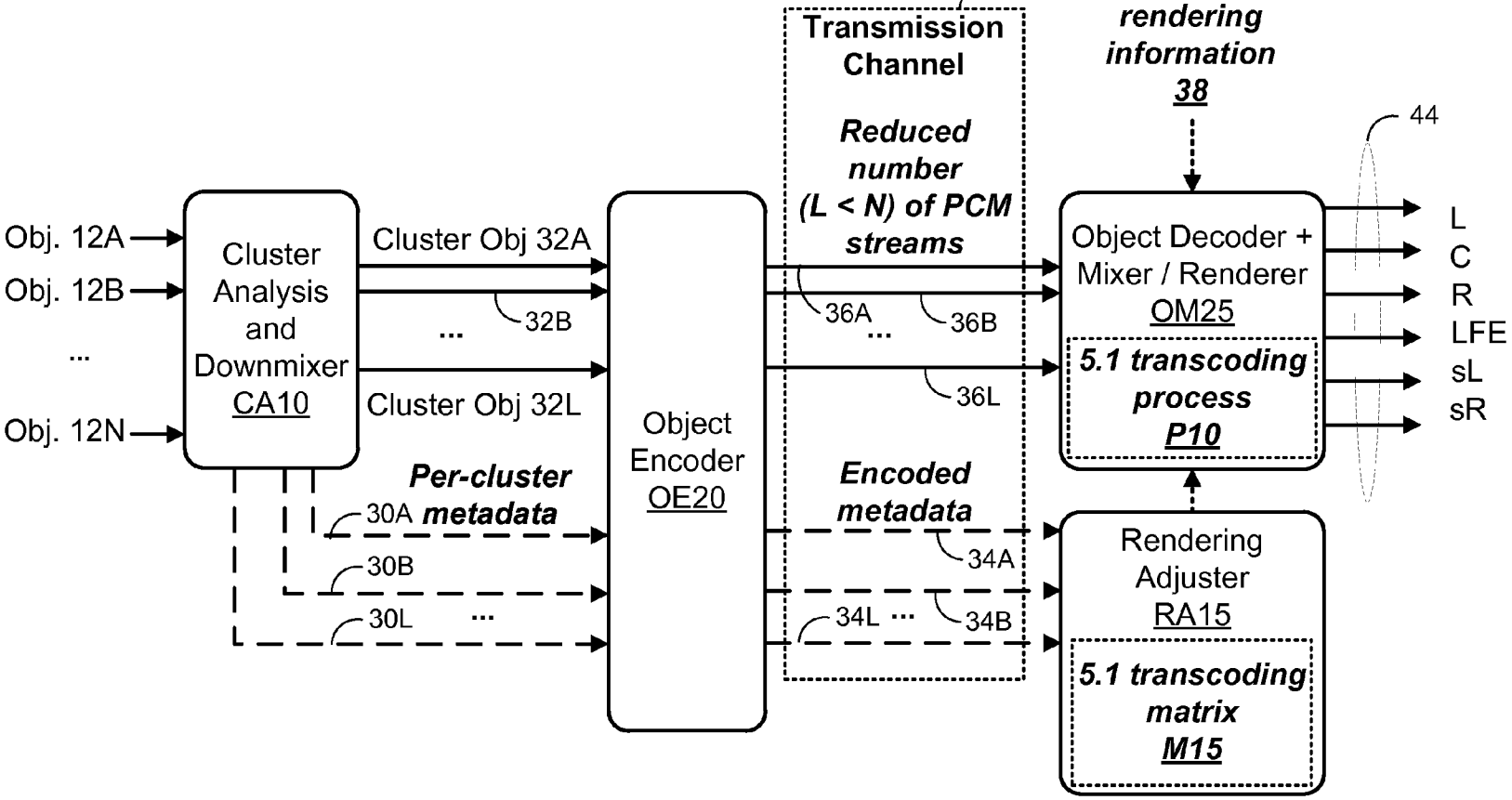

To ensure backward compatibility, the techniques may, in some examples, implement such a coding scheme to render one or more legacy outputs as well (e.g., 5.1 surround format). To fulfill this objective (using the 5.1 format as an example), a transcoding matrix from the length-L cluster vector to the length-6 5.1 cluster may be applied, so that the final audio vector $C_{5.1}$ can be obtained according to an expression such as:

$$C_{5.1}=A_{trans\ 5.1(6\times L)}C,$$

where $A_{trans\ 5.1}$ is the transcoding matrix. The transcoding matrix may be designed and enforced from the encoder side, or it may be calculated and applied at the decoder side. FIGS. 9 and 10 show examples of these two approaches.

FIG. 9 shows an example in which the transcoding matrix M15 is encoded in the metadata 40 (e.g., by an implementation of task T300) and further for transmission by transmission channel 20 in the encoded metadata 42. In this case, the transcoding matrix can be low-rate data in metadata, so the desired downmix (or upmix) design to 5.1 can be specified at the encoder end while not increasing much data. FIG. 10 shows an example in which the transcoding matrix M15 is calculated by the decoder (e.g., by an implementation of task T400).

Figure 11:
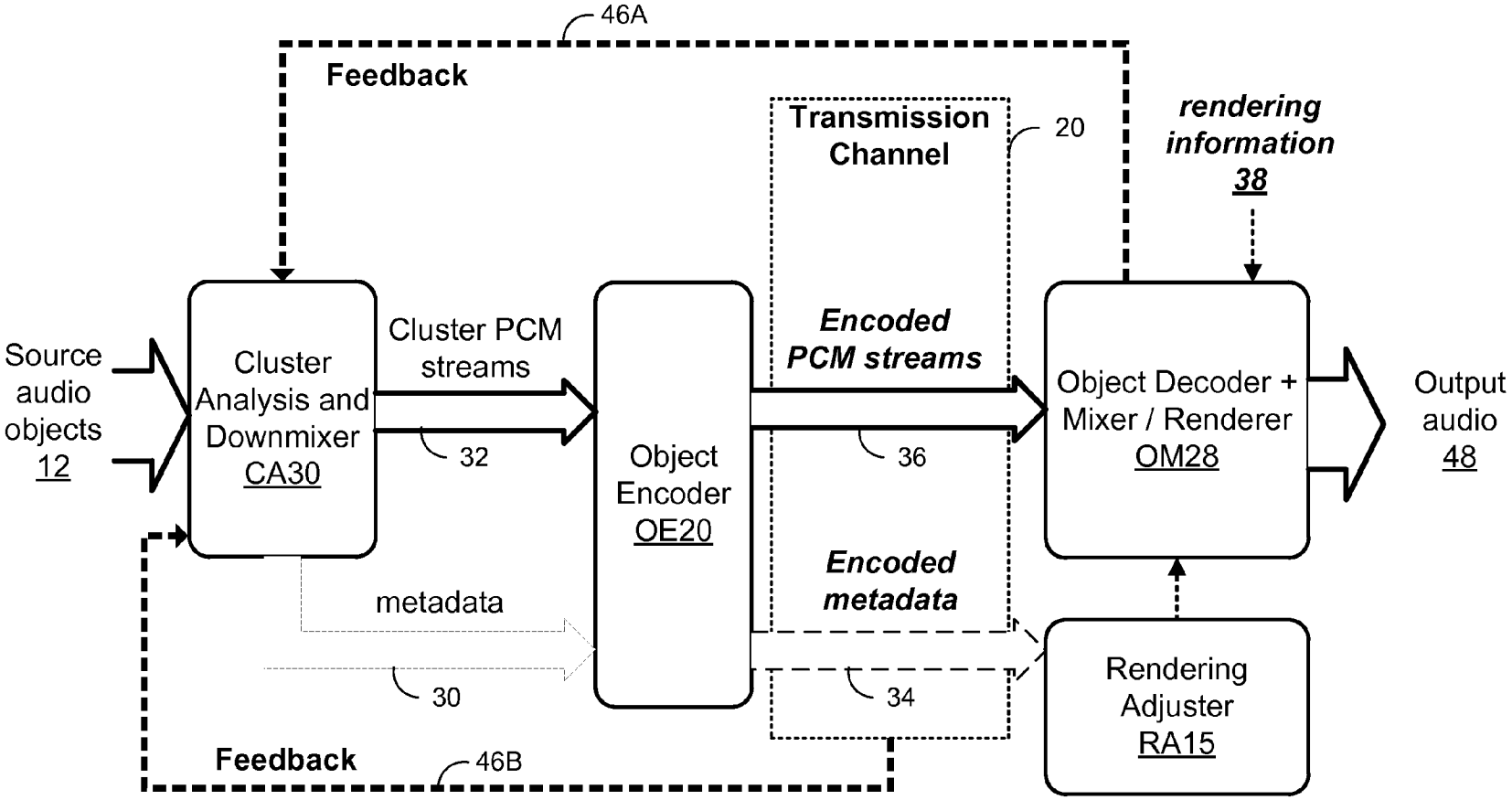
FIG. 11 shows a feedback design for cluster analysis updating.

Situations may arise in which the techniques described in this disclosure may be performed to update the cluster analysis parameters. As time passes, various aspects of the techniques described in this disclosure may, in some examples, be performed so as to enable the encoder to obtain knowledge from different nodes of the system. FIG. 11 illustrates one example of a feedback design concept, where output audio 48 may in some cases include instances of channels 14.

As shown in FIG. 10, during a communication type of real-time coding (e.g., a 3D audio conference with multiple talkers as the audio source objects), Feedback 46B can monitor and report the current channel condition in the transmission channel 20. When the channel capacity decreases, aspects of the techniques described in this disclosure may, in some examples, be performed to reduce the maximum number of designated cluster count, so that the data rate is reduced in the encoded PCM channels.

In other cases, a decoder CPU of object decoder and mixer/renderer OM28 may be busy running other tasks, causing the decoding speed to slow down and become the system bottleneck. The object decoder and mixer/renderer OM28 may transmit such information (e.g., an indication of decoder CPU load) back to the encoder as Feedback 46A, and the encoder may reduce the number of clusters in response to Feedback 46A. The output channel configuration or speaker setup can also change during decoding; such a change may be indicated by Feedback 46B and the encoder end comprising the cluster analysis and downmixer CA30 will update accordingly. In another example, Feedback 46A carries an indication of the user's current head orientation, and the encoder performs the clustering according to this information (e.g., to apply a direction dependence with respect to the new orientation). Other types of feedback that may be carried back from the object decoder and mixer/renderer OM28 include information about the local rendering environment, such as the number of loudspeakers, the room response, reverberation, etc. An encoding system may be implemented to respond to either or both types of feedback (i.e., to Feedback 46A and/or to Feedback 46B), and likewise object decoder and mixer/renderer OM28 may be implemented to provide either or both of these types of feedback.

The above are non-limiting examples of having a feedback mechanism built in the system. Additional implementations may include other design details and functions.

A system for audio coding may be configured to have a variable bit rate. In such case, the particular bit rate to be used by the encoder may be the audio bit rate that is associated with a selected one of a set of operating points. For example, a system for audio coding (e.g., MPEG-H 3D-Audio) may use a set of operating points that includes one or more (possibly all) of the following bitrates: 1.5 Mb/s, 768 kb/s, 512 kb/s, 256 kb/s. Such a scheme may also be extended to include operating points at lower bitrates, such as 96 kb/s, 64 kb/s, and 48 kb/s. The operating point may be indicated by the particular application (e.g., voice communication over a limited channel vs. music recording), by user selection, by feedback from a decoder and/or renderer, etc. It is also possible for the encoder to encode the same content into multiple streams at once, where each stream may be controlled by a different operating point.

As noted above, a maximum number of clusters may be specified according to the transmission channel 20 capacity and/or intended bit rate. For example, cluster analysis task T100 may be configured to impose a maximum number of clusters that is indicated by the current operating point. In one such example, task T100 is configured to retrieve the maximum number of clusters from a table that is indexed by the operating point (alternatively, by the corresponding bit rate). In another such example, task T100 is configured to calculate the maximum number of clusters from an indication of the operating point (alternatively, from an indication of the corresponding bit rate).

In one non-limiting example, the relationship between the selected bit rate and the maximum number of clusters is linear. In this example, if a bit rate A is half of a bit rate B, then the maximum number of clusters associated with bit rate A (or a corresponding operating point) is half of the maximum number of clusters associated with bit rate B (or a corresponding operating point). Other examples include schemes in which the maximum number of clusters decreases slightly more than linearly with bit rate (e.g., to account for a proportionally larger percentage of overhead).

Alternatively or additionally, a maximum number of clusters may be based on feedback received from the transmission channel 20 and/or from a decoder and/or renderer. In one example, feedback from the channel (e.g., Feedback 46B) is provided by a network entity that indicates a transmission channel 20 capacity and/or detects congestion (e.g., monitors packet loss). Such feedback may be implemented, for example, via RTCP messaging (Real-Time Transport Control Protocol, as defined in, e.g., the Internet Engineering Task Force (IETF) specification RFC 3550, Standard 64 (July 2003)), which may include transmitted octet counts, transmitted packet counts, expected packet counts, number and/or fraction of packets lost, jitter (e.g., variation in delay), and round-trip delay.

The operating point may be specified to the cluster analysis and downmixer CA30 (e.g., by the transmission channel 20 or by the object decoder and mixer/renderer OM28) and used to indicate the maximum number of clusters as described above. For example, feedback information from the object decoder and mixer/renderer OM28 (e.g., Feedback 46A) may be provided by a client program in a terminal computer that requests a particular operating point or bit rate. Such a request may be a result of a negotiation to determine transmission channel 20 capacity. In another example, feedback information received from the transmission channel 20 and/or from the object decoder and mixer/renderer OM28 is used to select an operating point, and the selected operating point is used to indicate the maximum number of clusters as described above.

It may be common that the capacity of the transmission channel 20 will limit the maximum number of clusters. Such a constraint may be implemented such that the maximum number of clusters depends directly on a measure of transmission channel 20 capacity, or indirectly such that a bit rate or operating point, selected according to an indication of channel capacity, is used to obtain the maximum number of clusters as described herein.

As noted above, the L clustered streams 32 may be produced as WAV files or PCM streams with accompanying metadata 30. Alternatively, various aspects of the techniques described in this disclosure may, in some examples, be performed, for one or more (possibly all) of the L clustered streams 32, to use a hierarchical set of elements to represent the sound field described by a stream and its metadata. A hierarchical set of elements is a set in which the elements are ordered such that a basic set of lower-ordered elements provides a full representation of the modeled sound field. As the set is extended to include higher-order elements, the representation becomes more detailed. One example of a hierarchical set of elements is a set of spherical harmonic coefficients or SHC.

In this approach, the clustered streams 32 are transformed by projecting them onto a set of basis functions to obtain a hierarchical set of basis function coefficients. In one such example, each stream 32 is transformed by projecting it (e.g., frame-by-frame) onto a set of spherical harmonic basis functions to obtain a set of SHC. Other examples of hierarchical sets include sets of wavelet transform coefficients and other sets of coefficients of multi-resolution basis functions.

The coefficients generated by such a transform have the advantage of being hierarchical (i.e., having a defined order relative to one another), making them amenable to scalable coding. The number of coefficients that are transmitted (and/or stored) may be varied, for example, in proportion to the available bandwidth (and/or storage capacity). In such case, when higher bandwidth (and/or storage capacity) is available, more coefficients can be transmitted, allowing for greater spatial resolution during rendering. Such transformation also allows the number of coefficients to be independent of the number of objects that make up the sound field, such that the bit-rate of the representation may be independent of the number of audio objects that were used to construct the sound field.

The following expression shows an example of how a PCM object $s_i(t)$, along with its metadata (containing location co-ordinates, etc.), may be transformed into a set of SHC:

$$s_i(t, r_l, \theta_l, \varphi_l) = \sum_{\omega=0}^{\infty}\left[\sum_{n=0}^{\infty} j_n(kr_l)\sum_{m=-n}^{n} A_n^m(k)Y_n^m(\theta_l, \varphi_l)\right]e^{j\omega t}, \quad (1)$$

where the wavenumber $$k = \frac{\omega}{c},$$

c is the speed of sound (~343 m/s), $\{r_l,\theta_l,\phi_l\}$ is a point of reference (or observation point) within the sound field, $j_n(\bullet)$ is the spherical Bessel function of order n, and $Y_n^m(\theta_l,\phi_l)$ are the spherical harmonic basis functions of order n and suborder m (some descriptions of SHC label n as degree (i.e. of the corresponding Legendre polynomial) and m as order). It can be recognized that the term in square brackets is a frequency-domain representation of the signal (i.e., $S(\omega,r_l,\theta_l,\phi_l)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

A sound field may be represented in terms of SHC using an expression such as the following:

$$p_i(t, r_l, \theta_l, \varphi_l) = \sum_{\omega=0}^{\infty}\left[4\pi\sum_{n=0}^{\infty} j_n(kr_l)\sum_{m=-n}^{n} A_n^m(k)Y_n^m(\theta_l, \varphi_l)\right]e^{j\omega t}, \quad (2)$$

This expression shows that the pressure $p_i$ at any point $\{r_l,\theta_l,\phi_l\}$ of the sound field can be represented uniquely by the SHC $A_n^m(k)$.

Figure 12:
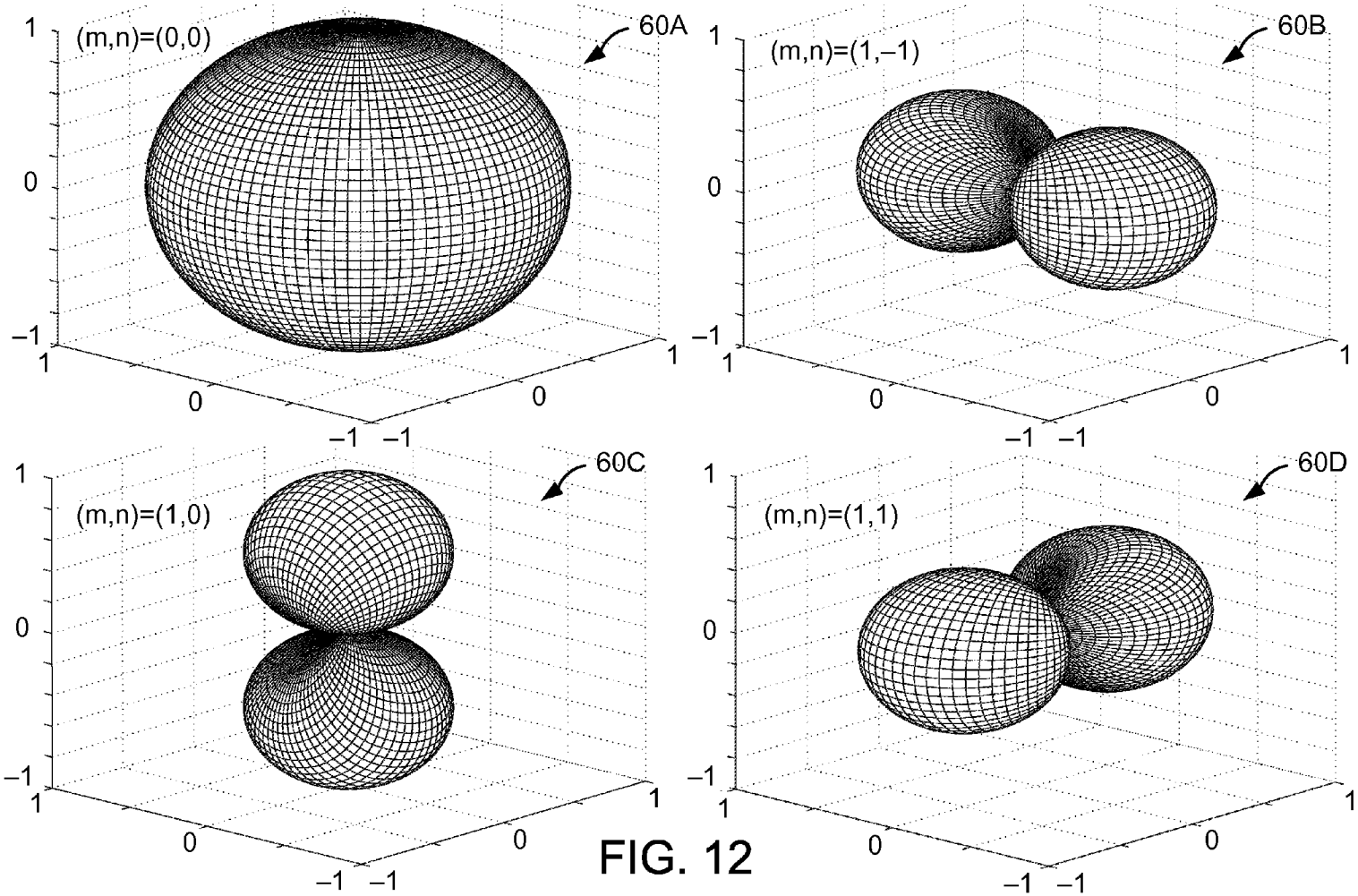
FIG. 12 shows examples of surface mesh plots of the magnitudes of spherical harmonic basis functions of order 0 and 1.

FIG. 12 shows examples of surface mesh plots of the magnitudes of spherical harmonic basis functions of order 0 and 1. The magnitude of the function $Y_0^0$ is spherical and omnidirectional. The function $Y_1^{-1}$ has positive and negative spherical lobes extending in the +y and −y directions, respectively. The function $Y_1^0$ has positive and negative spherical lobes extending in the +z and −z directions, respectively. The function $Y_1^1$ has positive and negative spherical lobes extending in the +x and −x directions, respectively.

Figure 13:
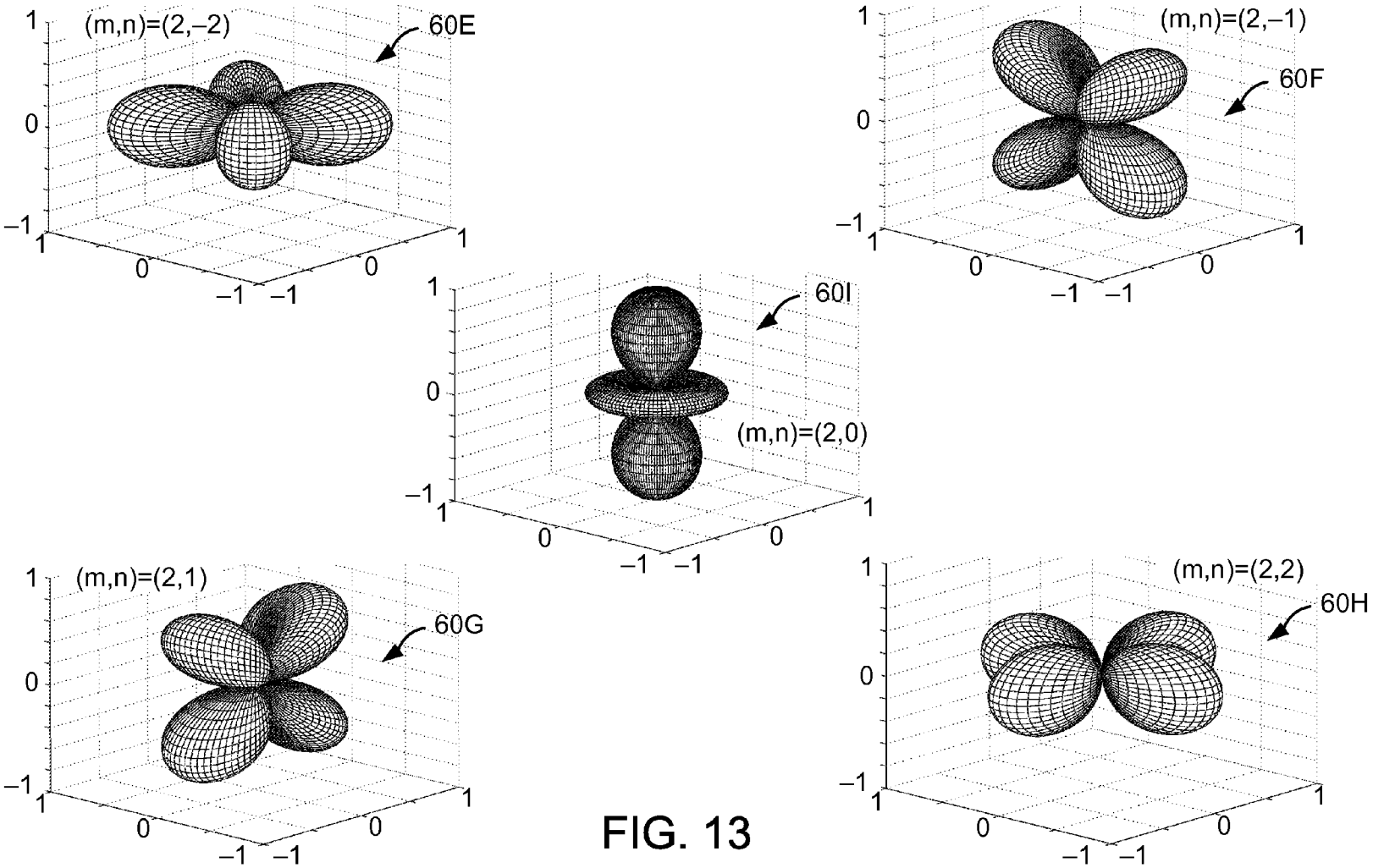
FIG. 13 shows examples of surface mesh plots of the magnitudes of spherical harmonic basis functions of order 2.

FIG. 13 shows examples of surface mesh plots of the magnitudes of spherical harmonic basis functions of order 2. The functions $Y_2^{-2}$ and $Y_2^2$ have lobes extending in the x-y plane. The function $Y_2^{-1}$ has lobes extending in the y-z plane, and the function $Y_2^1$ has lobes extending in the x-z plane. The function $Y_2^0$ has positive lobes extending in the +z and −z directions and a toroidal negative lobe extending in the x-y plane.

The SHC $A_n^m(k)$ for the sound field corresponding to an individual audio object or cluster may be expressed as $$A_n^m(k)=g(\omega)(-4\pi ik)h_n^{(2)}(kr_s)Y_n^{m*}(\theta_s,\phi_s), \quad (3)$$

where i is $\sqrt{-1}$ and $h_n^{(2)}(\bullet)$ is the spherical Hankel function (of the second kind) of order n. Knowing the source energy $g(\omega)$ as a function of frequency allows us to convert each PCM object and its location $\{r_s,\theta_s,\phi_s\}$ into the SHC $A_n^m(k)$. This source energy may be obtained, for example, using time-frequency analysis techniques, such as by performing a fast Fourier transform (e.g., a 256-, 512-, or 1024-point FFT) on the PCM stream. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, these coefficients contain information about the sound field (the pressure as a function of 3D coordinates), and the above represents the transformation from individual objects to a representation of the overall sound field, in the vicinity of the observation point $\{r_l,\theta_l,\phi_l\}$. The total number of SHC to be used may depend on various factors, such as the available bandwidth.

One of skill in the art will recognize that representations of coefficients $A_n^m$ (or, equivalently, of corresponding time-domain coefficients $a_n^m$) other than the representation shown in expression (3) may be used, such as representations that do not include the radial component. One of skill in the art will recognize that several slightly different definitions of spherical harmonic basis functions are known (e.g., real, complex, normalized (e.g., N3D), semi-normalized (e.g., SN3D), Furse-Malham (FuMa or FMH), etc.), and consequently that expression (2) (i.e., spherical harmonic decomposition of a sound field) and expression (3) (i.e., spherical harmonic decomposition of a sound field produced by a point source) may appear in the literature in slightly different form. The present description is not limited to any particular form of the spherical harmonic basis functions and indeed is generally applicable to other hierarchical sets of elements as well.

Figure 14A:
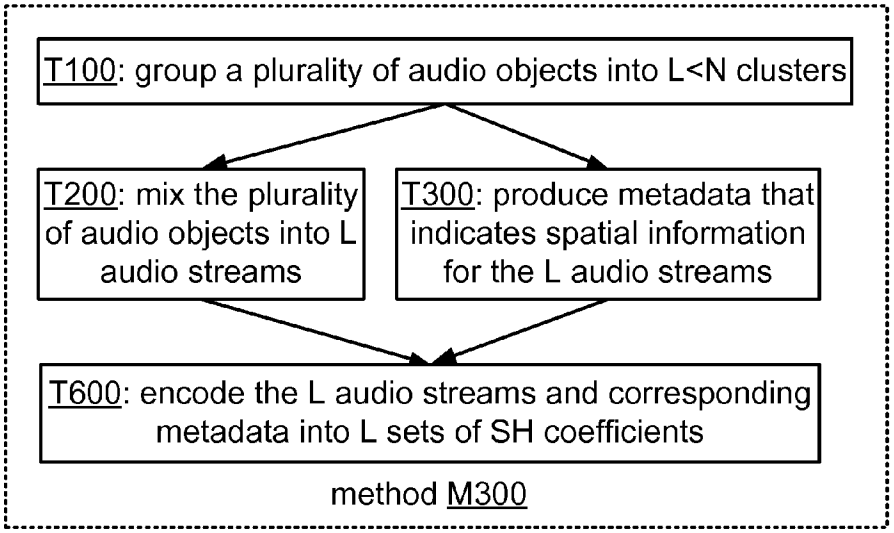
FIG. 14A shows a flowchart for an implementation M300 of method M100.
Figure 14B:
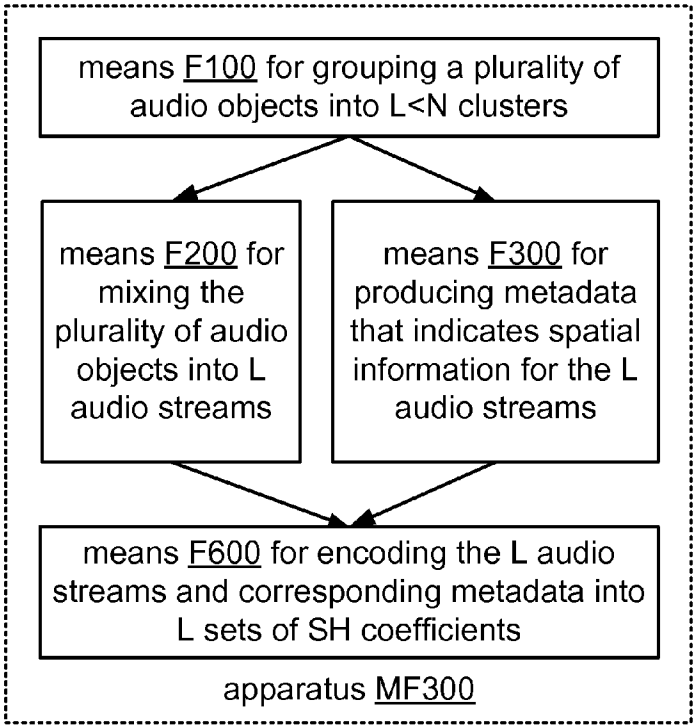
FIG. 14B shows a block diagram of an apparatus MF300 according to a general configuration.

FIG. 14A shows a flowchart for an implementation M300 of method M100. Method M300 includes a task T600 that encodes the L clustered audio objects 32 and corresponding spatial information 30 into L sets of SHC 74A-74L. FIG. 12B shows a block diagram of an apparatus MF300 for audio signal processing according to a general configuration. Apparatus MF300 includes means F100, means F200, and means F300 as described herein. Apparatus MF300 also includes means F600 for encoding the L clustered audio objects 32 and corresponding metadata 30 into L sets of SH coefficients 74A-74L (e.g., as described herein with reference to task T600) and to encode the metadata as encoded metadata 34.

Figure 14C:
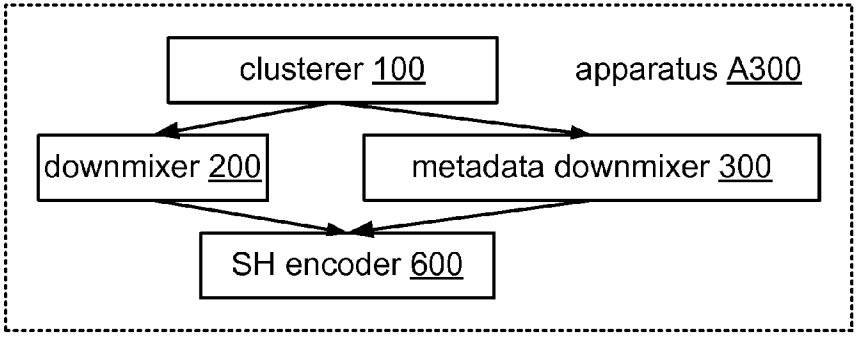
FIG. 14C shows a block diagram of an apparatus A300 according to a general configuration.

FIG. 14C shows a block diagram of an apparatus A300 for audio signal processing according to a general configuration. Apparatus A300 includes clusterer 100, downmixer 200, and metadata downmixer 300 as described herein. Apparatus MF300 also includes an SH encoder 600 configured to encode the L clustered audio objects 32 and corresponding metadata 30 into L sets of SH coefficients 74A-74L (e.g., as described herein with reference to task T600).

Figure 15A:
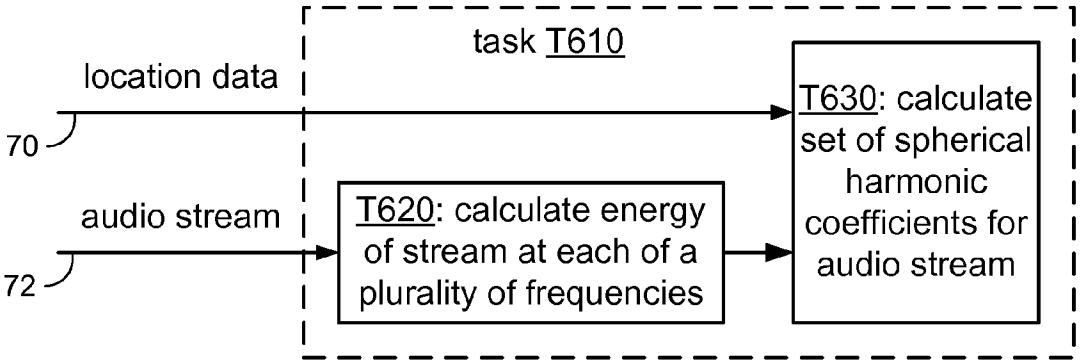
FIG. 15A shows a flowchart for a task T610.
Figure 15B:
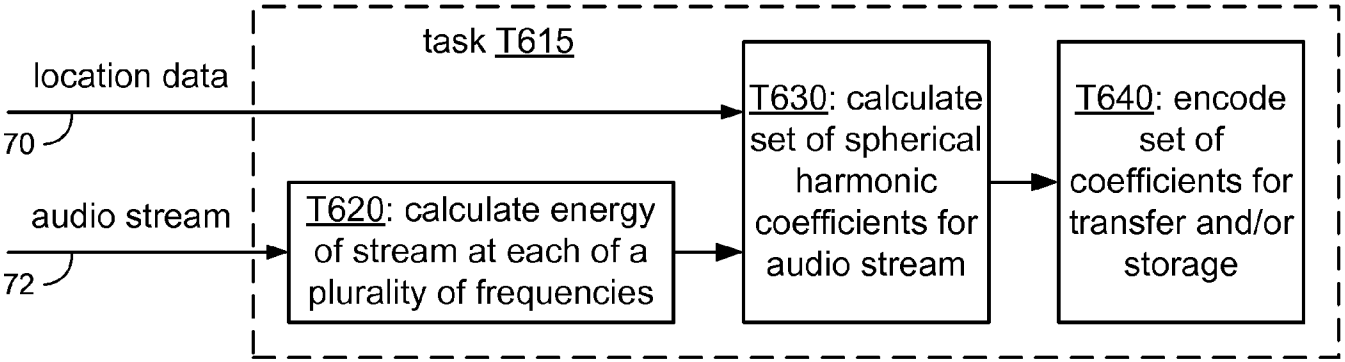
FIG. 15B shows a flowchart of an implementation T615 of task T610.

FIG. 15A shows a flowchart for a task T610 that includes subtasks T620 and T630. Task T620 calculates an energy $g(\omega)$ of the object (represented by stream 72) at each of a plurality of frequencies (e.g., by performing a fast Fourier transform on the object's PCM stream 72). Based on the calculated energies and location data 70 for the stream 72, task T630 calculates a set of SHC (e.g., a B-Format signal). FIG. 15B shows a flowchart of an implementation T615 of task T610 that includes task T640, which encodes the set of SHC for transmission and/or storage. Task T600 may be implemented to include a corresponding instance of task T610 (or T615) for each of the L audio streams 32.

Task T600 may be implemented to encode each of the L audio streams 32 at the same SHC order. This SHC order may be set according to the current bit rate or operating point. In one such example, selection of a maximum number of clusters as described herein (e.g., according to a bit rate or operating point) may include selection of one among a set of pairs of values, such that one value of each pair indicates a maximum number of clusters and the other value of each pair indicates an associated SHC order for encoding each of the L audio streams 36.

The number of coefficients used to encode an audio stream 32 (e.g., the SHC order, or the number of the highest-order coefficient) may be different from one stream 32 to another. For example, the sound field corresponding to one stream 32 may be encoded at a lower resolution than the sound field corresponding to another stream 32. Such variation may be guided by factors that may include, for example, the importance of the object to the presentation (e.g., a foreground voice vs. a background effect), location of the object relative to the listener's head (e.g., object to the side of the listener's head are less localizable than objects in front of the listener's head and thus may be encoded at a lower spatial resolution), location of the object relative to the horizontal plane (the human auditory system has less localization ability outside this plane than within it, so that coefficients encoding information outside the plane may be less important than those encoding information within it), etc. In one example, a highly detailed acoustic scene recording (e.g., a scene recorded using a large number of individual microphones, such as an orchestra recorded using a dedicated spot microphone for each instrument) is encoded at a high order (e.g., 100th-order) to provide a high degree of resolution and source localizability.

In another example, task T600 is implemented to obtain the SHC order for encoding an audio stream 32 according to the associated spatial information and/or other characteristic of the sound. For example, such an implementation of task T600 may be configured to calculate or select the SHC order based on information such as, e.g., diffusivity of the component objects and/or diffusivity of the cluster as indicated by the downmixed metadata. In such cases, task T600 may be implemented to select the individual SHC orders according to an overall bit-rate or operating-point constraint, which may be indicated by feedback from the channel, decoder, and/or renderer as described herein.

Figure 16A:
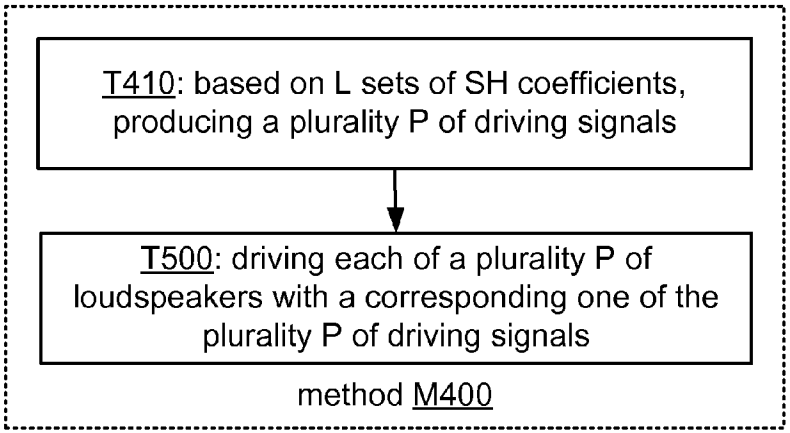
FIG. 16A shows a flowchart of an implementation M400 of method M200.

FIG. 16A shows a flowchart of an implementation M400 of method M200 that includes an implementation T410 of task T400. Based on L sets of SH coefficients, task T410 produces a plurality P of driving signals, and task T500 drives each of a plurality P of loudspeakers with a corresponding one of the plurality P of driving signals.

Figure 16C:
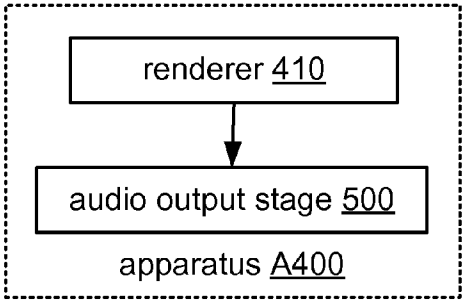
FIG. 16C shows a block diagram of an apparatus A400 according to a general configuration.
Figure 16B:
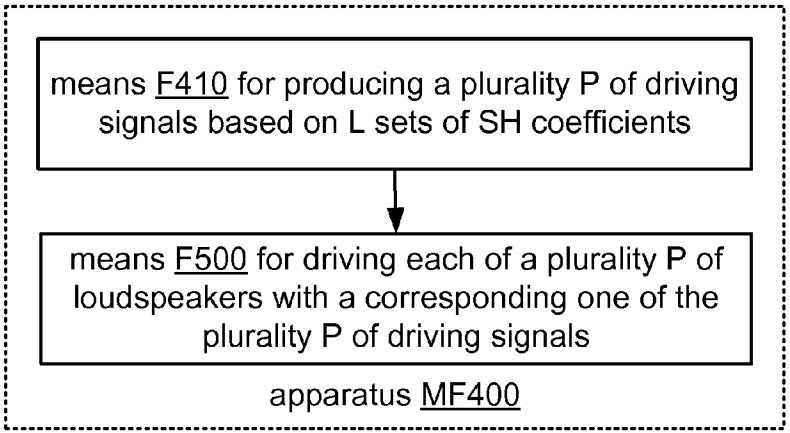
FIG. 16B shows a block diagram of an apparatus MF400 according to a general configuration.

FIG. 16B shows a block diagram of an apparatus MF400 for audio signal processing according to a general configuration. Apparatus MF400 includes means F410 for producing a plurality P of driving signals based on L sets of SH coefficients (e.g., as described herein with reference to task T410). Apparatus MF400 also includes an instance of means F500 as described herein.

FIG. 16C shows a block diagram of an apparatus A400 for audio signal processing according to a general configuration. Apparatus A400 includes a renderer 410 configured to produce a plurality P of driving signals based on L sets of SH coefficients (e.g., as described herein with reference to task T410). Apparatus A400 also includes an instance of audio output stage 500 as described herein.

Figure 19:
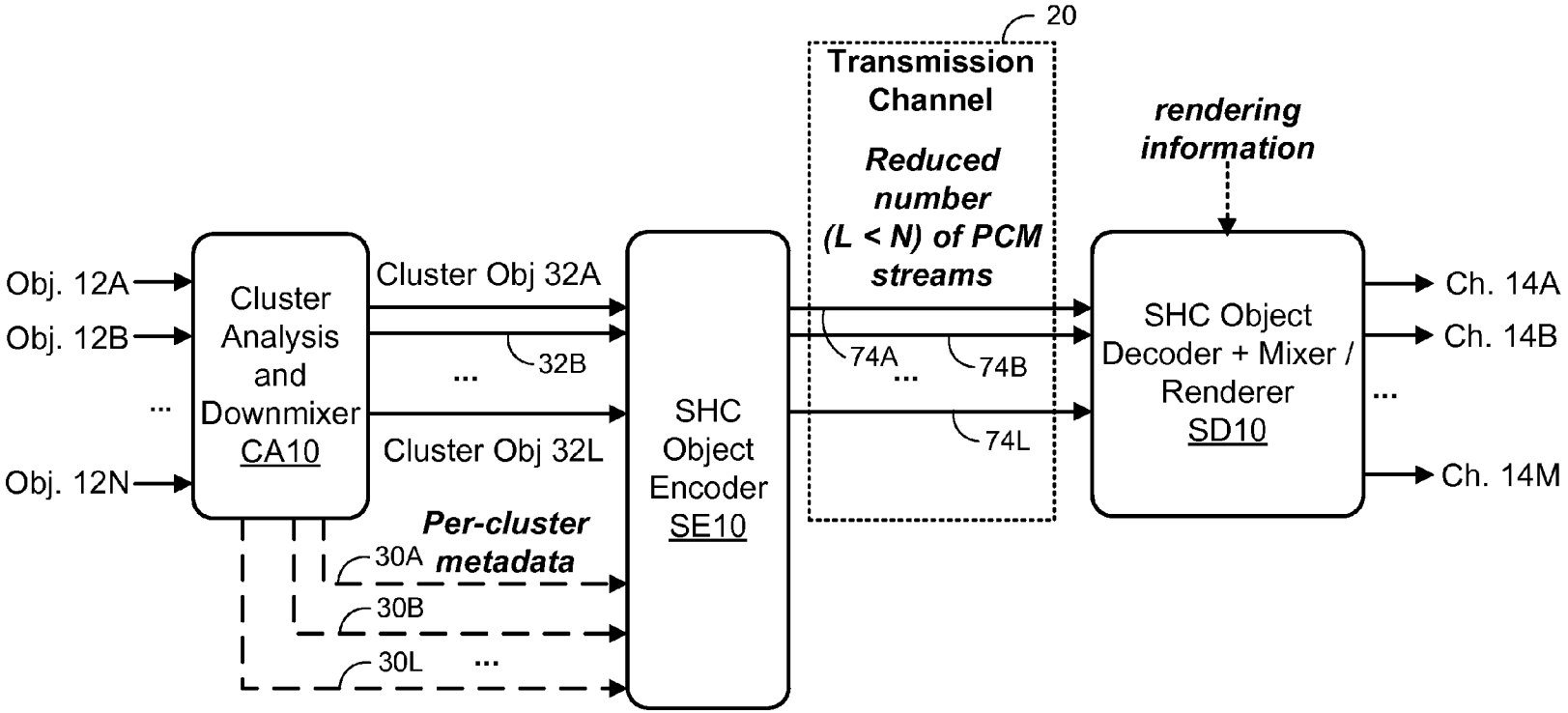
FIGS. 19-21 show conceptual diagrams of systems similar to those shown in FIGS. 8, 10, and 11.
Figure 20:
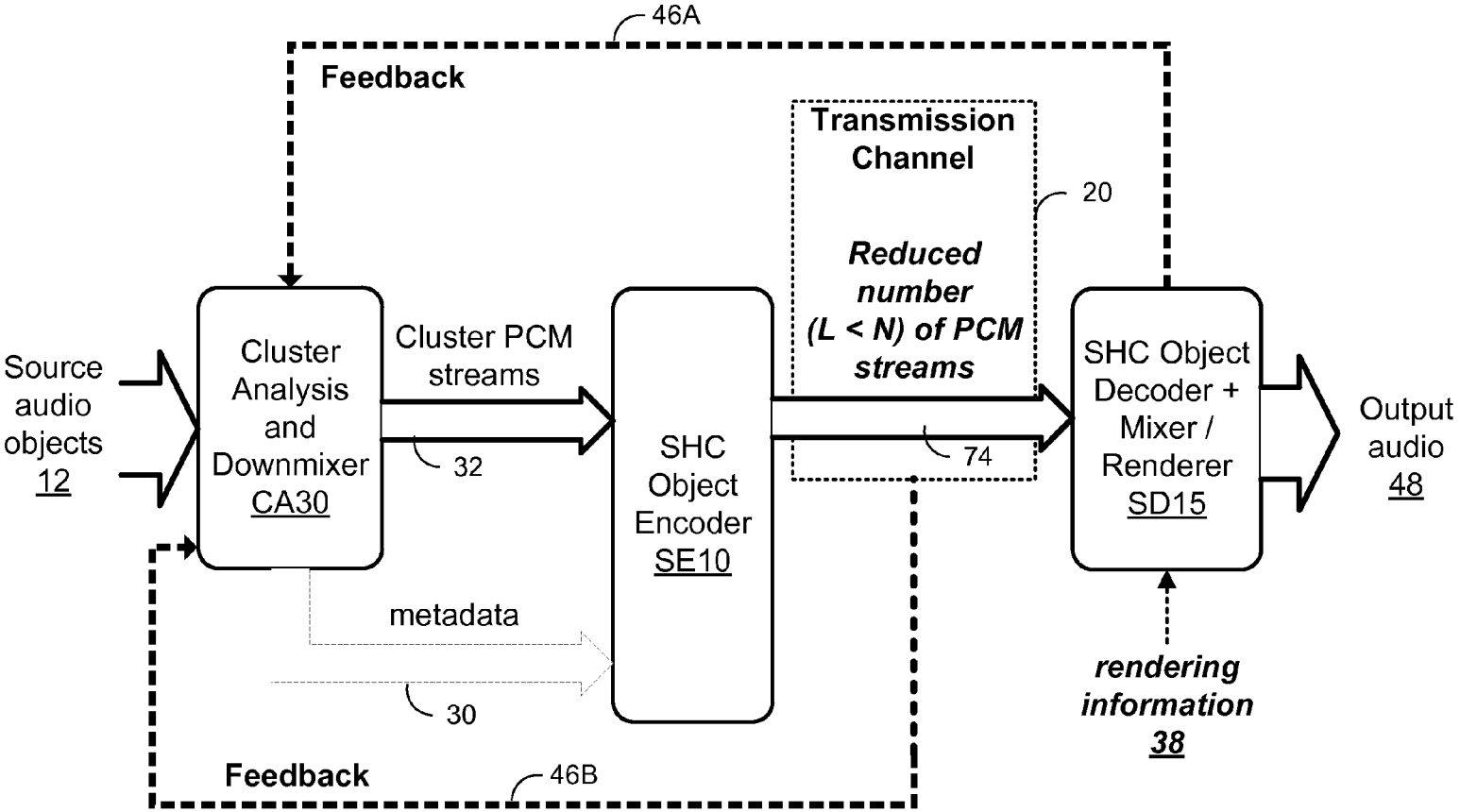
Figure 21:
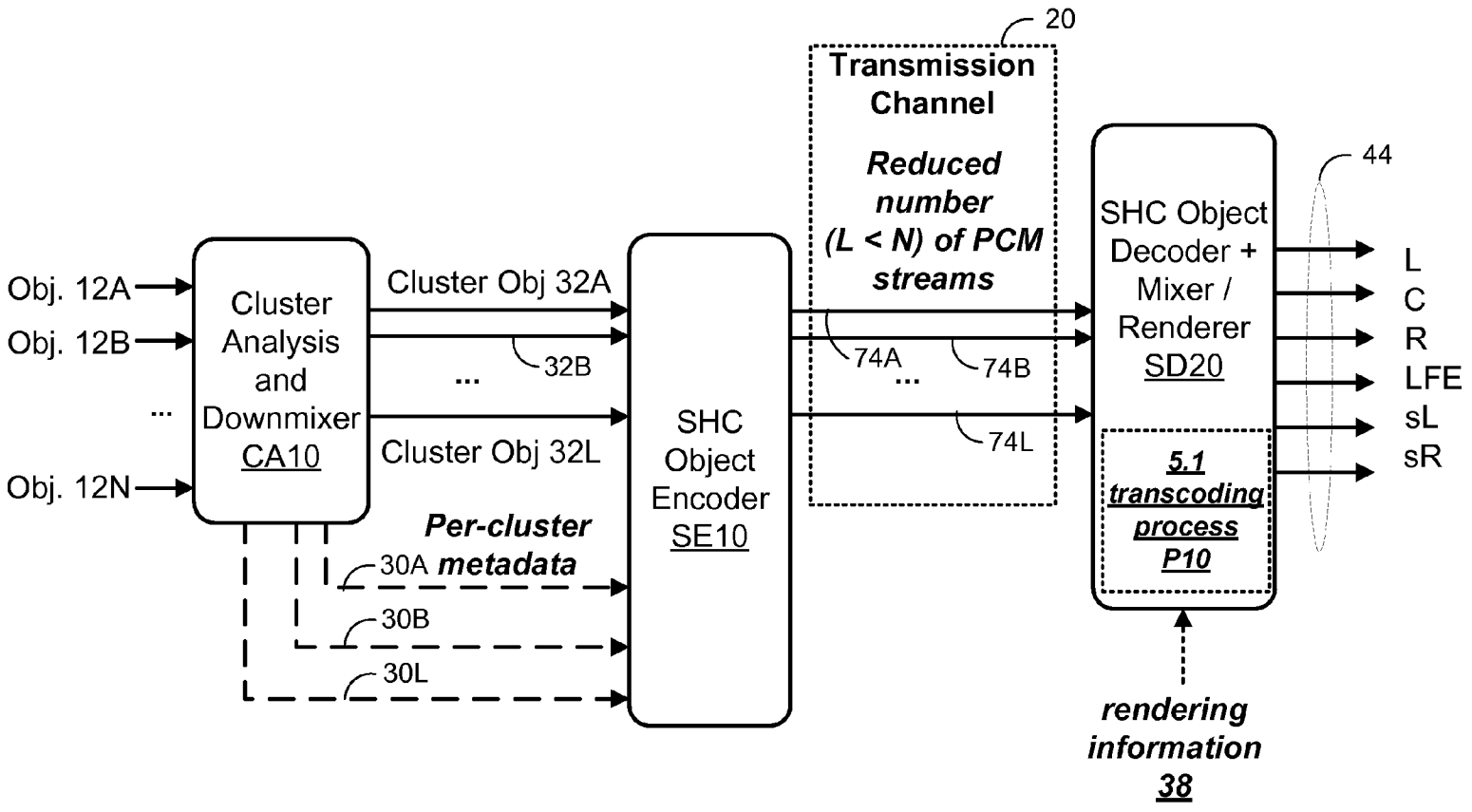

FIGS. 19, 20, and 21 show conceptual diagrams of systems as shown in FIGS. 8, 10, and 11 that include a cluster analysis and downmix module CA10 (and implementation CA30 thereof) that may be implemented to perform method M300, and a mixer/renderer module SD10 (and implementations SD15 and SD20 thereof) that may be implemented to perform method M400. This example also includes a codec as described herein that comprises an object encoder SE10 configured to encode the L SHC objects 74A-74L and an object decoder configured to decode the L SHC objects 74A-74L.

As an alternative to encoding the L audio streams 32 after clustering, various aspects of the techniques described in this disclosure may, in some examples, be performed to transform each of the audio objects 12, before clustering, into a set of SHC. In such case, a clustering method as described herein may include performing the cluster analysis on the sets of SHC (e.g., in the SHC domain rather than the PCM domain).

Figure 17A:
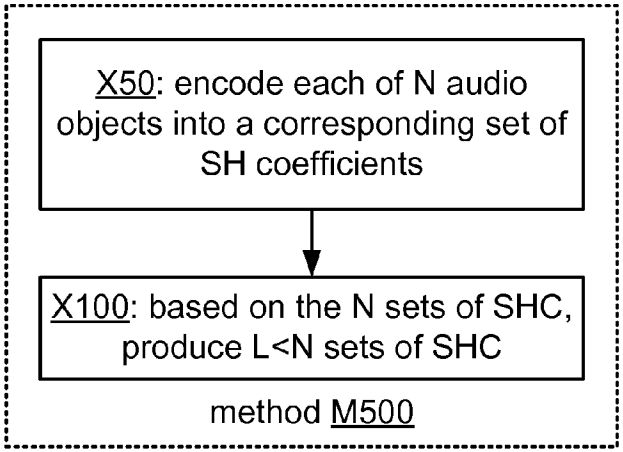
FIG. 17A shows a flowchart for a method M500 according to a general configuration.

FIG. 17A shows a flowchart for a method M500 according to a general configuration that includes tasks X50 and X100. Task X50 encodes each of the N audio objects 12 into a corresponding set of SHC. For a case in which each object 12 is an audio stream with corresponding location data, task X50 may be implemented according to the description of task T600 herein (e.g., as multiple implementations of task T610).

Task X50 may be implemented to encode each object 12 at a fixed SHC order (e.g., second-, third-, fourth-, or fifth-order or more). Alternatively, task X50 may be implemented to encode each object 12 at an SHC order that may vary from one object 12 to another based on one or more characteristics of the sound (e.g., diffusivity of the object 12, as may be indicated by the spatial information associated with the object). Such a variable SHC order may also be subject to an overall bit-rate or operating-point constraint, which may be indicated by feedback from the channel, decoder, and/or renderer as described herein.

Figure 17B:
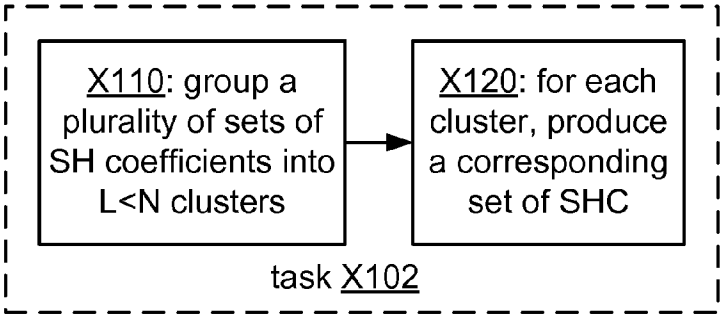
FIG. 17B shows a flowchart of an implementation X102 of task X100.

Based on a plurality of at least N sets of SHC, task X100 produces L sets of SHC, where L is less than N. The plurality of sets of SHC may include, in addition to the N sets, one or more additional objects that are provided in SHC form. FIG. 17B shows a flowchart of an implementation X102 of task X100 that includes subtasks X110 and X120. Task X110 groups a plurality of sets of SHC (which plurality includes the N sets of SHC) into L clusters. For each cluster, task X120 produces a corresponding set of SHC. Task X120 may be implemented, for example, to produce each of the L clustered objects by calculating a sum (e.g., a coefficient vector sum) of the SHC of the objects assigned to that cluster to obtain a set of SHC for the cluster. In another implementation, task X120 may be configured to concatenate the coefficient sets of the component objects instead.

For a case in which the N audio objects are provided in SHC form, of course, task X50 may be omitted and task X100 may be performed on the SHC-encoded objects. For an example in which the number N of objects is one hundred and the number L of clusters is ten, such a task may be applied to compress the objects into only ten sets of SHC for transmission and/or storage, rather than one hundred.

Task X100 may be implemented to produce the set of SHC for each cluster to have a fixed order (e.g., second-, third-, fourth-, or fifth-order or more). Alternatively, task X100 may be implemented to produce the set of SHC for each cluster to have an order that may vary from one cluster to another based on, e.g., the SHC orders of the component objects (e.g., a maximum of the object SHC orders, or an average of the object SHC orders, which may include weighting of the individual orders by, e.g., magnitude and/or diffusivity of the corresponding object).

The number of SH coefficients used to encode each cluster (e.g., the number of the highest-order coefficient) may be different from one cluster to another. For example, the sound field corresponding to one cluster may be encoded at a lower resolution than the sound field corresponding to another cluster. Such variation may be guided by factors that may include, for example, the importance of the cluster to the presentation (e.g., a foreground voice vs. a background effect), location of the cluster relative to the listener's head (e.g., object to the side of the listener's head are less localizable than objects in front of the listener's head and thus may be encoded at a lower spatial resolution), location of the cluster relative to the horizontal plane (the human auditory system has less localization ability outside this plane than within it, so that coefficients encoding information outside the plane may be less important than those encoding information within it), etc.

Figure 17C:
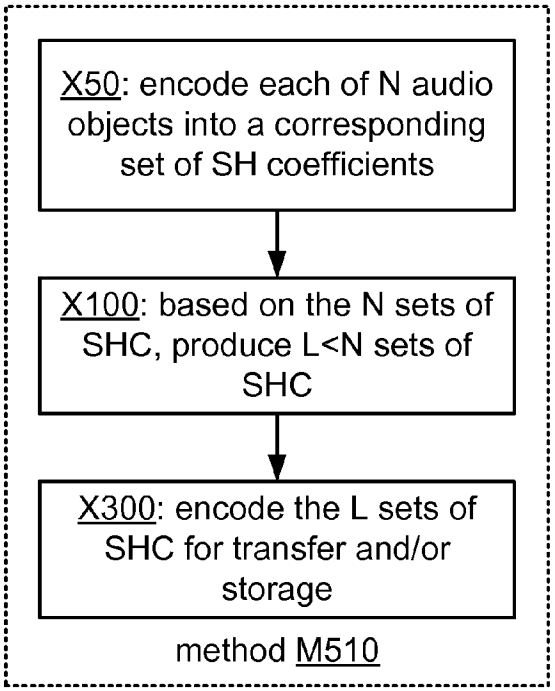
FIG. 17C shows a flowchart of an implementation M510 of method M500.

Encoding of the SHC sets produced by method M300 (e.g., task T600) or method M500 (e.g., task X100) may include one or more lossy or lossless coding techniques, such as quantization (e.g., into one or more codebook indices), error correction coding, redundancy coding, etc., and/or packetization. Additionally or alternatively, such encoding may include encoding into an Ambisonic format, such as B-format, G-format, or Higher-order Ambisonics (HOA). FIG. 17C shows a flowchart of an implementation M510 of method M500 which includes a task X300 that encodes the N sets of SHC (e.g., individually or as a single block) for transmission and/or storage.

Figure 22:
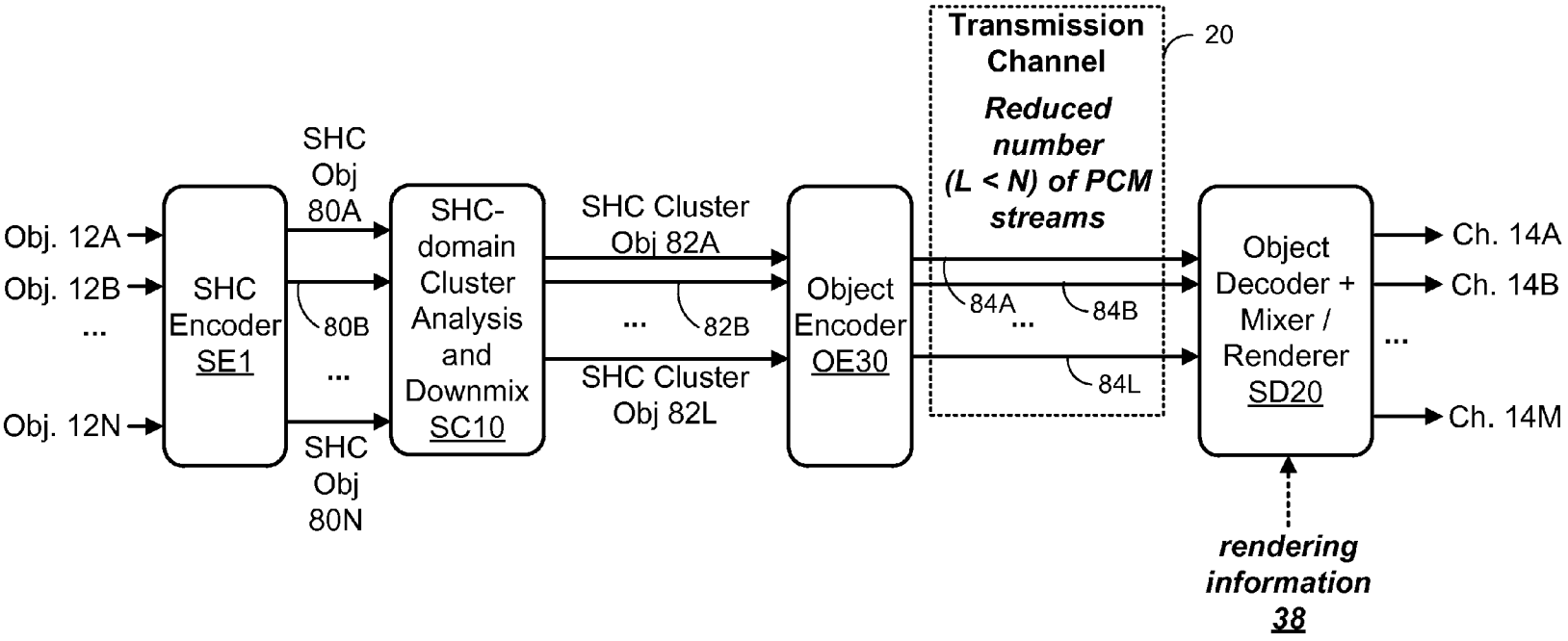
FIGS. 22-24 show conceptual diagrams of systems similar to those shown in FIGS. 8, 10, and 11.
Figure 23:
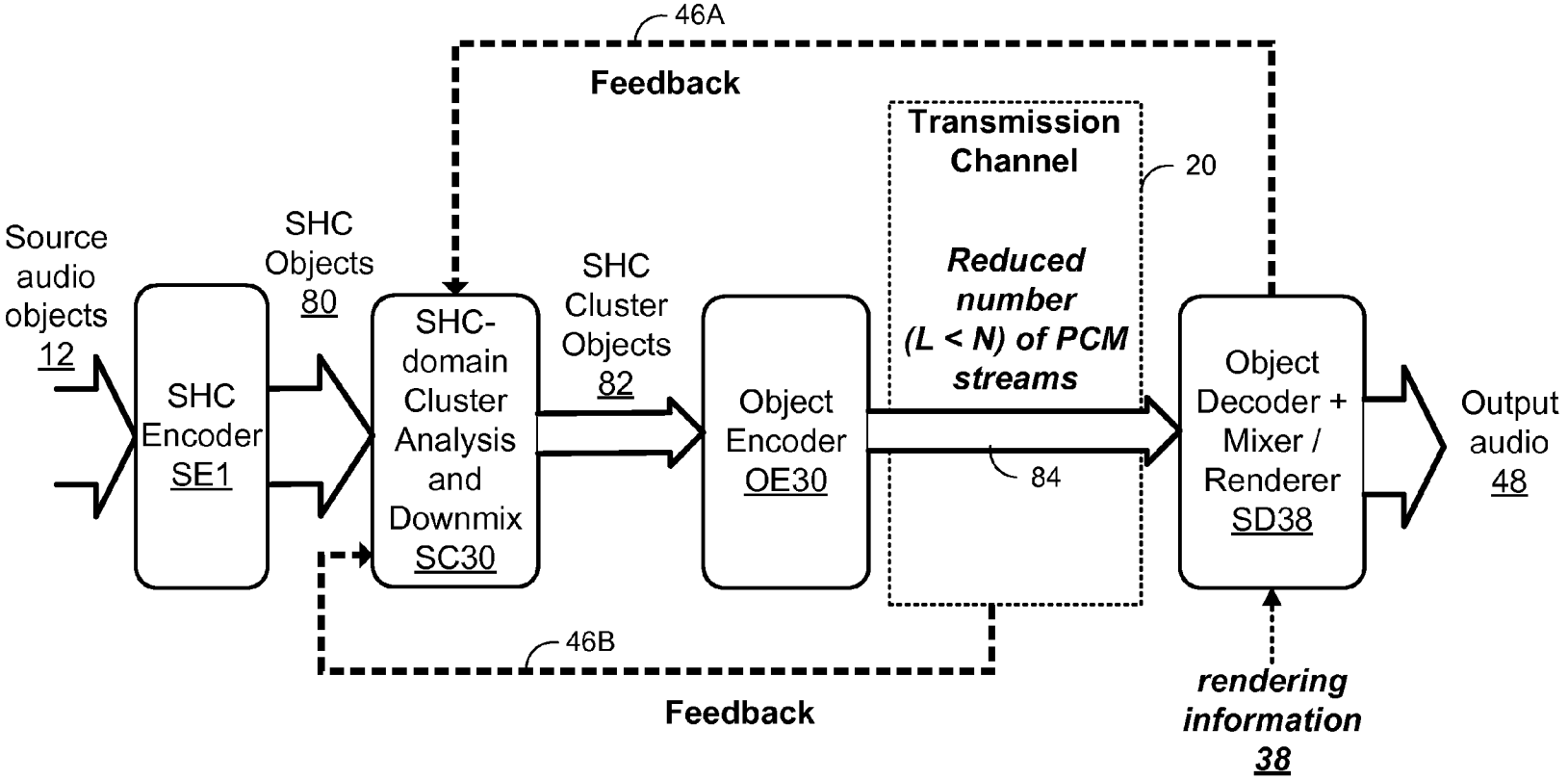
Figure 24:
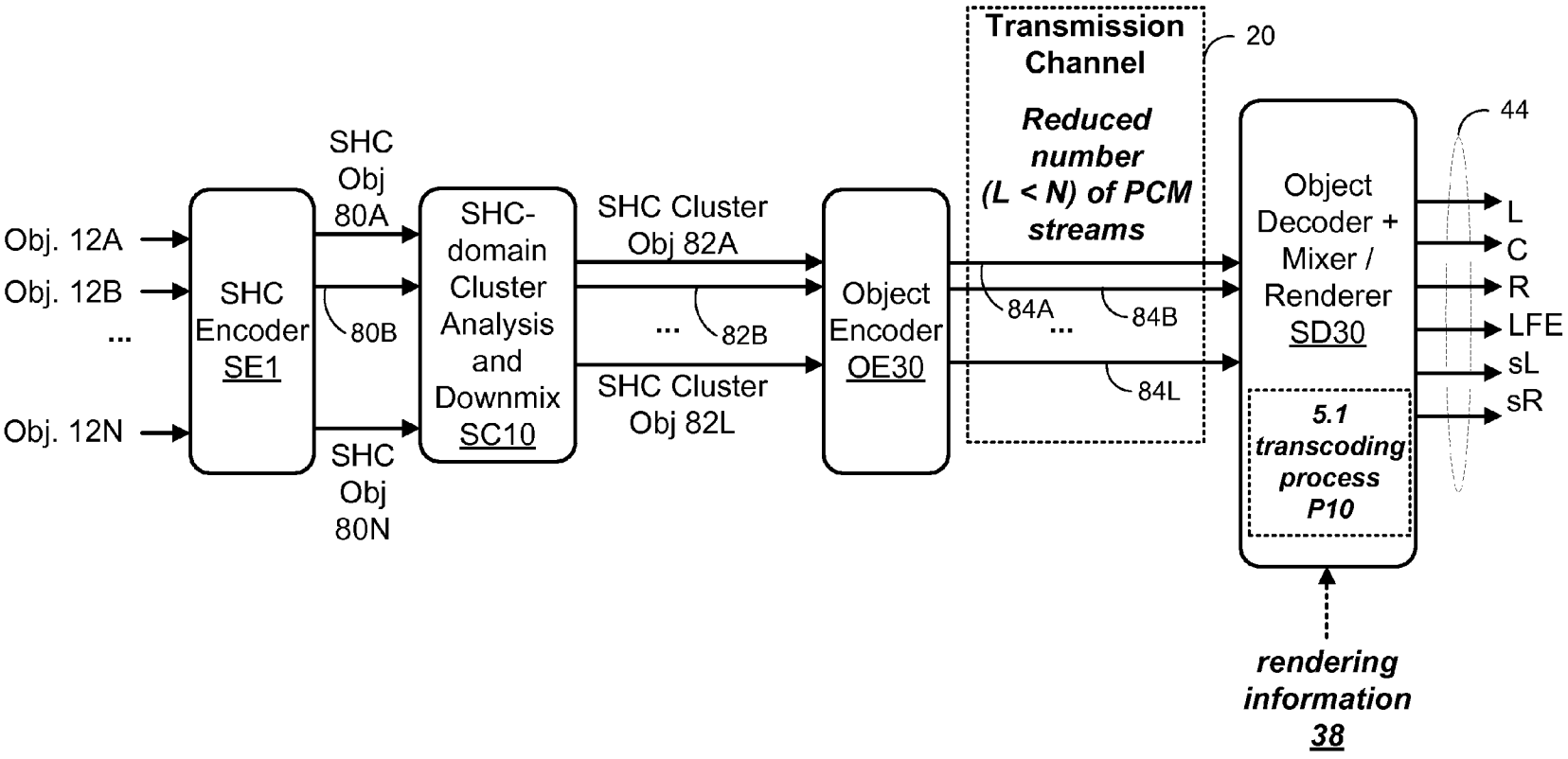

FIGS. 22, 23, and 24 show conceptual diagrams of systems as shown in FIGS. 8, 10, and 11 that include a cluster analysis and downmix module SC10 (and implementation SC30 thereof) that may be implemented to perform method M500, and a mixer/renderer of an object decoder and mixer/renderer module SD20 (and implementations SD38 and SD30 thereof) that may be implemented to perform method M400. This example also includes a codec as described herein that comprises an object encoder OE30 configured to encode the L SHC cluster objects 82A-82L and an object decoder of the object decoder and mixer/renderer module SD20 configured to decode the L SHC cluster objects 82A-82L, as well as an SHC encoder SE1 optionally includes to transform spatial audio objects 12 to the spherical harmonics domain as SHC objects 80A-80N.

Potential advantages of such a representation include one or more of the following:

i. The coefficients are hierarchical. Thus, it is possible to send or store up to a certain truncated order (say n=N) to satisfy bandwidth or storage requirements. If more bandwidth becomes available, higher-order coefficients can be sent and/or stored. Sending more coefficients (of higher order) reduces the truncation error, allowing better-resolution rendering.

ii. The number of coefficients is independent of the number of objects—meaning that it may be possible to code a truncated set of coefficients to meet the bandwidth requirement, no matter how many objects may be in the sound-scene.

iii. The conversion of the PCM object to the SHC is typically not reversible (at least not trivially). This feature may allay fears from content providers or creators who are concerned about allowing undistorted access to their copyrighted audio snippets (special effects), etc.

iv. Effects of room reflections, ambient/diffuse sound, radiation patterns, and other acoustic features can all be incorporated into the $A_n^m(k)$ coefficient-based representation in various ways.

v. The $A_n^m(k)$ coefficient-based sound field/surround-sound representation is not tied to particular loudspeaker geometries, and the rendering can be adapted to any loudspeaker geometry. Various rendering technique options can be found in the literature.

vi. The SHC representation and framework allows for adaptive and non-adaptive equalization to account for acoustic spatio-temporal characteristics at the rendering scene.

Additional features and options may include the following:

i. An approach as described herein may be used to provide a transformation path for channel- and/or object-based audio that may allow a unified encoding/decoding engine for all three formats: channel-, scene-, and object-based audio.

ii. Such an approach may be implemented such that the number of transformed coefficients is independent of the number of objects or channels.

iii. The method can be used for either channel- or object-based audio even when an unified approach is not adopted.

iv. The format is scalable in that the number of coefficients can be adapted to the available bit-rate, allowing a very easy way to trade-off quality with available bandwidth and/or storage capacity.

v. The SHC representation can be manipulated by sending more coefficients that represent the horizontal acoustic information (for example, to account for the fact that human hearing has more acuity in the horizontal plane than the elevation/height plane).

vi. The position of the listener's head can be used as feedback to both the renderer and the encoder (if such a feedback path is available) to optimize the perception of the listener (e.g., to account for the fact that humans have better spatial acuity in the frontal plane).

vii. The SHC may be coded to account for human perception (psychoacoustics), redundancy, etc.

viii. An approach as described herein may be implemented as an end-to-end solution (possibly including final equalization in the vicinity of the listener) using, e.g., spherical harmonics.

The spherical harmonic coefficients may be channel-encoded for transmission and/or storage. For example, such channel encoding may include bandwidth compression. It is also possible to configure such channel encoding to exploit the enhanced separability of the various sources that is provided by the spherical-wavefront model. Various aspects of the techniques described in this disclosure may, in some examples, be performed for a bitstream or file that carries the spherical harmonic coefficients to also include a flag or other indicator whose state indicates whether the spherical harmonic coefficients are of a planar-wavefront-model type or a spherical-wavefront model type. In one example, a file (e.g., a WAV format file) that carries the spherical harmonic coefficients as floating-point values (e.g., 32-bit floating-point values) also includes a metadata portion (e.g., a header) that includes such an indicator and may include other indicators (e.g., a near-field compensation (NFC) flag) and or text values as well.

At a rendering end, a complementary channel-decoding operation may be performed to recover the spherical harmonic coefficients. A rendering operation including task T410 may then be performed to obtain the loudspeaker feeds for the particular loudspeaker array configuration from the SHC. Task T410 may be implemented to determine a matrix that can convert between the set of SHC, e.g., one of encoded PCM streams 84 for an SHC cluster object 82, and a set of K audio signals corresponding to the loudspeaker feeds for the particular array of K loudspeakers to be used to synthesize the sound field.

One possible method to determine this matrix is an operation known as 'mode-matching'. Here, the loudspeaker feeds are computed by assuming that each loudspeaker produces a spherical wave. In such a scenario, the pressure (as a function of frequency) at a certain position r, θ, φ, due to the l-th loudspeaker, is given by $$P_l(\omega,r,\theta,\phi)=g_l(\omega)\Sigma_{n=0}^{\infty}j_n(kr)\Sigma_{m=-n}^{n}(-4\pi ik)h_n^{(2)}(kr_l)\,Y_n^{m*}(\theta_l,\phi_l)\,Y_n^m(\theta,\phi) \quad (4),$$

where $\{r_l,\theta_l,\phi_l\}$ represents the position of the l-th loudspeaker and $g_l(\omega)$ is the loudspeaker feed of the l-th speaker (in the frequency domain). The total pressure $P_t$ due to all L speakers is thus given by $$P_t(\omega, r, \theta, \varphi) = \sum_{l=1}^{L} g_l(\omega)\sum_{n=0}^{\infty} j_n(kr)\sum_{m=-n}^{n}(-4\pi ik)h_n^{(2)}(kr_l)Y_n^{m*}(\theta_l,\varphi_l)Y_n^m(\theta,\varphi) \quad (5)$$

We also know that the total pressure in terms of the SHC is given by the equation $$P_t(\omega,r,\theta,\phi)=4\pi\Sigma_{n=0}^{\infty}j_n(kr)\Sigma_{m=-n}^{n}A_n^m(k)Y_n^m(\theta,\phi) \quad (6)$$

Task T410 may be implemented to render the modeled sound field by solving an expression such as the following to obtain the loudspeaker feeds $g_l(\omega)$:

$$\begin{bmatrix} A_0^0(\omega) \\ A_1^1(\omega) \\ A_1^{-1}(\omega) \\ A_2^2(\omega) \\ A_2^{-2}(\omega) \end{bmatrix} = -ik \begin{bmatrix} h_0^{(2)}(kr_1)Y_0^{0*}(\theta_1, \varphi_1) & h_0^{(2)}(kr_2)Y_0^{0*}(\theta_2, \varphi_2). & \dots & \dots & \dots \\ h_1^{(2)}(kr_1)Y_1^{1*}(\theta_1, \varphi_1). & \dots & \dots & \dots & \dots \\ \dots & \dots & \dots & \dots & \dots \\ \dots & \dots & \dots & \dots & \dots \\ \dots & \dots & \dots & \dots & \dots \end{bmatrix} \begin{bmatrix} g_1(\omega) \\ g_2(\omega) \\ g_3(\omega) \\ g_4(\omega) \\ g_5(\omega) \end{bmatrix} \tag{7}$$

For convenience, this example shows a maximum N of order n equal to two. It is expressly noted that any other maximum order may be used as desired for the particular implementation (e.g., three, four, five, or more).

As demonstrated by the conjugates in expression (7), the spherical basis functions $Y_n^m$ are complex-valued functions. However, it is also possible to implement tasks X50, T630, and T410 to use a real-valued set of spherical basis functions instead.

In one example, the SHC are calculated (e.g., by task X50 or T630) as time-domain coefficients, or transformed into time-domain coefficients before transmission (e.g., by task T640). In such case, task T410 may be implemented to transform the time-domain coefficients into frequency-domain coefficients $A_n^m(\omega)$ before rendering.

Traditional methods of SHC-based coding (e.g., higher-order Ambisonics or HOA) typically use a plane-wave approximation to model the sound field to be encoded. Such an approximation assumes that the sources which give rise to the sound field are sufficiently distant from the observation location that each incoming signal may be modeled as a planar wavefront arriving from the corresponding source direction. In this case, the sound field is modeled as a superposition of planar wavefronts.

Although such a plane-wave approximation may be less complex than a model of the sound field as a superposition of spherical wavefronts, it lacks information regarding the distance of each source from the observation location, and it may be expected that separability with respect to distance of the various sources in the sound field as modeled and/or synthesized will be poor. Accordingly, a coding approach that models the sound field as a superposition of spherical wavefronts may be instead.

Figure 18B:
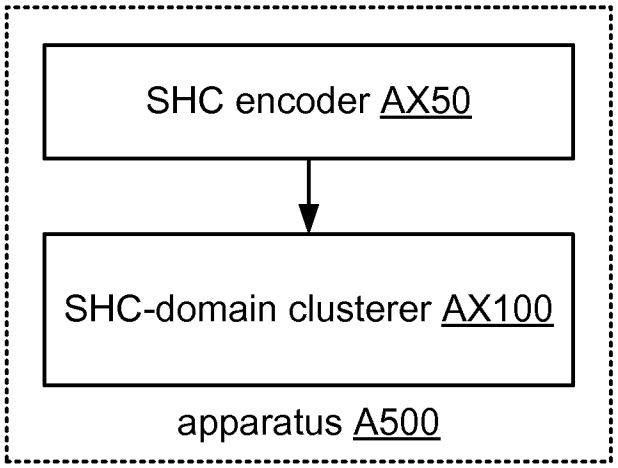
FIG. 18B shows a block diagram of an apparatus A500 according to a general configuration.
Figure 18A:
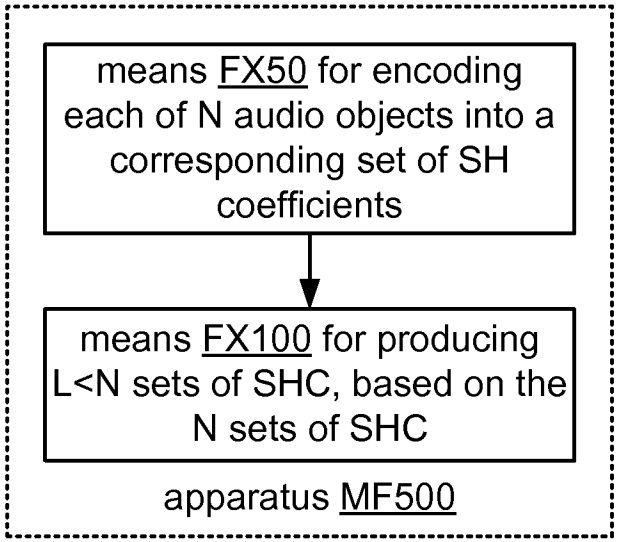
FIG. 18A shows a block diagram of an apparatus MF500 according to a general configuration.

FIG. 18A shows a block diagram of an apparatus MF500 for audio signal processing according to a general configuration. Apparatus MF500 includes means FX50 for encoding each of N audio objects into a corresponding set of SH coefficients (e.g., as described herein with reference to task X50). Apparatus MF500 also includes means FX100 for producing L sets of SHC cluster objects 82A-82L, based on the N sets of SHC objects 80A-80N (e.g., as described herein with reference to task X100). FIG. 18B shows a block diagram of an apparatus A500 for audio signal processing according to a general configuration. Apparatus A500 includes an SHC encoder AX50 configured to encode each of N audio objects into a corresponding set of SH coefficients (e.g., as described herein with reference to task X50). Apparatus A500 also includes an SHC-domain clusterer AX100 configured to produce L sets of SHC cluster objects 82A-82L, based on the N sets of SHC objects 80A-80N (e.g., as described herein with reference to task X100). In one example, clusterer AX100 includes a vector adder configured to add the component SHC coefficient vectors for a cluster to produce a single SHC coefficient vector for the cluster.

Figure 25A:
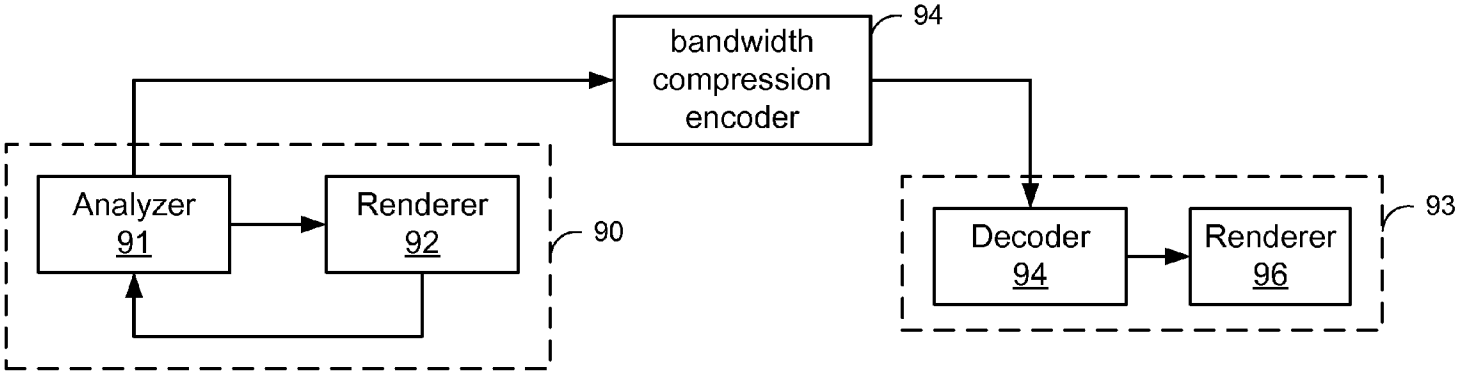
FIGS. 25A and 25B show schematic diagrams of coding systems that include a renderer local to the analyzer.
Figure 25B:
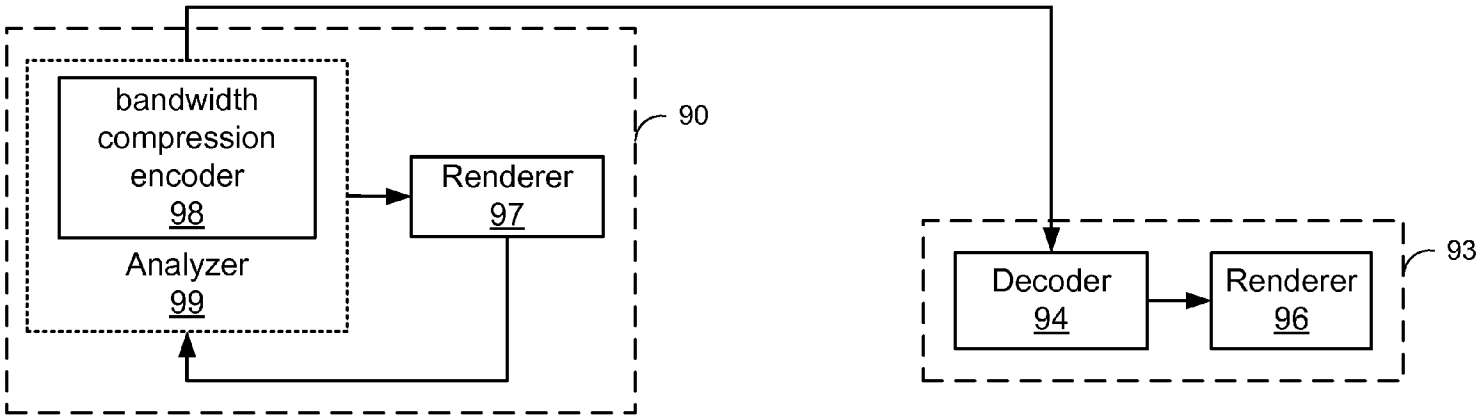

It may be desirable to perform a local rendering of the grouped objects, and to use information obtained via the local rendering to adjust the grouping. FIG. 25A shows a schematic diagram of such a coding system 90 that includes a renderer 92 local to the analyzer 91 (e.g., local to an implementation of apparatus A100 or MF100). Such an arrangement, which may be called "cluster analysis by synthesis" or simply "analysis by synthesis," may be used for optimization of the cluster analysis. As described herein, such a system may also include a feedback channel that provides information from the far-end renderer 96 about the rendering environment, such as number of loudspeakers, loudspeaker positions, and/or room response (e.g., reverberation), to the renderer 92 that is local to the analyzer 91.

Additionally or alternatively, in some cases a coding system 90 uses information obtained via a local rendering to adjust the bandwidth compression encoding (e.g., the channel encoding). FIG. 23B shows a schematic diagram of such a coding system 90 that includes a renderer 97 local to the analyzer 99 (e.g., local to an implementation of apparatus A100 or MF100) in which the compression bandwidth encoder 98 is part of the analyzer. Such an arrangement may be used for optimization of the bandwidth encoding (e.g., with respect to effects of quantization).

Figure 26A:
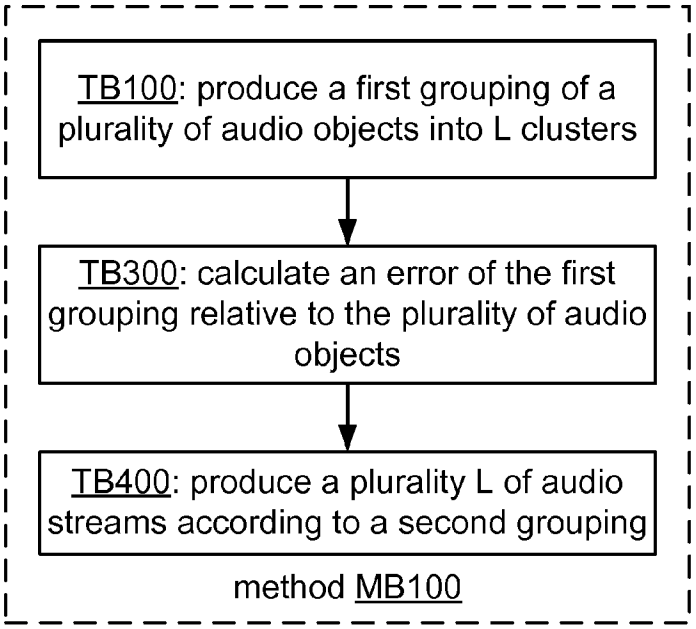
FIG. 26A shows a flowchart of a method MB100 of audio signal processing according to a general configuration.
Figure 26B:
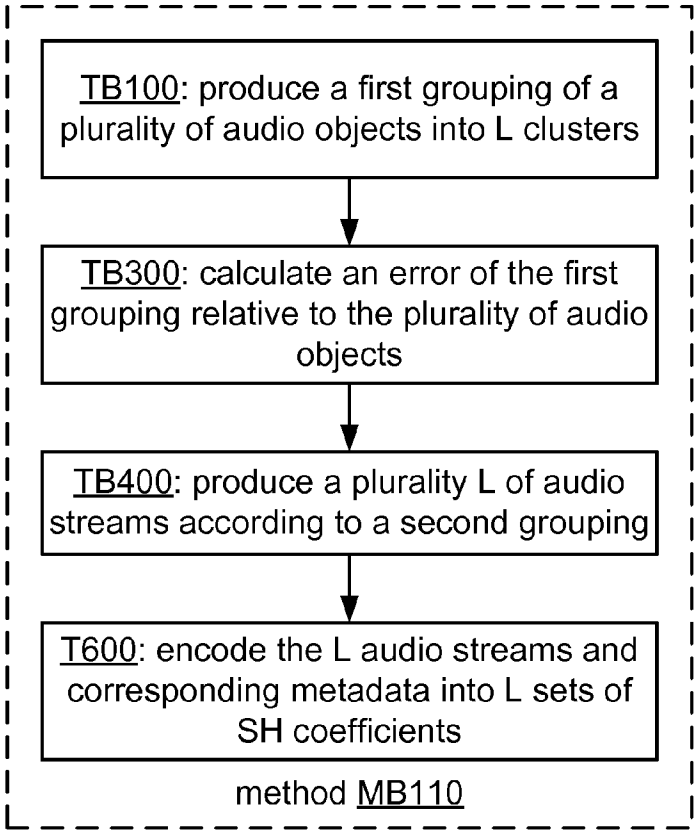
FIG. 26B shows a flowchart of an implementation MB110 of method MB100.

FIG. 26A shows a flowchart of a method MB100 of audio signal processing according to a general configuration that includes tasks TB100, TB300, and TB400. Based on a plurality of audio objects 12, task TB100 produces a first grouping of the plurality of audio objects into L clusters 32. Task TB100 may be implemented as an instance of task T100 as described herein. Task TB300 calculates an error of the first grouping relative to said plurality of audio objects 12. Based on the calculated error, task TB400 produces a plurality L of audio streams 36 according to a second grouping of the plurality of audio objects 12 into L clusters 32 that is different from the first grouping. FIG. 26B shows a flowchart of an implementation MB110 of method MB100 which includes an instance of task T600 that encodes the L audio streams 32 and corresponding spatial information into L sets of SHC 74.

Figure 27B:
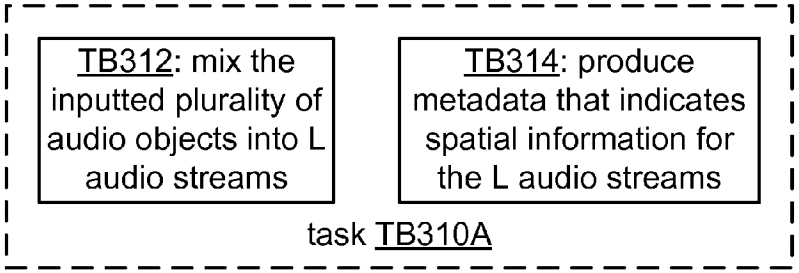
FIG. 27B shows a flowchart of an implementation TB310A of task TB310.
Figure 27C:
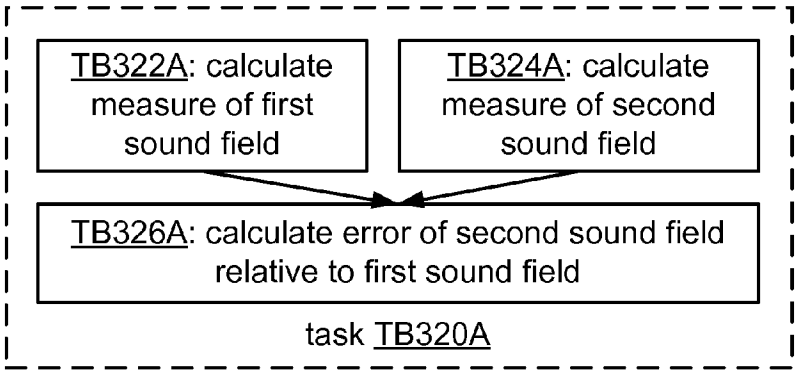
FIG. 27C shows a flowchart of an implementation TB320A of task TB320.
Figure 27A:
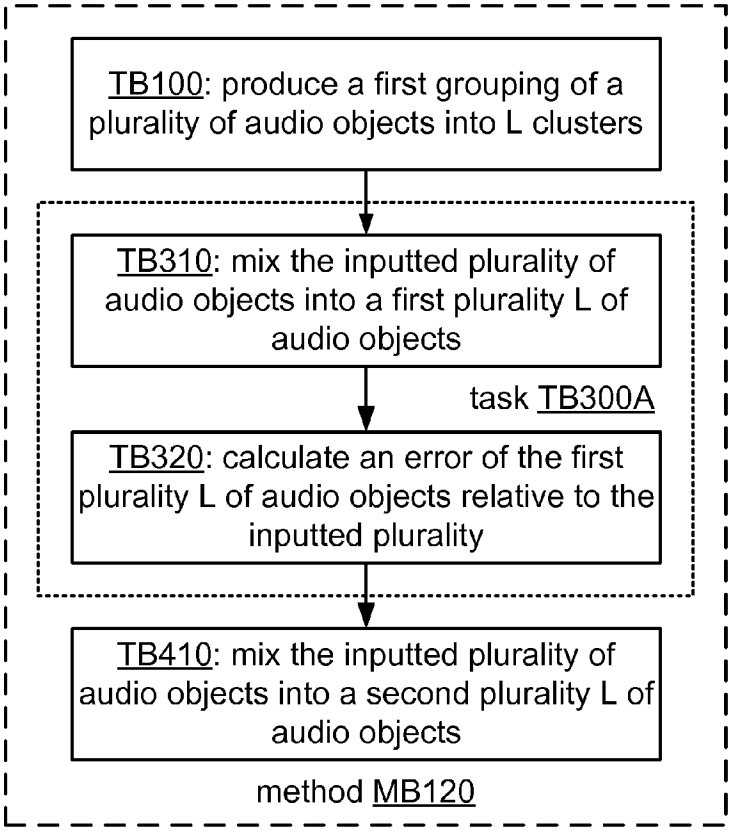
FIG. 27A shows a flowchart of an implementation MB120 of method MB100.

FIG. 27A shows a flowchart of an implementation MB120 of method MB100 that includes an implementation TB300A of task TB300. Task TB300A includes a subtask TB310 that mixes the inputted plurality of audio objects 12 into a first plurality L of audio objects 32. FIG. 27B shows a flowchart of an implementation TB310A of task TB310 that includes subtasks TB312 and TB314. Task TB312 mixes the inputted plurality of audio objects 12 into L audio streams 36. Task TB312 may be implemented, for example, as an instance of task T200 as described herein. Task TB314 produces metadata 30 that indicates spatial information for the L audio streams 36. Task TB314 may be implemented, for example, as an instance of task T300 as described herein.

As noted above, a task or system according to techniques herein may evaluate the cluster grouping locally. Task TB300A includes a task TB320 that calculates an error of the first plurality L of audio objects 32 relative to the inputted plurality. Task TB320 may be implemented to calculating an error of the synthesized field (i.e., as described by the grouped audio objects 32) relative to the field being encoded (i.e., as described by the original audio objects 12).

FIG. 27C shows a flowchart of an implementation TB320A of task TB320 that includes subtasks TB322A, TB324A, and TB326A. Task TB322A calculates a measure of a first sound field that is described by the inputted plurality of audio objects 32. Task TB324A calculates a measure of a second sound field that is described by the first plurality L of audio objects 32. Task TB326A calculates an error of the second sound field relative to the first sound field.

Figure 28:
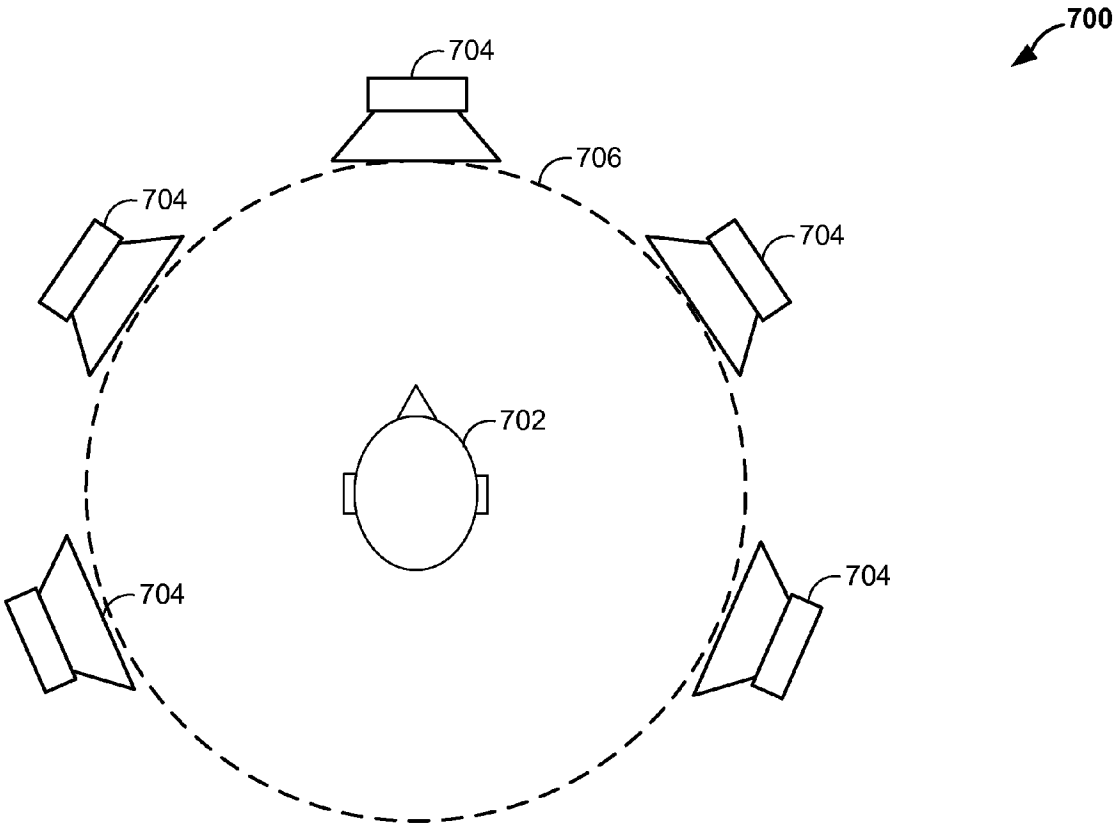
FIG. 28 shows a top view of an example of a reference loudspeaker array configuration.

In one example, tasks TB322A and TB324A are implemented to render the original set of audio objects 12 and the set of clustered objects 32, respectively, according to a reference loudspeaker array configuration. FIG. 28 shows a top view of an example of such a reference configuration 700, in which the position of each loudspeaker 704 may be defined as a radius relative to the origin and an angle (for 2D) or angle and azimuth (for 3D) relative to a reference direction (e.g., in the direction of the gaze of hypothetical user 702). In the non-limiting example shown in FIG. 28, all of the loudspeakers 704 are at the same distance from the origin, which distance may be defined as a radius of a sphere 706.

In some cases, the number of loudspeakers 704 at the renderer and possibly also their positions may be known, such that the local rendering operations (e.g., tasks TB322A and TB324A) may be configured accordingly. In one example, information from the far-end renderer 96, such as number of loudspeakers 704, loudspeaker positions, and/or room response (e.g., reverberation), is provided via a feedback channel as described herein. In another example, the loudspeaker array configuration at the renderer 96 is a known system parameter (e.g., a 5.1, 7.1, 10.2, 11.1, or 22.2 format), such that the number of loudspeakers 704 in the reference array and their positions are predetermined.

Figure 29A:
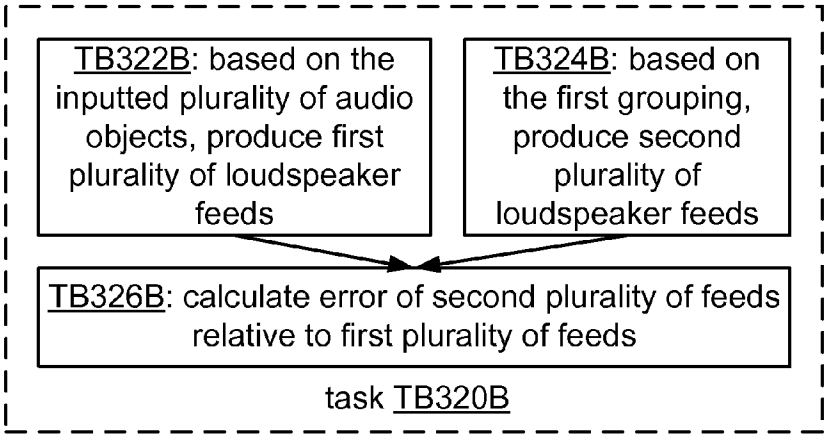
FIG. 29A shows a flowchart of an implementation TB320B of task TB320.

FIG. 29A shows a flowchart of an implementation TB320B of task TB320 that includes subtasks TB322B, TB324B, and TB326B. Based on the inputted plurality of clustered audio objects 32, task TB322B produces a first plurality of loudspeaker feeds. Based on the first grouping, task T324B produces a second plurality of loudspeaker feeds. Task TB326B calculates an error of the second plurality of loudspeaker feeds relative to the first plurality of loudspeaker feeds.

The local rendering (e.g., tasks TB322A/B and TB324A/B) and/or error calculation (e.g., task TB326A/B) may be done in the time domain (e.g., per frame) or in a frequency domain (e.g., per frequency bin or subband) and may include perceptual weighting and/or masking. In one example, task TB326A/B is configured to calculate the error as a signal-to-noise ratio (SNR), which may be perceptually weighted (e.g., the ratio of the energy sum of the perceptually weighted feeds due to the original objects, to the perceptually weighted differences between the energy sum of the feeds due to the original objects and energy sum of the feeds according to the grouping being evaluated).

Method MB120 also includes an implementation TB410 of task TB400 that mixes the inputted plurality of audio objects into a second plurality L of audio objects 32, based on the calculated error.

Method MB100 may be implemented to perform task TB400 based on a result of an open-loop analysis or a closed-loop analysis. In one example of an open-loop analysis, task TB100 is implemented to produce at least two different candidate groupings of the plurality of audio objects 12 into L clusters, and task TB300 is implemented to calculate an error for each candidate grouping relative to the original objects 12. In this case, task TB300 is implemented to indicate which candidate grouping produces the lesser error, and task TB400 is implemented to produce the plurality L of audio streams 36 according to that selected candidate grouping.

Figure 29B:
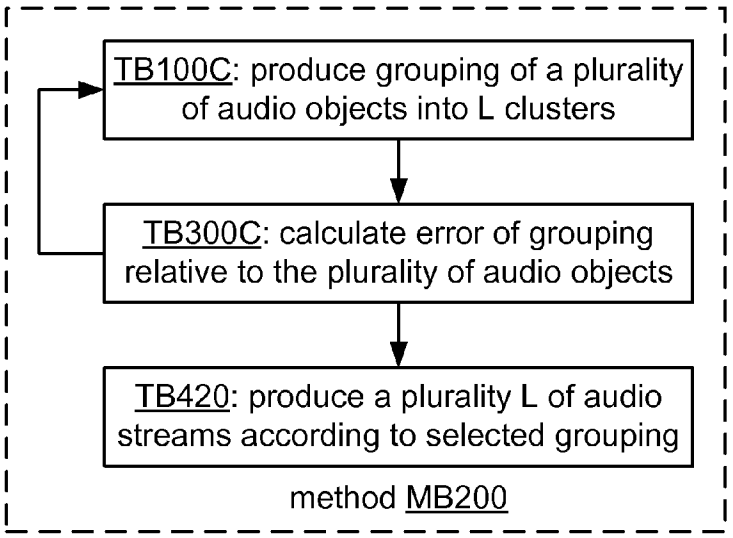
FIG. 29B shows an example of an implementation MB200 of method MB100.
Figure 29C:
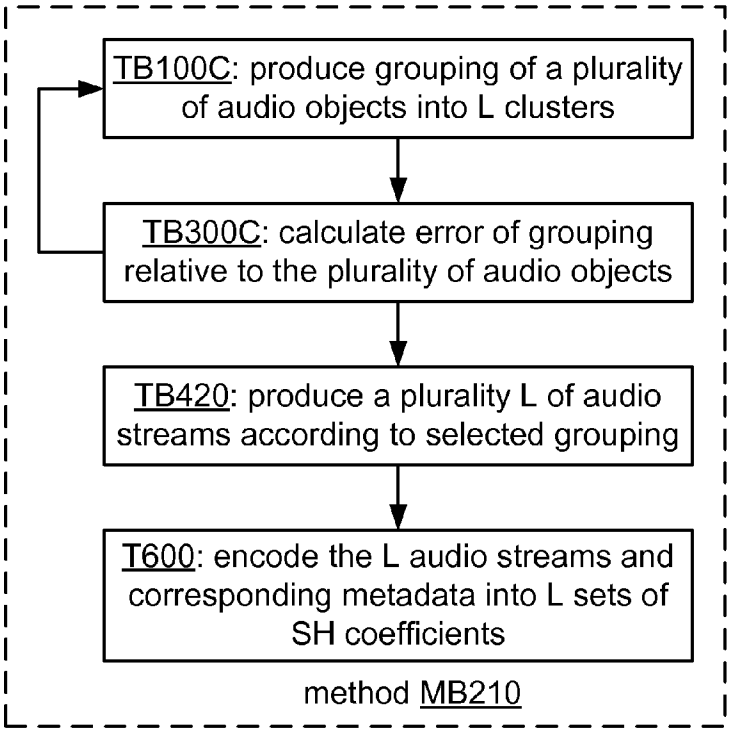
FIG. 29C shows a flowchart of an implementation MB210 of method MB200.

FIG. 29B shows an example of an implementation MB200 of method MB100 that performs a closed-loop analysis. Method MB200 includes a task TB100C that performs multiple instances of task TB100 to produce different respective groupings of the plurality of audio objects 12. Method MB200 also includes a task TB300C that performs an instance of error calculation task TB300 (e.g., task TB300A) on each grouping. As shown in FIG. 27B, task TB300C may be arranged to provide feedback to task TB100C that indicates whether the error satisfies a predetermined condition (e.g., whether the error is below (alternatively, not greater than) a threshold value). For example, task TB300C may be implemented to cause task TB100C to produce additional different groupings until the error condition is satisfied (or until an end condition, such as a maximum number of groupings, is satisfied).

Task TB420 is an implementation of task TB400 that produces a plurality L of audio streams 36 according to the selected grouping. FIG. 27C shows a flowchart of an implementation MB210 of method MB200 which includes an instance of task T600.

As an alternative to an error analysis with respect to a reference loudspeaker array configuration, it may be desirable to configure task TB320 to calculate the error based on differences between the rendered fields at discrete points in space. In one example of such a spatial sampling approach, a region of space, or a boundary of such a region, is selected to define a desired sweet spot (e.g., an expected listening area). In one example, the boundary is a sphere (e.g., the upper hemisphere) around the origin (e.g., as defined by a radius).

In this approach, the desired region or boundary is sampled according to a desired pattern. In one example, the spatial samples are uniformly distributed (e.g., around the sphere, or around the upper hemisphere). In another example, the spatial samples are distributed according to one or more perceptual criteria. For example, the samples may be distributed according to localizability to a user facing forward, such that samples of the space in front of the user are more closely spaced than samples of the space at the sides of the user.

Figure 30:
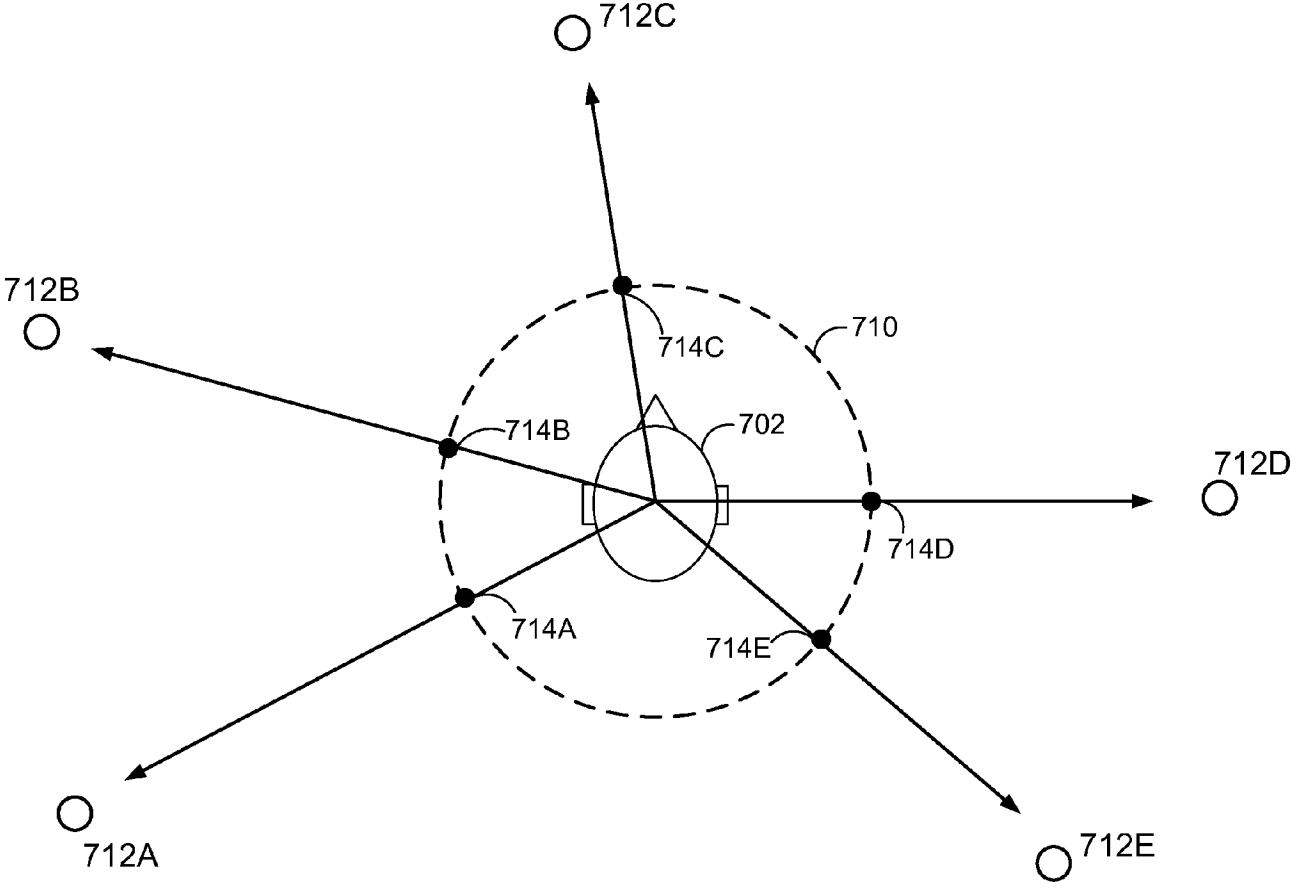
FIGS. 30-32 show top views of an example of source-position-dependent spatial sampling.

In a further example, spatial samples are defined by the intersections of the desired boundary with a line, for each original source, from the origin to the source. FIG. 30 shows a top view of such an example in which the five original audio objects 712A-712E (collectively, "audio objects 712") are located outside the desired boundary 710 (indicated by the dashed circle, and the corresponding spatial samples are indicated by points 714A-714E (collectively, "sample points 714").

Figure 31:
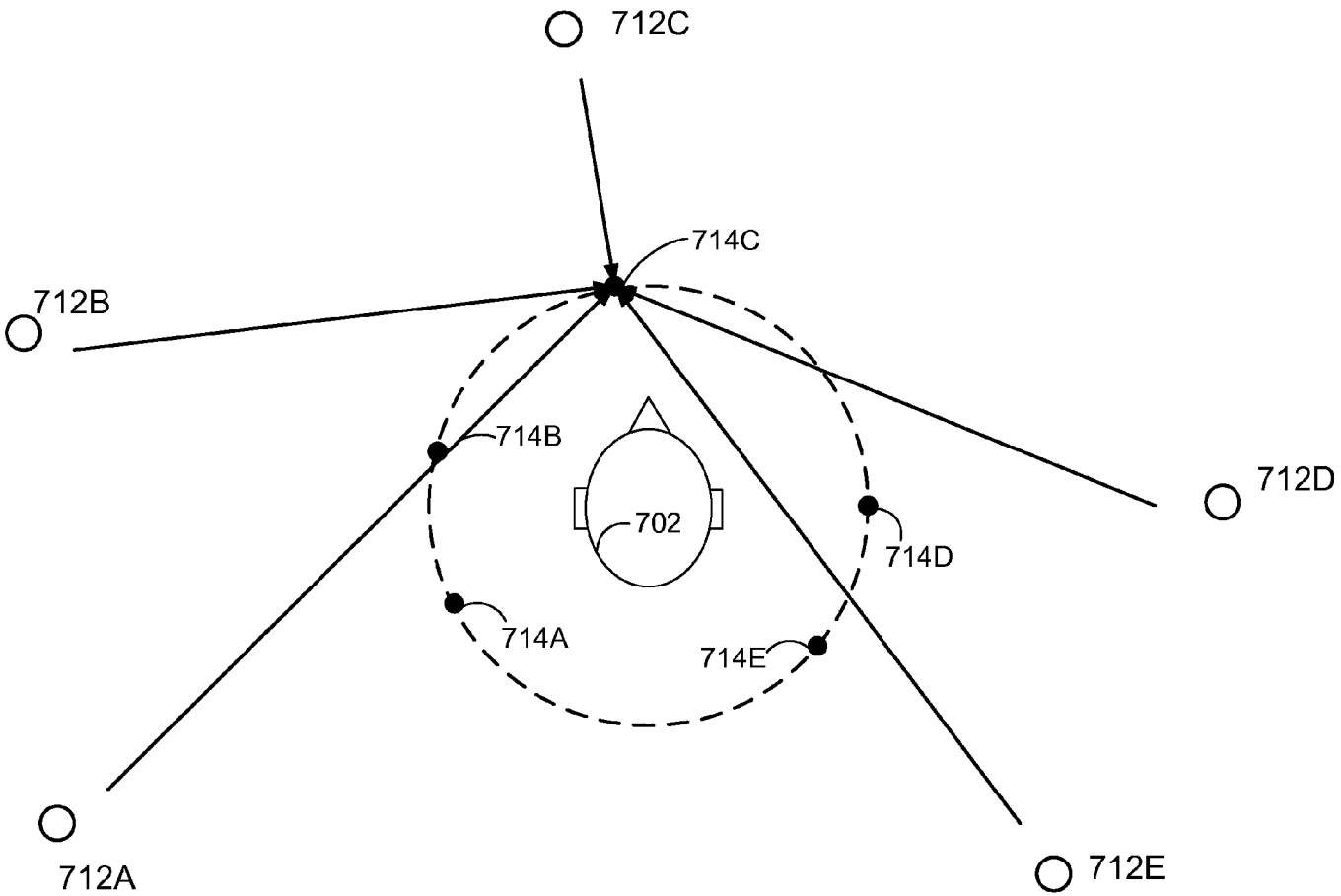

In this case, task TB322A may be implemented to calculate a measure of the first sound field at each sample point 714 by, e.g., calculating a sum of the estimated sound pressures due to each of the original audio objects 712 at the sample point. FIG. 31 illustrates such an operation. For spatial objects 712 that represent PCM objects, the corresponding spatial information may include gain and location, or relative gain (e.g., with respect to a reference gain level) and direction. Such spatial information may also include other aspects, such as directivity and/or diffusivity. For SHC objects, task TB322A may be implemented to calculate the modeled field according to a planar-wavefront model or a spherical-wavefront model as described herein.

Figure 32:
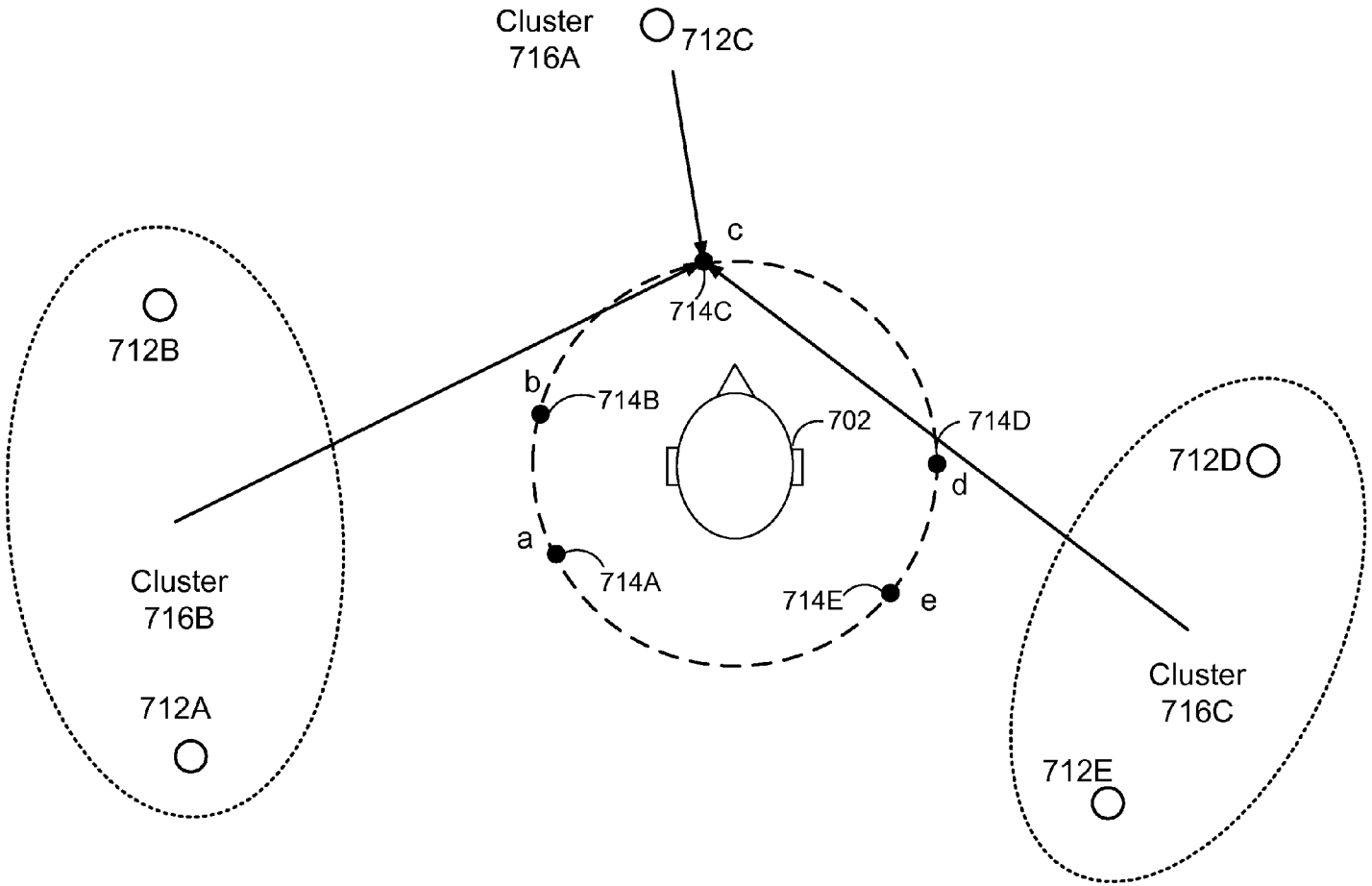

In the same manner, task TB324A may be implemented to calculate a measure of the second sound field at each sample point 714 by, e.g., calculating a sum of the estimated sound pressures due to each of the clustered objects at the sample point 714. FIG. 32 illustrates such an operation for the clustering example as indicated. Task TB326A may be implemented to calculate the error of the second sound field relative to the first sound field at each sample point 714 by, e.g., calculating an SNR (for example, a perceptually weighted SNR) at the sample point 714. It may be desirable to implement task TB326A to normalize the error at each spatial sample (and possibly for each frequency) by the pressure (e.g., gain or energy) of the first sound field at the origin.

A spatial sampling as described above (e.g., with respect to a desired sweet spot) may also be used to determine, for each of at least one of the audio objects 712, whether to include the object 712 among the objects to be clustered. For example, it may be desirable to consider whether the object 712 is individually discernible within the total original sound field at the sample points 714. Such a determination may be performed (e.g., within task TB100, TB100C, or TB500) by calculating, for each sample point, the pressure due to the individual object 712 at that sample point 714; and comparing each such pressure to a corresponding threshold value that is based on the pressure due to the collective set of objects 712 at that sample point 714.

In one such example, the threshold value at sample point i is calculated as $\alpha \times P_{tot.i}$, where $P_{tot.i}$ is the total sound field pressure at the point and $\alpha$ is a factor having a value less than one (e.g., 0.5, 0.6, 0.7, 0.75, 0.8, or 0.9). The value of $\alpha$, which may differ for different objects 712 and/or for different sample points 714 (e.g., according to expected aural acuity in the corresponding direction), may be based on the number of objects 712 and/or the value of $P_{tot.i}$ (e.g., a higher threshold for low values of $P_{tot.i}$). In this case, it may be decided to exclude the object 712 from the set of objects 712 to be clustered (i.e., to encode the object 712 individually) if the individual pressure exceeds (alternatively, is not less than) the corresponding threshold value for at least a predetermined proportion (e.g., half) of the sample points 714 (alternatively, for not less than the predetermined proportion of the sample points).

In another example, the sum of the pressures due to the individual object 712 at the sample points 714 is compared to a threshold value that is based on the sum of the pressures due to the collective set of objects 712 at the sample points 714. In one such example, the threshold value is calculated as $\alpha \times P_{tot}$, where $P_{tot}=\Sigma_i P_{tot.i}$ is the sum of the total sound field pressures at the sample points 714 and factor $\alpha$ is as described above.

Figure 33A:
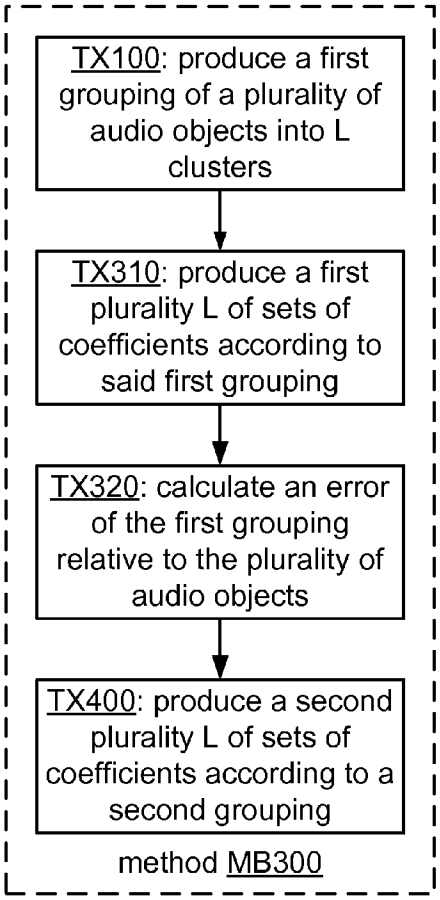
FIG. 33A shows a flowchart of a method MB300 of audio signal processing according to a general configuration.

It may be desirable to perform the cluster analysis and/or the error analysis in a hierarchical basis function domain (e.g., a spherical harmonic basis function domain as described herein) rather than the PCM domain. FIG. 33A shows a flowchart of such an implementation MB300 of method MB100 that includes tasks TX100, TX310, TX320, and TX400. Task TX100, which produces a first grouping of a plurality of audio objects 12 into L clusters 32, may be implemented as an instance of task TB100, TB100C, or TB500 as described herein. Task TX100 may also be implemented as an instance of such a task that is configured to operate on objects that are sets of coefficients (e.g., sets of SHC) such as SHC objects 80A-80N. Task TX310, which produces a first plurality L of sets of coefficients, e.g., SHC cluster objects 82A-82L, according to said first grouping, may be implemented as an instance of task TB310 as described herein. For a case in which the objects 12 are not yet in the form of sets of coefficients, task TX310 may also be implemented to perform such encoding (e.g., to perform an instance of task X120 for each cluster to produce the corresponding set of coefficients, e.g., SHC objects 80A-80N or "coefficients 80"). Task TX320, which calculates an error of the first grouping relative to the plurality of audio objects 12, may be implemented as an instance of task TB320 as described herein that is configured to operate on sets of coefficients, e.g., SHC cluster objects 82A-82L. Task TX400, which produces a second plurality L of sets of coefficients, e.g., SHC cluster objects 82A-82L, according to a second grouping, may be implemented as an instance of task TB400 as described herein that is configured to operate on sets of coefficients (e.g., sets of SHC).

Figure 33B:
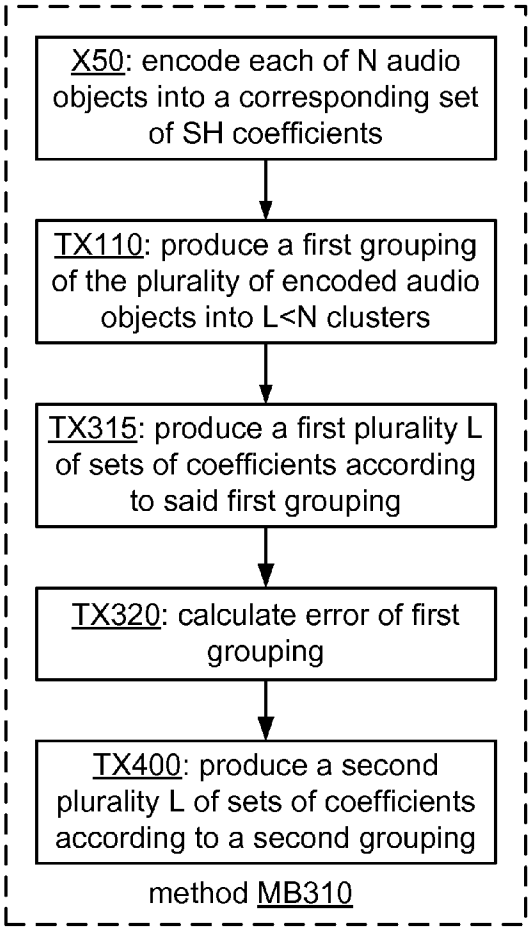
FIG. 33B shows a flowchart of an implementation MB310 of method MB300.
Figure 33C:
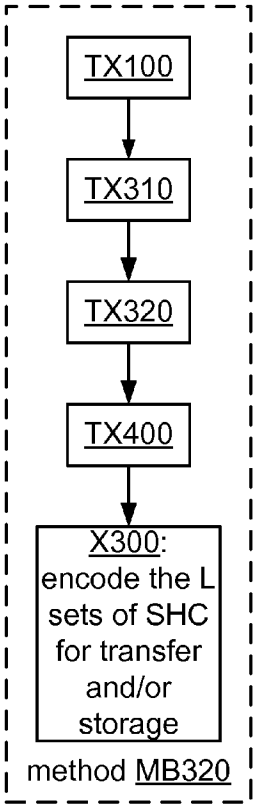
FIG. 33C shows a flowchart of an implementation MB320 of method MB300.
Figure 33D:
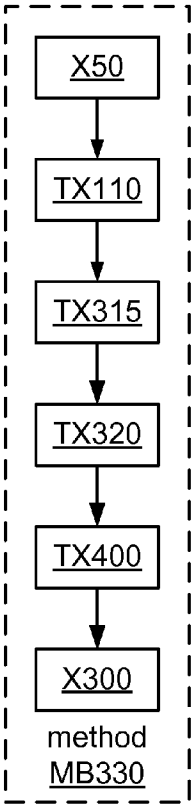
FIG. 33D shows a flowchart of an implementation MB330 of method MB310.

FIG. 33B shows a flowchart of an implementation MB310 of method MB100 that includes an instance of SHC encoding task X50 as described herein. In this case, an implementation TX110 of task TX100 is configured to operate on the SHC objects 80, and an implementation TX315 of task TX310 is configured to operate on SHC objects 82 input. FIGS. 33C and 33D show flowcharts of implementations MB320 and MB330 of methods MB300 and MB310, respectively, that include instances of encoding (e.g., bandwidth compression or channel encoding) task X300.

Figure 34B:
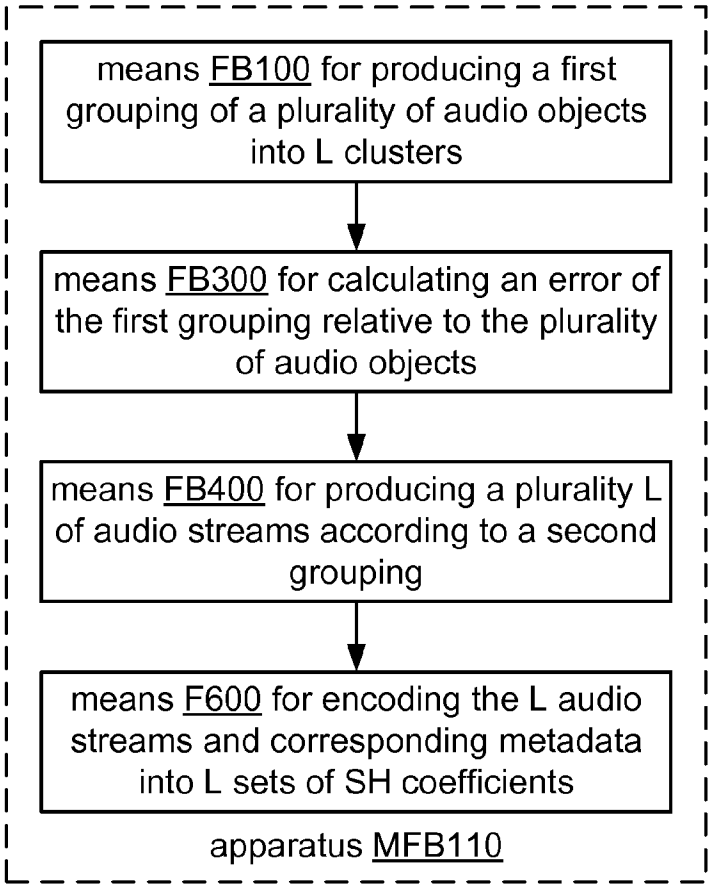
FIG. 34B shows a block diagram of an implementation MFB110 of apparatus MFB100.
Figure 34A:
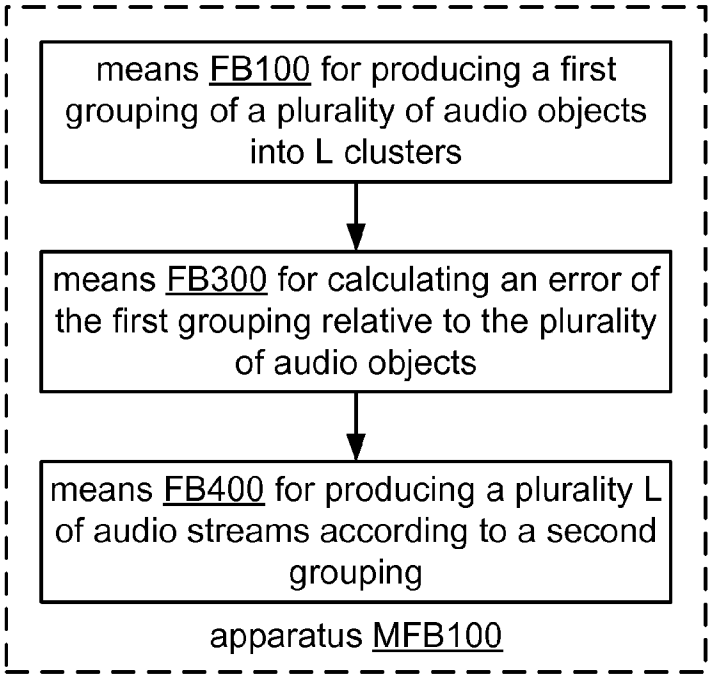
FIG. 34A shows a block diagram of an apparatus MFB 100 according to a general configuration.

FIG. 34A shows a block diagram of an apparatus MFB100 for audio signal processing according to a general configuration. Apparatus MFB 100 includes means FB100 for producing a first grouping of a plurality of audio objects 12 into L clusters (e.g., as described herein with reference to task TB100). Apparatus MFB100 also includes means FB300 for calculating an error of the first grouping relative to the plurality of audio objects 12 (e.g., as described herein with reference to task TB300). Apparatus MFB100 also includes means FB400 for producing a plurality L of audio streams 32 according to a second grouping (e.g., as described herein with reference to task TB400). FIG. 34B shows a block diagram of an implementation MFB110 of apparatus MFB100 that includes means F600 for encoding the L audio streams 32 and corresponding metadata 34 into L sets of SH coefficients 74A-74L (e.g., as described herein with reference to task T600).

Figure 35A:
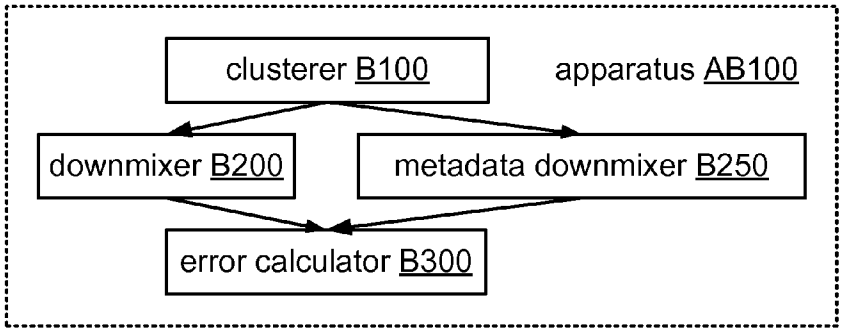
FIG. 35A shows a block diagram of an apparatus AB100 for audio signal processing according to a general configuration.
Figure 35B:
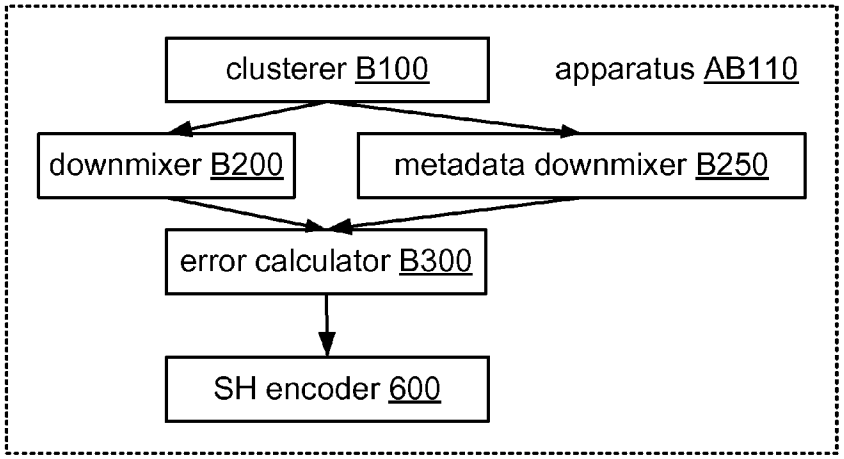
FIG. 35B shows a block diagram of an implementation AB110 of apparatus AB100.

FIG. 35A shows a block diagram of an apparatus AB100 for audio signal processing according to a general configuration that includes a clusterer B100, a downmixer B200, a metadata downmixer B250, and an error calculator B300. Clusterer B100 may be implemented as an instance of clusterer 100 that is configured to perform an implementation of task TB100 as described herein. Downmixer B200 may be implemented as an instance of downmixer 200 that is configured to perform an implementation of task TB400 (e.g., task TB410) as described herein. Metadata downmixer B250 may be implemented as an instance of metadata downmixer 300 as described herein. Collectively, downmixer B200 and metadata downmixer B250 may be implemented to perform an instance of task TB310 as described herein. Error calculator B300 may be implemented to perform an implementation of task TB300 or TB320 as described herein. FIG. 35B shows a block diagram of an implementation AB110 of apparatus AB100 that includes an instance of SH encoder 600.

Figure 36B:
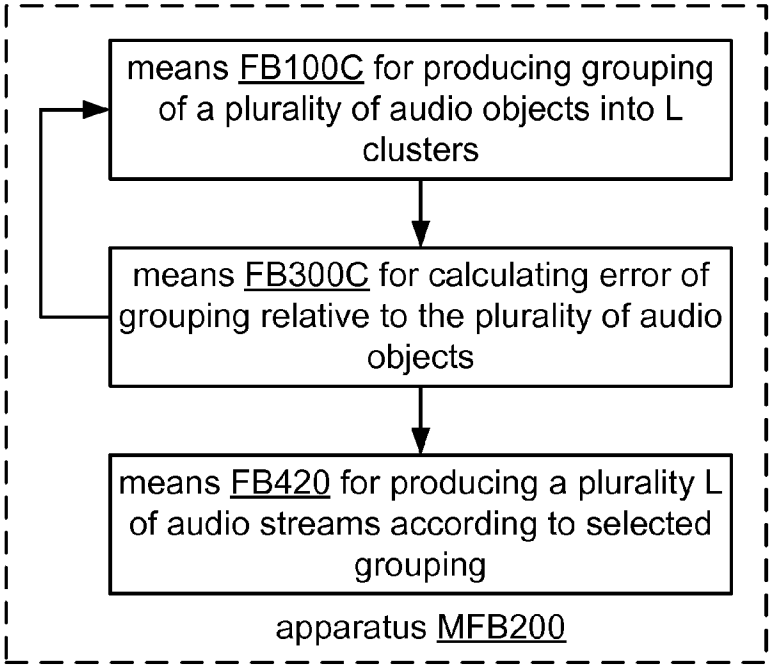
FIG. 36B shows a block diagram of an apparatus MFB200 for audio signal processing according to a general configuration.
Figure 36A:
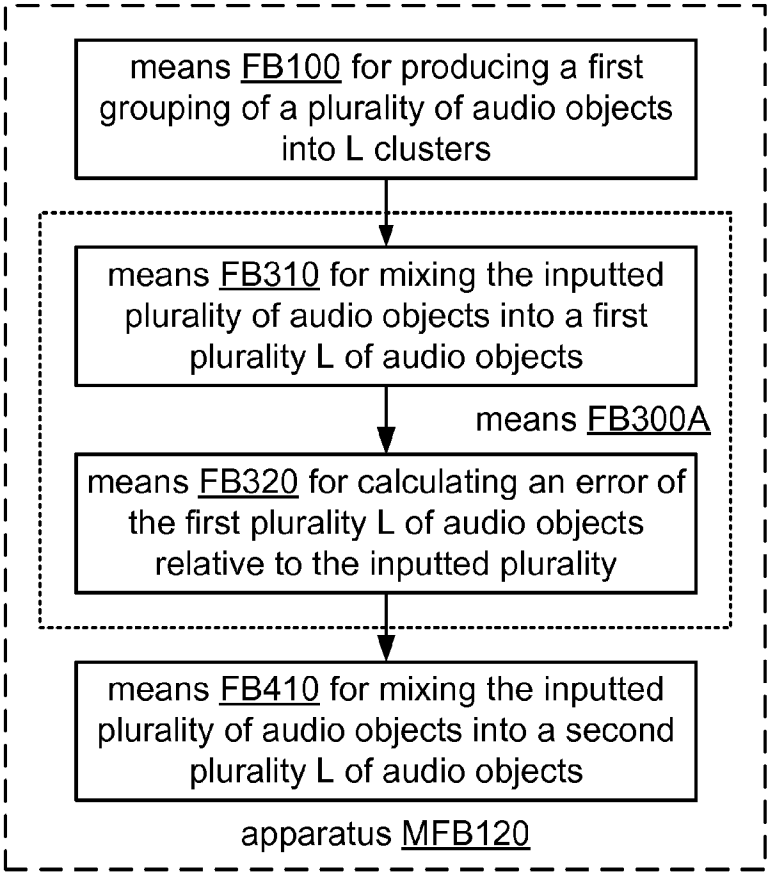
FIG. 36A shows a block diagram of an implementation MFB120 of apparatus MFB100.

FIG. 36A shows a block diagram of an implementation MFB120 of apparatus MFB100 that includes an implementation FB300A of means FB300. Means FB300A includes means FB310 for mixing the inputted plurality of audio objects 12 into a first plurality L of audio objects (e.g., as described herein with reference to task B310). Means FB300A also includes means FB320 for calculating an error of the first plurality L of audio objects relative to the inputted plurality (e.g., as described herein with reference to task B320). Apparatus MFB 120 also includes an implementation FB410 of means FB400 for mixing the inputted plurality of audio objects into a second plurality L of audio objects (e.g., as described herein with reference to task B410).

FIG. 36B shows a block diagram of an apparatus MFB200 for audio signal processing according to a general configuration. Apparatus MFB200 includes means FB100C for producing groupings of a plurality of audio objects 12 into L clusters (e.g., as described herein with reference to task B100C). Apparatus MFB200 also includes means FB300C for calculating an error of each grouping relative to the plurality of audio objects (e.g., as described herein with reference to task B300C). Apparatus MFB200 also includes means FB420 for producing a plurality L of audio streams 36 according to a selected grouping (e.g., as described herein with reference to task B420). FIG. 37C shows a block diagram of an implementation MFB210 of apparatus MFB200 that includes an instance of means F600.

Figure 37A:
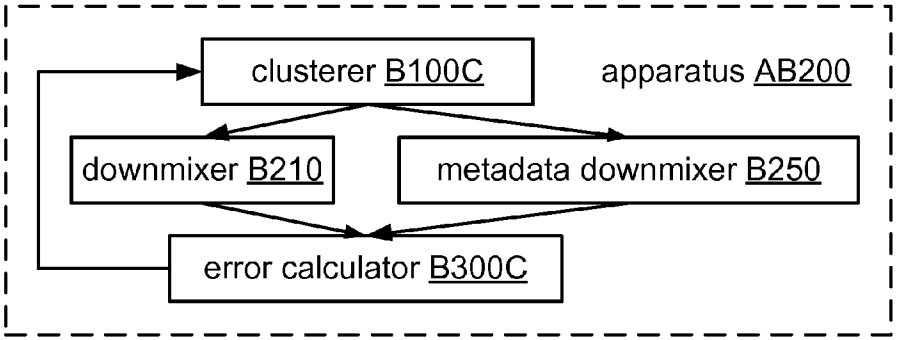
FIG. 37A shows a block diagram of an apparatus AB200 for audio signal processing according to a general configuration.
Figure 37B:
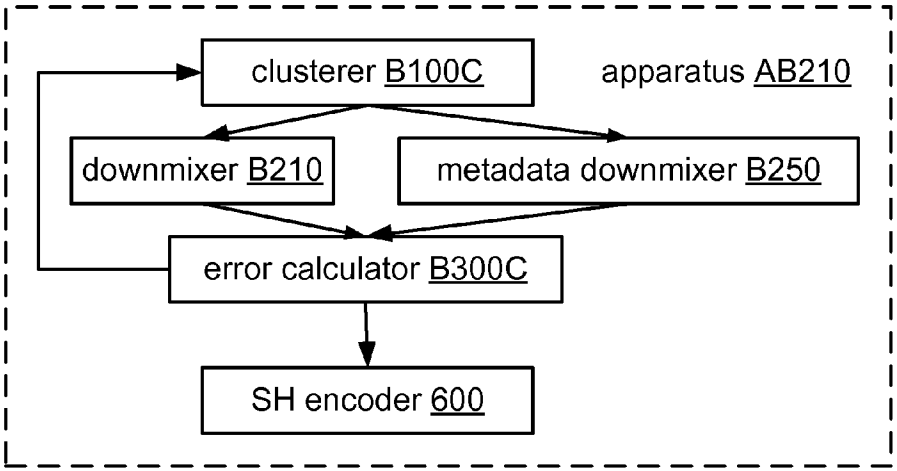
FIG. 37B shows a block diagram of an implementation AB210 of apparatus AB200.
Figure 37C:
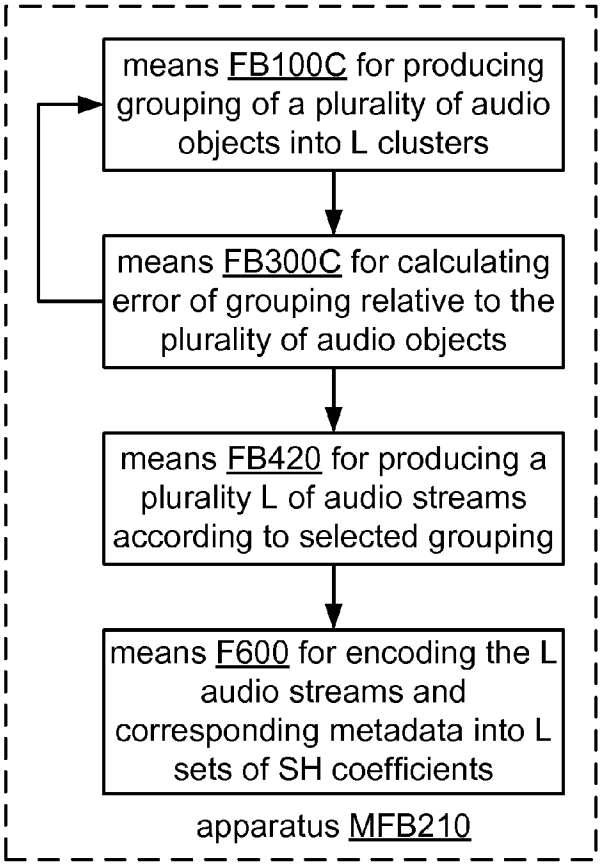
FIG. 37C shows a block diagram of an implementation MFB210 of apparatus MFB200.

FIG. 37A shows a block diagram of an apparatus AB200 for audio signal processing according to a general configuration that includes a clusterer B100C, a downmixer B210, metadata downmixer B250, and an error calculator B300C. Clusterer B100C may be implemented as an instance of clusterer 100 that is configured to perform an implementation of task TB100C as described herein. Downmixer B210 may be implemented as an instance of downmixer 200 that is configured to perform an implementation of task TB420 as described herein. Error calculator B300C may be implemented to perform an implementation of task TB300C as described herein. FIG. 37B shows a block diagram of an implementation AB210 of apparatus AB200 that includes an instance of SH encoder 600.

Figure 38B:
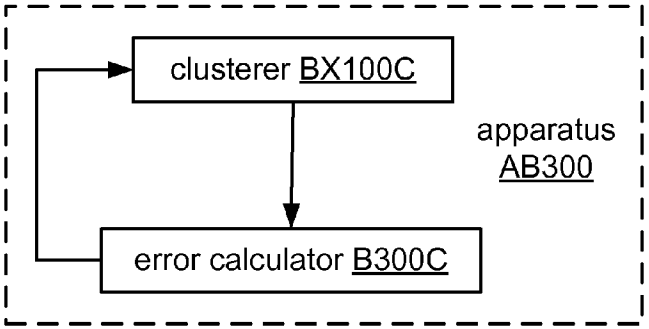
FIG. 38B shows a block diagram of an apparatus AB300 for audio signal processing according to a general configuration.
Figure 38A:
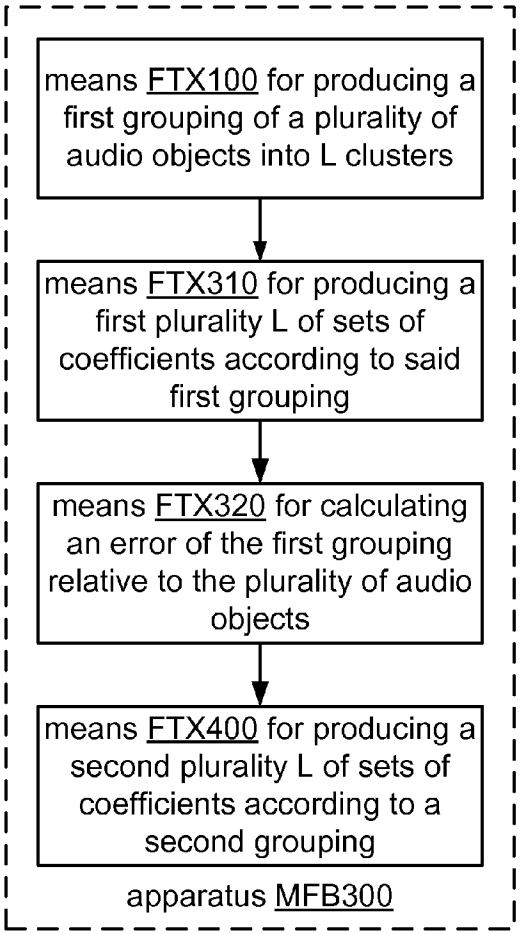
FIG. 38A shows a block diagram of an apparatus MFB300 for audio signal processing according to a general configuration.

FIG. 38A shows a block diagram of an apparatus MFB300 for audio signal processing according to a general configuration. Apparatus MFB300 includes means FTX100 for producing a first grouping of a plurality of audio objects 12 (or SHC objects 80) into L clusters (e.g., as described herein with reference to task TX100 or TX110). Apparatus MFB300 also includes means FTX310 for producing a first plurality L of sets of coefficients 82A-82L according to said first grouping (e.g., as described herein with reference to task TX310 or TX315). Apparatus MFB300 also includes means FTX320 for calculating an error of the first grouping relative to the plurality of audio objects 12 (or SHC objects 80) (e.g., as described herein with reference to task TX320). Apparatus MFB300 also includes means FTX400 for producing a second plurality L of sets of coefficients 82A-82L according to a second grouping (e.g., as described herein with reference to task TX400).

FIG. 38B shows a block diagram of an apparatus AB300 for audio signal processing according to a general configuration that includes a clusterer BX100 and an error calculator BX300. Clusterer BX100 is an implementation of SHC-domain clusterer AX100 that is configured to perform tasks TX100, TX310, and TX400 as described herein. Error calculator B300C is an implementation of error calculator B300 that is configured to perform task TX320 as described herein.

Figure 39:
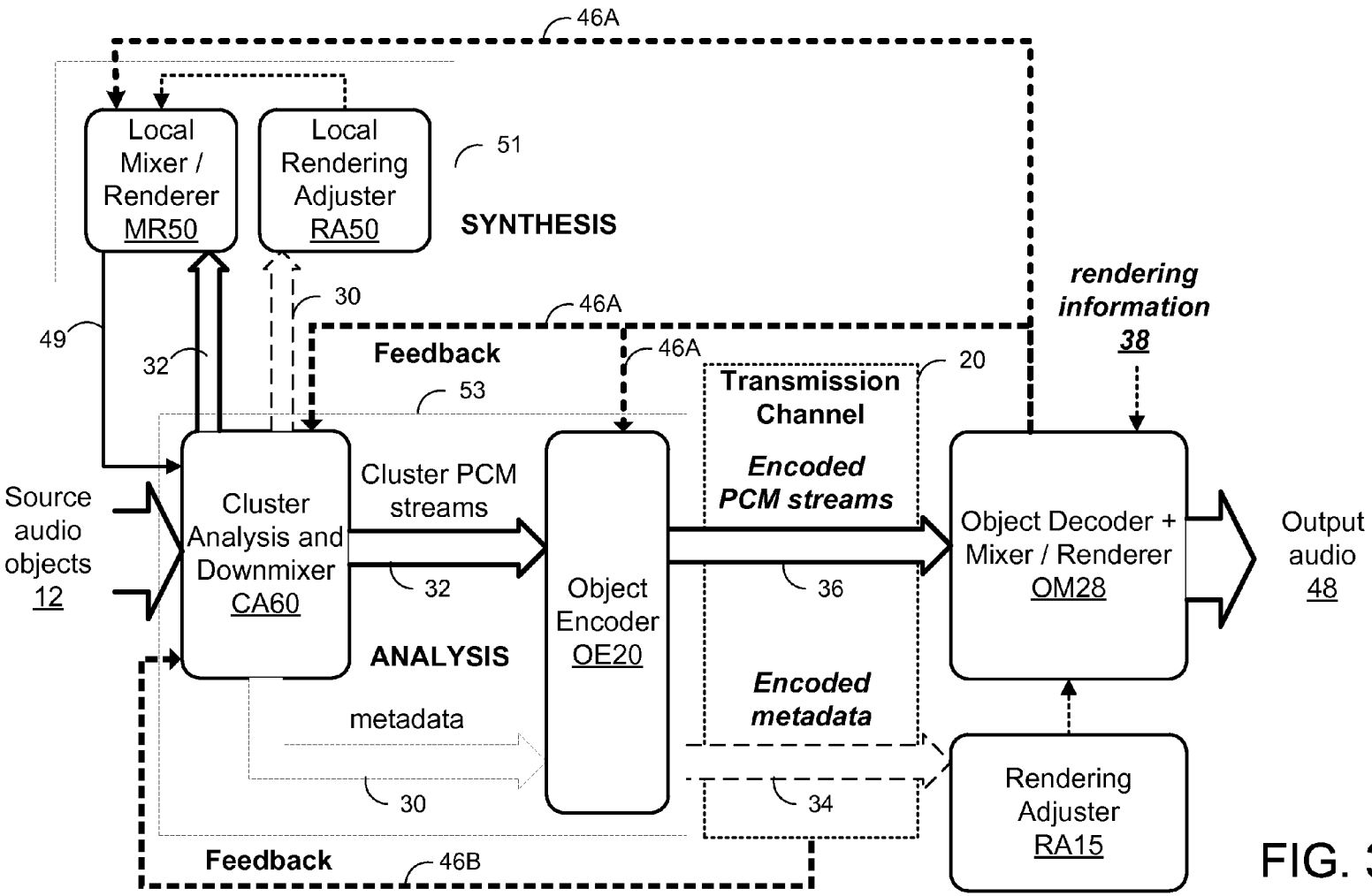
FIG. 39 shows a conceptual overview of a coding scheme, as described herein with cluster analysis and downmix design, and including a renderer local to the analyzer for cluster analysis by synthesis.

FIG. 39 shows a conceptual overview of a coding scheme, as described herein with cluster analysis and downmix design, and including a renderer local to the analyzer for cluster analysis by synthesis. The illustrated example system is similar to that of FIG. 11 but additionally includes a synthesis component 51 including local mixer/renderer MR50 and local rendering adjuster RA50. The system includes a cluster analysis component 53 including cluster analysis and downmix module CA60 that may be implemented to perform method MB100, an object decoder and mixer/renderer module OM28, and a rendering adjustments module RA15 that may be implemented to perform method M200.

The cluster analysis and downmixer CA60 produces a first grouping of the input objects 12 of L clusters and outputs the L clustered streams 32 to local mixer/renderer MR50. The cluster analysis and downmixer CA60 may additionally output corresponding metadata 30 for the L clustered streams 32 to the local rendering adjuster RA50. The local mixer/renderer MR50 renders the L clustered streams 32 and provides the rendered objects 49 to cluster analysis and downmixer CA60, which may perform task TB300 to calculate an error of the first grouping relative to the input audio objects 12. As described above (e.g., with reference to tasks TB100C and TB300C), such a loop may be iterated until an error condition and/or other end condition is satisfied. The cluster analysis and downmixer CA60 may then perform task TB400 to produce a second grouping of the input objects 12 and output the L clustered streams 32 to the object encoder OE20 for encoding and transmission to the remote renderer, the object decoder and mixer/renderer OM28.

By performing cluster analysis by synthesis in this manner, i.e., locally rendering the clustered streams 32 to synthesize a corresponding representation of the encoded sound field, the system of FIG. 39 may improve the cluster analysis. In some instances, cluster analysis and downmixer CA60 may perform the error calculation and comparison to accord with parameters provided by feedback 46A or feedback 46B. For example, the error threshold may be defined, at least in part, by bit rate information for the transmission channel provided in feedback 46B. In some instances, feedback 46A parameters affect the coding of streams 32 to encoded streams 36 by the object encoder OE20. In some instances, the object encoder OE20 includes the cluster analysis and downmixer CA60, i.e., an encoder to encode objects (e.g., streams 32) may include the cluster analysis and downmixer CA60.

The methods and apparatus disclosed herein may be applied generally in any transceiving and/or audio sensing application, including mobile or otherwise portable instances of such applications and/or sensing of signal components from far-field sources. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein (e.g., smartphones, tablet computers) may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The foregoing presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 44.1, 48, or 192 kHz).

Goals of a multi-microphone processing system may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing for more aggressive noise reduction.

An apparatus as disclosed herein (e.g., apparatus A100, A200, MF100, MF200) may be implemented in any combination of hardware with software, and/or with firmware, that is deemed suitable for the intended application. For example, the elements of such an apparatus may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of the elements of the apparatus may be implemented within the same array or arrays. Such an array or arrays may be implemented within one or more chips (for example, within a chipset including two or more chips).

One or more elements of the various implementations of the apparatus disclosed herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a downmixing procedure as described herein, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., methods M100, M200) may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor-readable storage medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein (e.g., apparatus A100 or MF100) may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

What is claimed is:

1. A method of audio signal processing, the method comprising:

based on spatial information for each of N audio objects, grouping a plurality of audio objects that includes the N audio objects into L clusters, where L is less than N;

mixing the plurality of audio objects into L audio streams;

based on the spatial information and the grouping, producing metadata that indicates spatial information for each of the L audio streams, wherein a maximum value for L is based on information received from at least one of a transmission channel, a decoder, and a renderer; and outputting, for transmission, a representation the L audio streams and the metadata that indicates the spatial information for each of the L audio streams.

2. The method of claim 1, wherein the information received includes information describing a state of the transmission channel and the maximum value of L is based at least on the state of the transmission channel.

3. The method of claim 1, wherein the information received includes information describing a capacity of the transmission channel and the maximum value of L is based at least on the capacity of the transmission channel.

4. The method of claim 1, wherein the information received is information received from a decoder.

5. The method of claim 1, wherein the information received is information received from a renderer.

6. The method of claim 1, wherein the information received comprises a bit rate indication that indicates a bit rate and the maximum value of L is based at least on the bit rate.

7. The method of claim 1, wherein the N audio objects comprises N sets of coefficients, and wherein mixing the plurality of audio objects into L audio streams comprises mixing the plurality of sets of coefficients into L sets of coefficients.

8. The method of claim 7, wherein each of N sets of coefficients is a hierarchical set of basis function coefficients.

9. The method of claim 7, wherein each of the N sets of coefficients is a set of spherical harmonic coefficients.

10. The method of claim 7, wherein each of the L sets of coefficients is a set of spherical harmonic coefficients.

11. The method of claim 7, wherein mixing the plurality of audio objects into L audio streams comprises, for each of at least one among the L clusters, calculating a sum of the sets of coefficients of the N sets of coefficients grouped into the cluster.

12. The method of claim 7, wherein mixing the plurality of audio objects into L audio streams comprises calculating each among the L sets of coefficients as a sum of the corresponding ones among the N sets of coefficients.

13. The method of claim 7, wherein the information received comprises a bit rate indication that indicates a bit rate, and wherein, for at least one among the L sets of coefficients, a total number of coefficients in the set is based on a bit rate indication.

14. The method of claim 7, wherein, for at least one among the L sets of coefficients, a total number of coefficients in the set is based on the information received.

15. An apparatus for audio signal processing, the apparatus comprising:

means for receiving information from at least one of a transmission channel, a decoder, and a renderer;

means for grouping, based on spatial information for each of N audio objects, a plurality of audio objects that includes the N audio objects into L clusters, where L is less than N and wherein a maximum value for L is based on the information received;

means for mixing the plurality of audio objects into L audio streams;

means for producing, based on the spatial information and the grouping, metadata that indicates spatial information for each of the L audio streams; and means for outputting, for transmission, a representation the L audio streams and the metadata that indicates the spatial information for each of the L audio streams.

16. The apparatus of claim 15, wherein the information received includes information describing a state of the transmission channel and the maximum value of L is based at least on the state of the transmission channel.

17. The apparatus of claim 15, wherein the information received includes information describing a capacity of the transmission channel and the maximum value of L is based at least on the capacity of the transmission channel.

18. The apparatus of claim 15, wherein the information received is information received from a decoder.

19. The apparatus of claim 15, wherein the information received is information received from a renderer.

20. The apparatus of claim 15, wherein the information received comprises a bit rate indication that indicates a bit rate and the maximum value of L is based at least on the bit rate.

21. The apparatus of claim 15, wherein the N audio objects comprises N sets of coefficients, and wherein the means for mixing the plurality of audio objects into L audio streams comprises means for mixing the plurality of sets of coefficients into L sets of coefficients.

22. The apparatus of claim 21, wherein each of N sets of coefficients is a hierarchical set of basis function coefficients.

23. The apparatus of claim 21, wherein each of the N sets of coefficients is a set of spherical harmonic coefficients.

24. The apparatus of claim 21, wherein each of the L sets of coefficients is a set of spherical harmonic coefficients.

25. The apparatus of claim 21, wherein the means for mixing the plurality of audio objects into L audio streams comprises, for each of at least one among the L clusters, means for calculating a sum of the sets of coefficients of the N sets of coefficients grouped into the cluster.

26. The apparatus of claim 21, wherein the means for mixing the plurality of audio objects into L audio streams comprises means for calculating each among the L sets of coefficients as a sum of the corresponding ones among the N sets of coefficients.

27. The apparatus of claim 21, wherein the information received comprises a bit rate indication that indicates a bit rate, and wherein, for at least one among the L sets of coefficients, a total number of coefficients in the set is based on a bit rate indication.

28. The apparatus of claim 21, wherein, for at least one among the L sets of coefficients, a total number of coefficients in the set is based on the information received.

29. A device for audio signal processing, the device comprising:

a cluster analysis module configured to group, based on spatial information for each of N audio objects, a plurality of audio objects that includes the N audio objects into L clusters, where L is less than N, wherein the cluster analysis module is configured to receive information from at least one of a transmission channel, a decoder, and a renderer, and wherein a maximum value for L is based on the information received;

a downmix module configured to mix the plurality of audio objects into L audio streams, a metadata downmix module configured to produce, based on the spatial information and the grouping, metadata that indicates spatial information for each of the L audio streams; and an encoder configured to output, for transmission, a representation the L audio streams and the metadata that indicates the spatial information for each of the L audio streams.

30. The device of claim 29, wherein the information received includes information describing a state of the transmission channel and the maximum value of L is based at least on the state of the transmission channel.

31. The device of claim 29, wherein the information received includes information describing a capacity of the transmission channel and the maximum value of L is based at least on the capacity of the transmission channel.

32. The device of claim 29, wherein the information received is information received from a decoder.

33. The device of claim 29, wherein the information received is information received from a renderer.

34. The device of claim 29, wherein the information received comprises a bit rate indication that indicates a bit rate and the maximum value of L is based at least on the bit rate.

35. The device of claim 29, wherein the N audio objects comprises N sets of coefficients, and wherein the downmix module is configured to mix the plurality of audio objects into L audio streams by mixing the plurality of sets of coefficients into L sets of coefficients.

36. The device of claim 35, wherein each of N sets of coefficients is a hierarchical set of basis function coefficients.

37. The device of claim 35, wherein each of the N sets of coefficients is a set of spherical harmonic coefficients.

38. The device of claim 35, wherein each of the L sets of coefficients is a set of spherical harmonic coefficients.

39. The device of claim 35, wherein the downmix module is configured to mix the plurality of audio objects into L audio streams by, for each of at least one among the L clusters, calculating a sum of the sets of coefficients of the N sets of coefficients grouped into the cluster.

40. The device of claim 35, wherein the downmix module is configured to mix the plurality of audio objects into L audio streams by calculating each among the L sets of coefficients as a sum of the corresponding ones among the N sets of coefficients.

41. The device of claim 35, wherein the information received comprises a bit rate indication that indicates a bit rate, and wherein, for at least one among the L sets of coefficients, a total number of coefficients in the set is based on a bit rate indication.

42. The device of claim 35, wherein, for at least one among the L sets of coefficients, a total number of coefficients in the set is based on the information received.

43. A non-transitory computer-readable storage medium having stored thereon instructions that, when executed, cause one or more processors to:

based on spatial information for each of N audio objects, group a plurality of audio objects that includes the N audio objects into L clusters, where L is less than N;

mix the plurality of audio objects into L audio streams;

based on the spatial information and the grouping, produce metadata that indicates spatial information for each of the L audio streams, wherein a maximum value for L is based on information received from at least one of a transmission channel, a decoder, and a renderer; and output, for transmission, a representation the L audio streams and the metadata that indicates the spatial information for each of the L audio streams.

* * * * *